US009087655B2

(12) United States Patent
Enomoto et al.

(10) Patent No.: US 9,087,655 B2
(45) Date of Patent: Jul. 21, 2015

(54) CONTACT DEVICE

(75) Inventors: Hideki Enomoto, Nara (JP); Ritu Yamamoto, Mie (JP); Yoshihisa Fukuda, Osaka (JP); Yoji Ikeda, Hokkaido (JP); Ryosuke Ozaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 13/636,029

(22) PCT Filed: Mar. 2, 2011

(86) PCT No.: PCT/IB2011/000420

§ 371 (c)(1),
(2), (4) Date: Sep. 19, 2012

(87) PCT Pub. No.: WO2011/117696

PCT Pub. Date: Sep. 29, 2011

(65) Prior Publication Data

US 2013/0012037 A1 Jan. 10, 2013

(30) Foreign Application Priority Data

Mar. 25, 2010 (JP) ..... 2010-070780
Mar. 25, 2010 (JP) ..... 2010-070781

(51) Int. Cl.
*H01H 9/30* (2006.01)
*H01H 9/02* (2006.01)
(Continued)

(52) U.S. Cl.
CPC ..... *H01H 9/443* (2013.01); *H01H 50/38* (2013.01); *H01H 50/546* (2013.01); *H01H 9/446* (2013.01); *H01H 51/065* (2013.01); *H01H 2050/025* (2013.01)

(58) Field of Classification Search
CPC ..... H01H 9/443; H01H 50/38; H01H 50/546; H01H 9/446; H01H 2050/025; H01H 51/065; H01H 1/20; H01H 2001/545; H01F 7/1615
USPC ..... 335/78–86, 124, 128–135, 201, 202
See application file for complete search history.

(56) References Cited

U.S. PATENT DOCUMENTS 4,367,448 A * 1/1983 Nishizako ..... 335/201
5,546,061 A 8/1996 Okabayashi et al.
(Continued)

FOREIGN PATENT DOCUMENTS

EP 1168392 1/2002
EP 2141714 1/2010
(Continued)

OTHER PUBLICATIONS

International Search Report dated Jul. 19, 2011.
(Continued)

*Primary Examiner* — Bernard Rojas
(74) *Attorney, Agent, or Firm* — Greenblum & Bernstein P.L.C.

(57) ABSTRACT

A contact device includes a contact point block, a drive unit, and permanent magnets. The contact point block includes fixed terminals having fixed contact points and a movable contactor having movable contact points arranged side by side on one surface of the movable contactor. The movable contact points are configured to come into contact and out of contact with the fixed contact points. The drive unit drives the movable contactor such that the movable contact points come into contact and out of contact with the fixed contact points. The permanent magnets are arranged in a mutually opposing relationship across the contact point block along a direction orthogonal to an arrangement direction of the movable contact points and to a direction in which the movable contact points come into contact and out of contact with the fixed contact points. The permanent magnets are provided with mutually-opposing surfaces having the same polarity.

39 Claims, 38 Drawing Sheets

(51) Int. Cl.

| | |
|---|---|
| ***H01H 9/44*** | (2006.01) |
| ***H01H 50/38*** | (2006.01) |
| ***H01H 50/54*** | (2006.01) |
| *H01H 51/06* | (2006.01) |
| *H01H 50/02* | (2006.01) |

(56) References Cited

U.S. PATENT DOCUMENTS

| | | | | |
|---|---|---|---|---|
| 6,700,466 | B1 * | 3/2004 | Yamamoto et al. | 335/132 |
| 8,193,881 | B2 * | 6/2012 | Yuba et al. | 335/78 |
| 8,228,144 | B2 * | 7/2012 | Sugisawa et al. | 335/78 |
| 8,354,906 | B2 * | 1/2013 | Nagura et al. | 335/201 |
| 8,390,410 | B2 * | 3/2013 | Kojima et al. | 335/201 |
| 8,482,368 | B2 * | 7/2013 | Sasaki et al. | 335/201 |
| 8,519,811 | B2 * | 8/2013 | Sugisawa et al. | 335/177 |
| 2004/0066261 | A1 | 4/2004 | Nishida et al. | |
| 2005/0285704 | A1 | 12/2005 | Imanishi et al. | |
| 2006/0050466 | A1 | 3/2006 | Enomoto et al. | |
| 2009/0322454 | A1 | 12/2009 | Tanaka et al. | |

FOREIGN PATENT DOCUMENTS

| | | |
|---|---|---|
| JP | 10-154448 | 6/1998 |
| JP | 3321963 | 6/2002 |
| JP | 2004-071512 | 3/2004 |
| JP | 2005-056819 | 3/2005 |
| JP | 2008-226547 | 9/2008 |

OTHER PUBLICATIONS

Search report from E.P.O. (App. No. 13160280.7), mail date is Oct. 24, 2013.

Search report from E.P.O. (App. No. 11758885.5), mail date is Oct. 24, 2013.

* cited by examiner

CONTACT DEVICE

FIELD OF THE INVENTION

The present invention relates to a contact device.

BACKGROUND OF THE INVENTION

In the past, there is provided a contact device for use in, e.g., an electromagnetic relay, a switch or a timer, which has a magnetic blow structure in which an arc current generated when contact points comes into contact or out of contact with each other is drawn out by a magnetic force of a permanent magnet arranged near the contact points, thereby performing arc extinction.

As one example of the contact device having the magnetic blow structure, there is known a contact device that includes, as shown in FIG. 43, a contact point block 8 formed of a pair of fixed terminals 81 having fixed contact points 811 and a movable contactor 82 having a pair of movable contact points 821 coming into contact and out of contact with the fixed contact points 811, a drive block (not shown) for driving the movable contactor 82 and a plurality of permanent magnets 9 arranged near the contact point block 8 (see, e.g., Japanese Patent No. 3321963).

The movable contactor 82 is formed into a substantially rectangular plate shape. The movable contact points 821 are arranged side by side along the longitudinal direction of the movable contactor 82. As the movable contactor 82 is moved toward the fixed terminals 81 by the drive block, the movable contact points 821 come into contact with the fixed contact points 811.

The permanent magnets 9 are arranged at one and the other lateral sides of the movable contactor 82 so as to oppose to each other across the contact point block 8. In this regard, each pair of the permanent magnets 9 opposing to each other across the contact point block 8 is arranged near each pair of the single fixed contact point 811 and the single movable contact point 821 coming into contact and out of contact with the fixed contact point 811. That is to say, there are provided two pairs of the permanent magnets 9.

Each pair of the permanent magnets 9 is arranged such that the polarities of the mutually-opposing surfaces of the permanent magnets 9 differ from each other. For example, the permanent magnets 9 arranged at one lateral side of the movable contactor 82 (at the upper side in FIG. 43) have N-pole surfaces opposing to the contact point block 8. The permanent magnets 9 arranged at the other lateral side of the movable contactor 82 (at the lower side in FIG. 43) have S-pole surfaces opposing to the contact point block 8. In other words, the permanent magnets 9 arranged at one lateral side of the movable contactor 82 are identical in the polarity of the surfaces opposing to the movable contactor 82. The permanent magnets 9 arranged at the other lateral side of the movable contactor 82 are identical in the polarity of the surfaces opposing to the movable contactor 82. This helps strengthen the magnetic fields flowing across the contact points.

If an electric current flows from one longitudinal side of the movable contactor 82 toward the other longitudinal side (from the left side toward the right in FIG. 43), the arc currents generated when each pair of the contact points comes into contact and out of contact with each other are drawn out away from each other. In other words, the arc current generated at one longitudinal side of the movable contactor 82 (at the left side in FIG. 43) is drawn out toward the one longitudinal side direction. The arc current generated at the other longitudinal side of the movable contactor 82 (at the right side in FIG. 43) is drawn out toward the other longitudinal side direction.

However, if an electric current flows in the reverse direction (from the right side toward the left side), the arc currents generated in the respective pairs of the contact points are drawn out toward each other. For that reason, if an electric current such as a regenerative electric current or the like flows through the contact device in the direction opposite to the normal direction, the arc currents generated in the respective pairs of the contact points make contact with each other. This may possibly lead to short-circuit.

In light of this, there is provided a contact device in which, as shown in FIG. 42, a pair of permanent magnets 9 is arranged at the longitudinal opposite ends of a movable contactor 82 in an opposing relationship across a contact point block 8.

The contact device shown in FIGS. 41 and 42 includes a contact point block 8 formed of a pair of fixed terminals 81 having fixed contact points 811 and a movable contactor 82 having a pair of movable contact points 821 coming into contact and out of contact with the fixed contact points 811, a drive block (not shown) for driving the movable contactor 82 and a pair of permanent magnets 9 arranged near the contact point block 8 (see, e.g., Japanese Patent Application Publication Nos. 2004-71512 and 2008-226547).

The movable contactor 82 is formed into a substantially rectangular plate shape. The movable contact points 821 are arranged side by side along the longitudinal direction of the movable contactor 82. As the movable contactor 82 is moved toward the fixed terminals 81 by the drive block, the movable contact points 821 come into contact with the fixed contact points 811.

The permanent magnets 9 are arranged at one and the other longitudinal ends of the movable contactor 82 in an opposing relationship across the contact point block 8.

In the contact devices disclosed in Japanese Patent Application Publication Nos. 2004-71512 and 2008-226547, the permanent magnets 9 are identical in the polarity of the surfaces opposing to each other. Thus the distribution of the magnetic fluxes formed around one pair of the contact points is symmetrical with the distribution of the magnetic fluxes formed around the other pair of the contact points. Regardless of the flow direction of an electric current flowing through the movable contactor 82 along the longitudinal direction of the movable contactor 82, the arc currents generated in the respective pairs of the contact points are drawn out away from each other.

The arc currents generated between the contact points when the movable contact points 821 comes into contact and out of contact with the fixed contact points 811 are drawn out by the magnetic fields generated from the permanent magnets 9, whereby the arc is cut off.

In the contact device disclosed in Japanese Patent Application Publication No. 2004-71512, however, the permanent magnets 9 are arranged in an opposing relationship with the respective end surfaces of the movable contactor 82 along the side-by-side arrangement direction of the movable contact points 821. This poses a problem in that the size of the contact device grows larger in the side-by-side arrangement direction of the movable contact points 821.

In the contact devices disclosed in Japanese Patent Application Publication Nos. 2004-71512 and 2008-226547, the permanent magnets 9 are arranged at the longitudinal opposite end sides of the contact point block 8. Therefore, the magnetic gap between the permanent magnets 9 becomes larger and the amount of magnetic fluxes leaked in the magnetic gap gets increased. For that reason, the force acting to draw out the arcs generated between the contact points is weakened. This may make it impossible to obtain high enough arc cutoff performance.

As one method of enhancing the arc cutoff performance in the contact devices stated above, it is thinkable to increase the size of the permanent magnets 9. In that case, however, there are posed problems such as an increase in the cost of the permanent magnets 9 and an increase in the size of the contact devices.

SUMMARY OF THE INVENTION

In view of the above, the present invention provides a contact device capable of obtaining stable arc cutoff performance and capable of enjoying size reduction.

In accordance with a first aspect of the present invention, there is provided a contact device, including: a contact point block including a pair of fixed terminals having fixed contact points and a movable contactor having a pair of movable contact points arranged side by side on one surface of the movable contactor, the movable contact points being configured to come into contact and out of contact with the fixed contact points; a drive unit for driving the movable contactor such that the movable contact points come into contact and out of contact with the fixed contact points; and a pair of permanent magnets arranged in a mutually opposing relationship across the contact point block along a direction orthogonal to an arrangement direction of the movable contact points and to a direction in which the movable contact points come into contact and out of contact with the fixed contact points, the permanent magnets provided with mutually-opposing surfaces having the same polarity.

In accordance with a second aspect of the present invention, there is provided a contact device, including: a contact point block including a pair of fixed terminals having fixed contact points and a movable contactor having a pair of movable contact points arranged side by side on one surface of the movable contactor, the movable contact points configured to come into contact and out of contact with the fixed contact points; a drive unit for driving the movable contactor such that the movable contact points come into contact and out of contact with the fixed contact points; a pair of permanent magnets arranged in a mutually opposing relationship across the contact point block along an arrangement direction of the movable contact points, the permanent magnets being provided with mutually-opposing surfaces having the same polarity; and a second yoke arranged between the permanent magnets.

With the present invention stated above, it is possible to provide a contact device capable of obtaining stable arc cutoff performance and capable of enjoying size reduction.

DETAILED DESCRIPTION OF THE PREFERRED EMBODIMENTS

Embodiments of the present invention will now be described with reference to the drawings which form a part hereof.

(First Embodiment)

Figure 1:
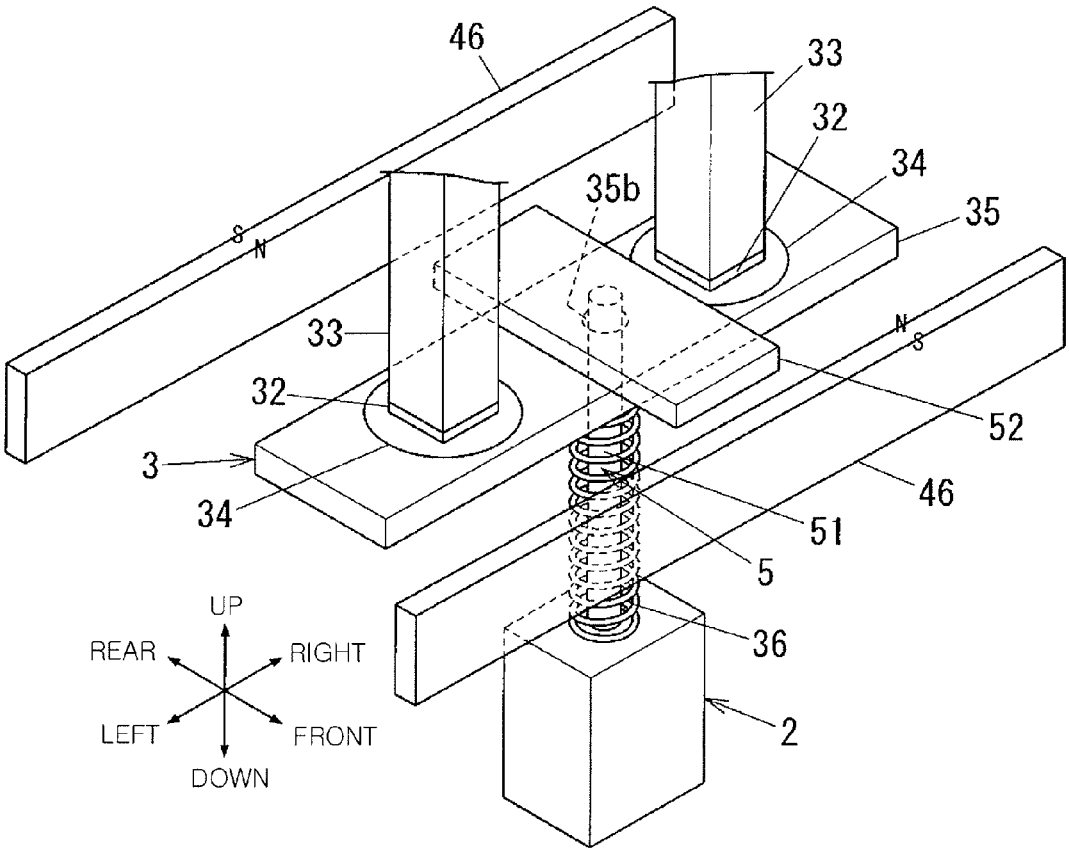
FIG. 1 is a schematic perspective view showing a contact device according to a first embodiment of the present disclosure.

A contact device according to a first embodiment will be described with reference to FIGS. 1 through 3. In the following description, up-down and left-right directions will be defined on the basis of the directions shown in FIG. 1. The direction orthogonal to the up-down and left-right directions will be referred to as front-rear direction.

The contact device of the present embodiment includes: a contact point block 3 formed of fixed terminals 33 having fixed contact points 32, a movable contactor 35 having movable contact points 34 coming into contact and out of contact with the fixed contact points 32 and a compression spring 36 for biasing the movable contactor 35 toward the fixed contact points 32; a drive unit formed of a movable shaft 5 movably inserted through an insertion hole 35*b* formed in the movable contactor 35 and configured to restrain movement of the movable contactor 35 toward the fixed contact points 32 and an electromagnet block 2 for driving the movable shaft 5 so that the movable contact points 34 can come into contact and out of contact with the fixed contact points 32; and a pair of permanent magnets 46 for extinguishing arcs generated in the contact point block 3 in a short time.

The movable contactor 35 is formed into a substantially rectangular plate shape. The movable contact points 34 are respectively fixed to the longitudinal (left-right) opposite end regions of the upper surface of the movable contactor 35. The insertion hole 35*b* is formed in the substantially central region of the movable contactor 35. The lower surface of the movable contactor 35 is pressed by the compression spring 36. In this regard, the movable contact points 34 are arranged in the positions equidistantly spaced apart from the insertion hole 35*b*.

The movable shaft 5 includes a shaft portion 51 movably inserted through the insertion hole 35*b* of the movable contactor 35 and a rectangular contact portion 52 arranged at the upper end of the shaft portion 51 to make contact with the upper surface of the movable contactor 35 and configured to restrain the movement of the movable contactor 35 toward the fixed contact points 32.

The contact portion 52 is made of a magnetic material such as a soft iron or the like. Thus the contact portion 52 serves as both a contact portion and a yoke. In the following description, the contact portion 52 will be called a yoke contact portion 52. The shaft portion 51 is connected to the central region of the lower surface of the yoke contact portion 52. The shaft portion 51 extends through the center of the movable contactor 35.

The permanent magnets 46 are formed into a substantially rectangular parallelepiped shape and are arranged to extend substantially parallel to the longitudinal direction of the movable contactor 35. The permanent magnets 46 are arranged at the front and rear sides of the movable contactor 35 in a mutually-opposing relationship across the gaps of the fixed contact points 32 and the movable contact points 34 (contact point gaps). The permanent magnets 46 include mutually-opposing surfaces having the same polarity (N-pole in the present embodiment). In the front permanent magnet 46, the front surface has an S-pole and the rear surface has an N-pole. In the rear permanent magnet 46, the front surface has an N-pole and the rear surface has an S-pole.

In the contact device of the present embodiment, if the movable shaft 5 is moved upward by the electromagnet block 2, the restraint on the movement of the movable contactor 35 toward the fixed contact points 32 is released and the movable contactor 35 is moved toward the fixed contact points 32 by the biasing force of the compression spring 36. As a result, the movable contact points 34 come into contact with the fixed contact points 32, whereby electric connection is established between the contact points.

Figure 2:
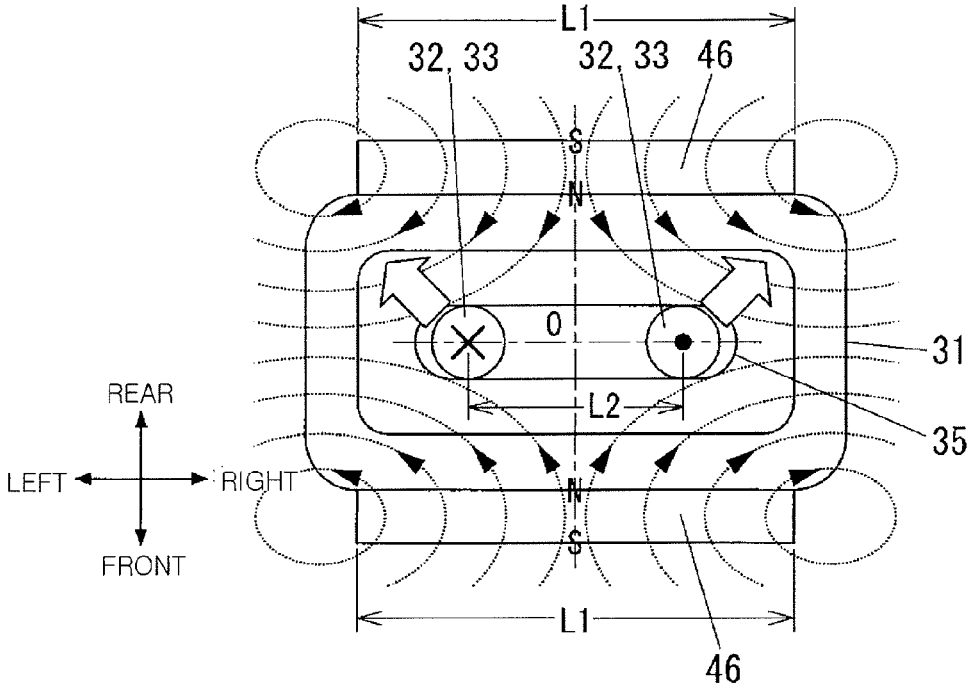
FIG. 2 is a partially enlarged view of the contact device of the first embodiment.

As shown in FIG. 2, magnetic fields are formed around the contact point block 3 by the permanent magnets 46. For that reason, regardless of the flow direction of an electric current flowing through the movable contactor 35, the arcs generated between the fixed contact points 32 and the movable contact points 34 (between the contact points) are drawn out away from each other and are extinguished. More specifically, if the electric current flows through the movable contactor 35 from the left side toward the right side in FIG. 2, the arc generated between the left contact points is drawn out toward the left rear side and the arc generated between the right contact points is drawn out toward the right rear side. This makes it possible to prevent short-circuiting of an arc current. If the electric current flows through the movable contactor 35 from the right side toward the left side in FIG. 2, the arc generated between the left contact points is drawn out toward the left front side and the arc generated between the right contact points is drawn out toward the right front side. This makes it possible to prevent short-circuiting of an arc current. In FIG. 2, reference numeral 31 designates a sealing container 31.

The permanent magnets 46 are arranged such that the length L1 thereof becomes larger than the distance L2 between the fixed contact points 32 and such that the center-line X extending through the centers of the mutually-opposing surfaces of the permanent magnets 46 and perpendicularly intersecting the permanent magnets 46 passes through the center point "0" between the fixed contact points 32. Therefore, magnetic fields symmetrical with respect to the centerline X are formed around the left contact points and the right contact points. The arcs generated between left contact points and between the right contact points are drawn out by the same magnitude of forces applied from the magnetic fields. Accordingly, the contact erosion of the left contact point becomes substantially equal to that of the right contact point. This makes it possible to obtain stable contact-point switching performance.

Figure 3:
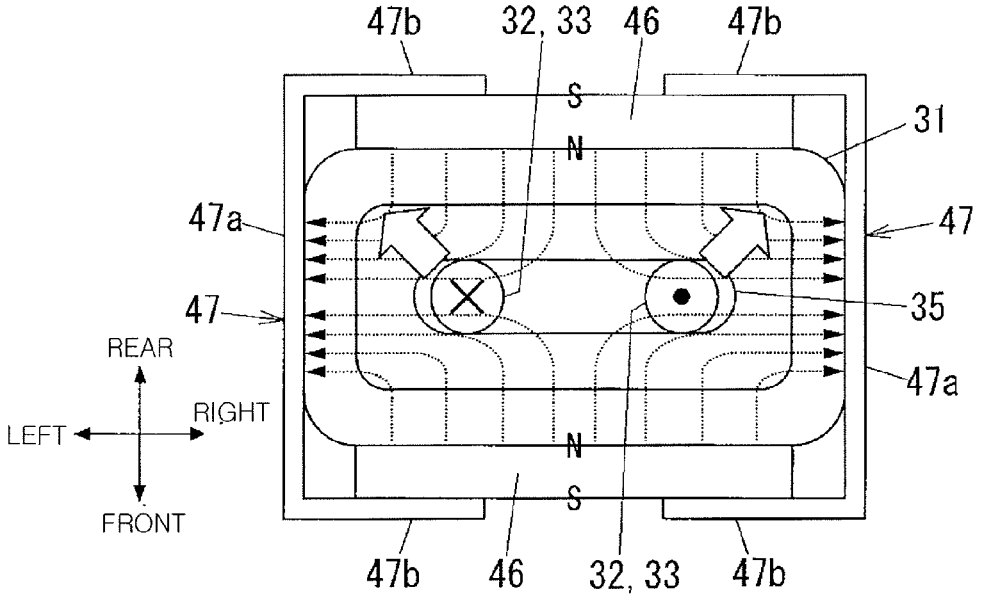
FIG. 3 is a partially enlarged view of the contact device of the first embodiment provided with a first yoke.

As shown in FIG. 3, a pair of first yokes 47 interconnecting the permanent magnets 46 may be provided in an opposing relationship with the longitudinal end surfaces of the movable contactor 35. Each of the first yokes 47 is formed into a substantially square bracket-like shape. Each of the first yokes 47 includes a base portion 47*a* opposing to the corresponding longitudinal end surface of the movable contactor 35 and a pair of extension portions 47*b* provided to extend from the opposite ends of the base portion 47*a* in a substantially perpendicular relationship with the base portion 47*a* and connected to the permanent magnets 46. In this regard, the extension portions 47*b* make contact with the S-pole surfaces of the permanent magnets 46. That is to say, one of the extension portions 47*b* is connected to the front surface of the front permanent magnet 46. The other extension portion 47*b* is connected to the rear surface of the rear permanent magnet 46.

Thus the magnetic fluxes coming out from the permanent magnets 46 are attracted by the first yokes 47. This suppresses leakage of the magnetic fluxes, thereby making it possible to increase the magnetic flux density near the contact points. This increases the arc drawing-out forces generated between the contact points. Accordingly, even if the size of the permanent magnets 46 is made small, the arc drawing-out forces can be maintained by installing the first yokes 47. It is therefore possible to reduce the size of the contact device and to assure cost-effectiveness while maintaining the arc cutoff performance.

Figure 4:
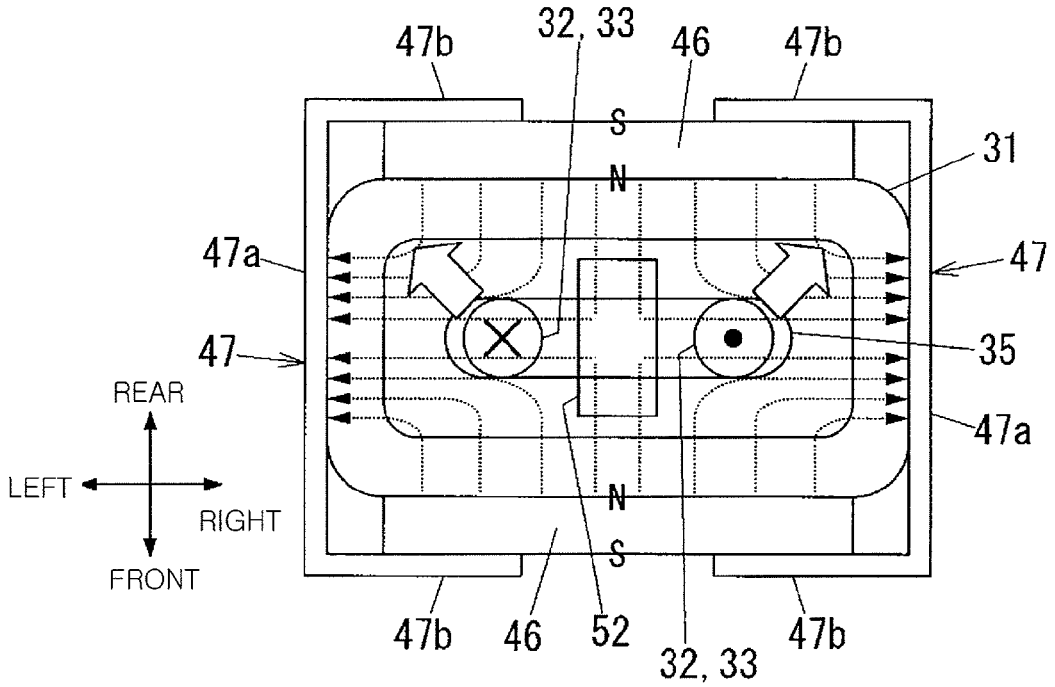
FIG. 4 is a partially enlarged view showing a modification of the contact device of the first embodiment.

As shown in FIG. 4, a second yoke 52 making contact with the upper surface of the movable contactor 35 is provided between the permanent magnets 46 and is arranged substantially parallel to the permanent magnets 46. The second yoke 52 is arranged in the midst of the magnetic fluxes generated by the permanent magnets 46. A portion of the magnetic fluxes is perpendicularly incident on the second yoke 52. In this regard, the magnetic fluxes incident upon the front and rear surfaces of the second yoke 52 repel against each other substantially at the center of the second yoke 52 and come out from the left and right side surfaces of the second yoke 52. Then, the magnetic fluxes pass through the vicinities of the contact points and move toward the first yokes 47. Accordingly, the number of magnetic fluxes passing through the vicinities of the contact points is increased due to the provision of the second yoke 52. This increases the forces of drawing out the arc currents, thereby making it possible to enhance the arc cutoff performance. In other words, due to the provision of the second yoke 52, the magnetic fluxes generated between the permanent magnets 46 can be efficiently guided toward the vicinities of the contact points.

Figure 5A:
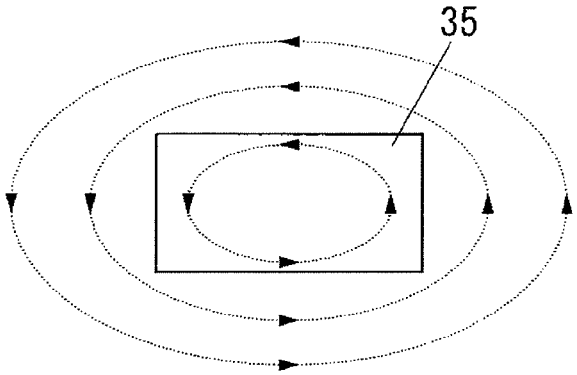
FIGS. 5A and 5B are schematic side views of the contact device of the first embodiment.

As shown in FIG. 5A, if an electric current flows through a conductor (the movable contactor 35) around which a yoke is not provided, magnetic fluxes are concentrically generated about the conductor. In FIG. 5A, therefore, the number of the magnetic fluxes moving from the right side toward the left side within the conductor is substantially equal to the number of the magnetic fluxes moving from the left side toward the right side within the conductor. For that reason, no electromagnetic force is generated in the conductor.

Figure 5B:
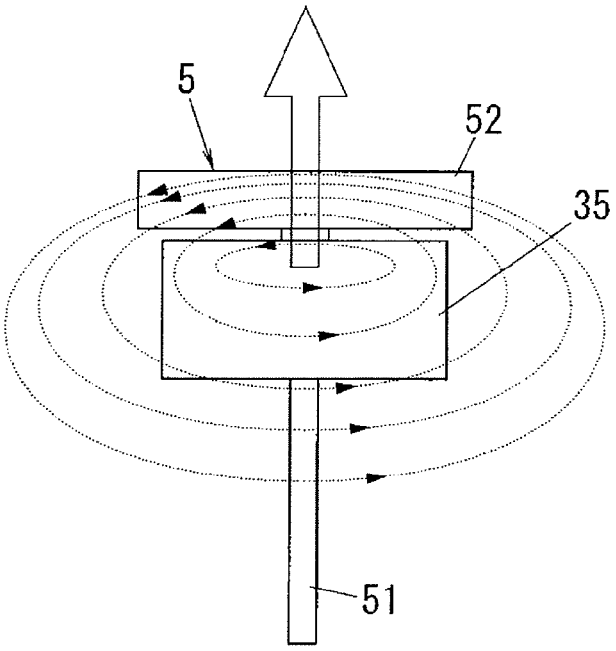

In the contact device of the present embodiment, however, when the contact points are electrically connected, the balance of the magnetic fields generated around the movable contactor 35 is collapsed under the influence of the yoke contact portion 52 adjoining the upper surface of the movable contactor 35 as shown in FIG. 5B. In FIG. 5B, most of the magnetic fluxes moving from the right side toward the left side are attracted by the yoke contact portion 52. Therefore, as compared with a case where no yoke is provided near the movable contactor 35 as shown in FIG. 5A, the number of the magnetic fluxes going from the right side toward the left side within the movable contactor 35 is decreased. In the following description, the yoke contact portion 52 will be called a second yoke 52.

On the other hand, in FIG. 5B, all the magnetic fluxes going from the left side toward the right side are moved upward. Therefore, as compared with a case where no yoke is provided near the movable contactor 35 as shown in FIG. 5A, the number of the magnetic fluxes going from the left side toward the right side within the movable contactor 35 is increased.

Then, the upward electromagnetic force applied to the movable contactor 35 by the magnetic fluxes going from the left side toward the right side within the movable contactor 35 becomes larger than the downward electromagnetic force applied to the movable contactor 35 by the magnetic fluxes going from the right side toward the left side within the movable contactor 35. Consequently, an upward electromagnetic force (attraction force) is applied to the movable contactor 35. That is to say, an attraction force acting toward the fixed contact points in the direction substantially parallel to the displacing direction of the movable contactor 35 (in the vertically upward direction) is applied to the movable contactor 35.

In this regard, the vertically upward attraction force applied to the movable contactor 35 is 180 degrees opposite to the contact point repulsion force (the downward force) generated in the movable contactor 35. Thus the vertically upward attraction force acts in the direction in which the contact point repulsion force is most efficiently negated. For that reason, the contact point repulsion force can be efficiently negated by the attraction force. This makes it possible to suppress a decrease in the contact pressure acting between the contact points.

In the contact device of the present embodiment, therefore, the contact erosion of the left contact point becomes substantially equal to that of the right contact point due to the provision of the permanent magnets 46. In addition, the second yoke 52 attracts the movable contactor 35 toward the fixed contact points. Consequently, the contact device of the present embodiment is capable of increasing the endurance against the electromagnetic repulsion force generated during load short-circuit, providing stable arc cutoff performance and obtaining stable contact-point switching performance.

In the present embodiment, the second yoke 52 serves as both a yoke and a contact portion. The second yoke 52 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 52 and the shaft portion 51 are one-piece formed in the present embodiment, it may be possible to independently form the second yoke 52 and the shaft portion 51, after which the shaft portion 51 may be fitted to the second yoke 52.

Figure 6B:
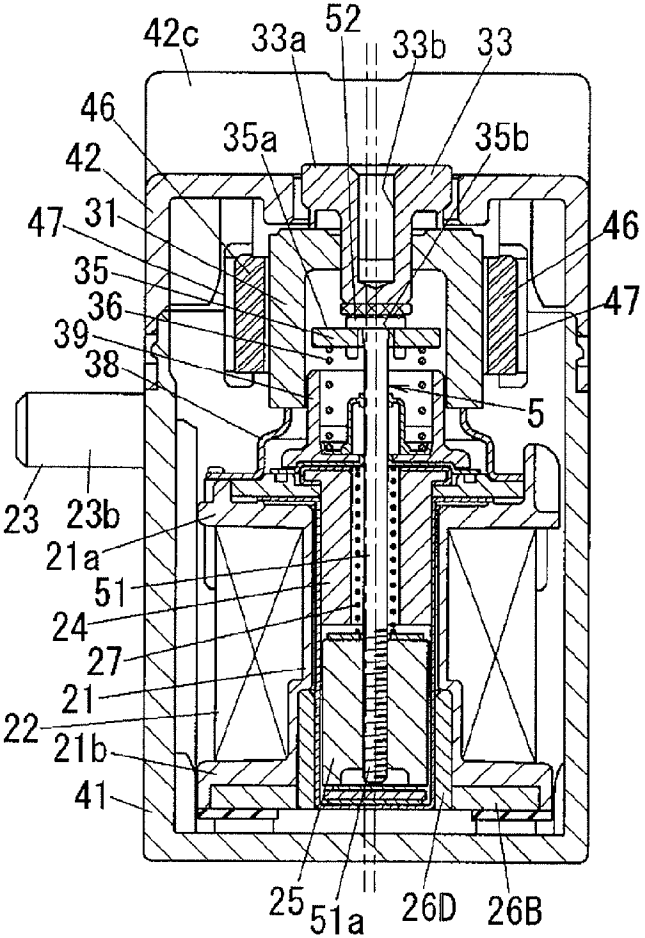
FIGS. 6A and 6B are section views showing an electromagnetic relay provided with the contact device of the first embodiment.
Figure 6A:
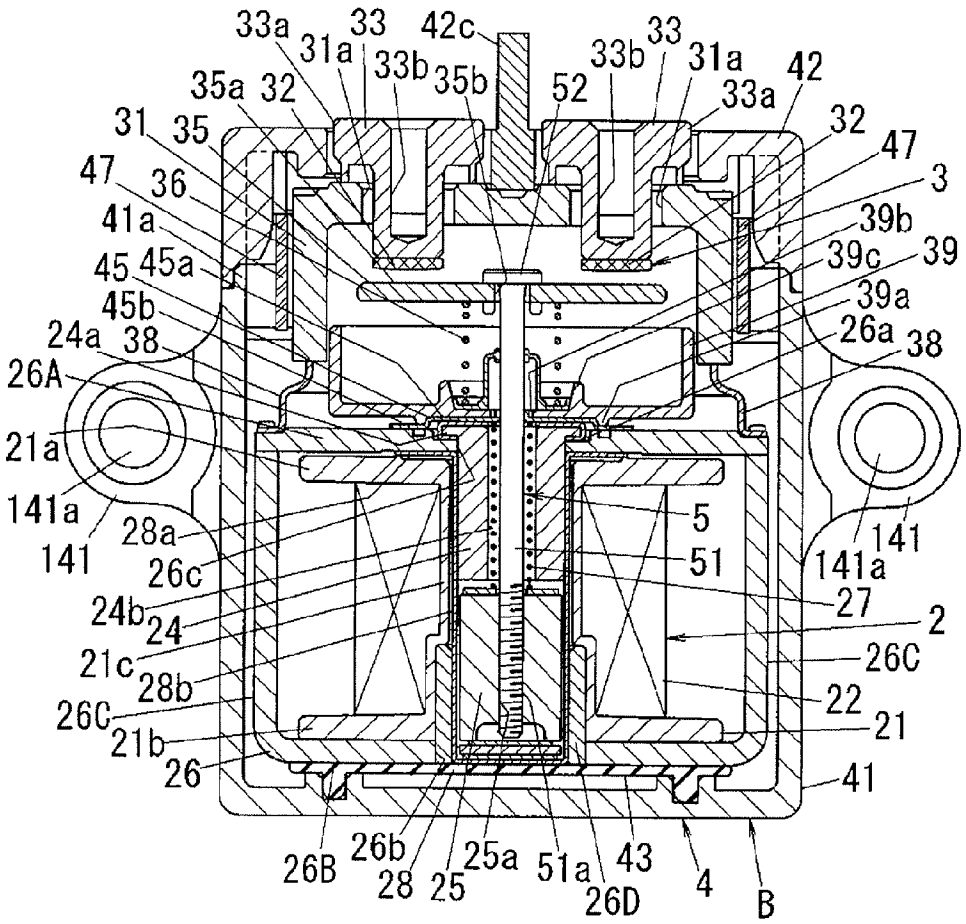
Figure 7B:
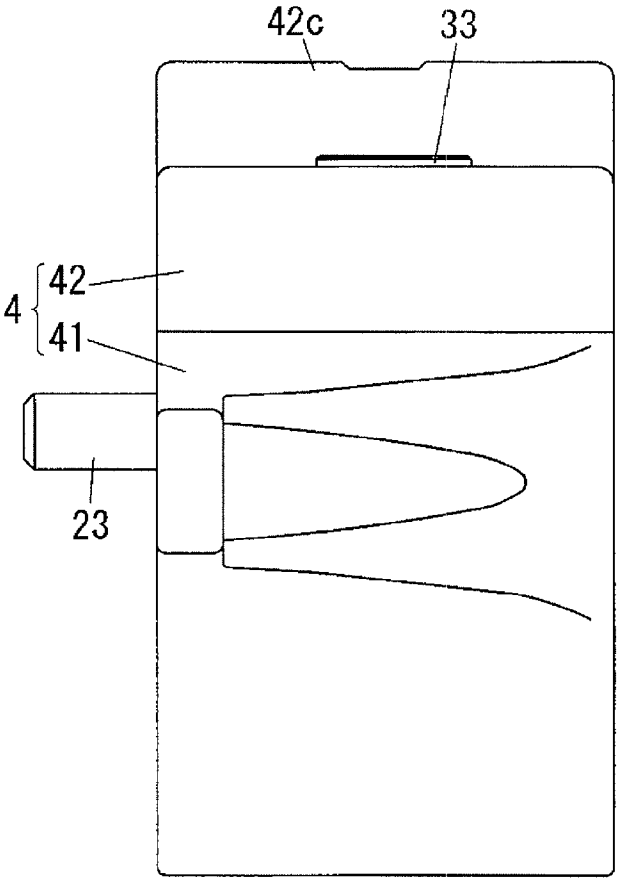
FIGS. 7A and 7B are outward appearance views of the electromagnetic relay provided with the contact device of the first embodiment.
Figure 7A:
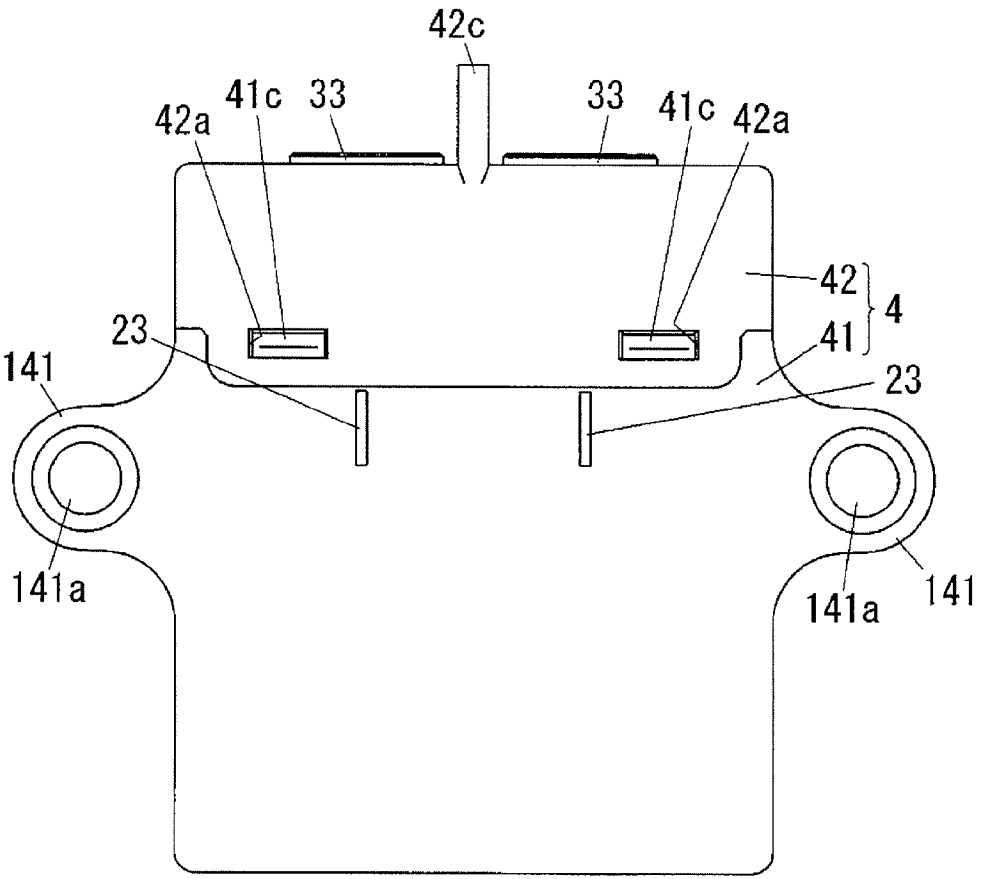

The contact device of the present embodiment can be used in, e.g., an electromagnetic relay shown in FIGS. 6A and 6B.

As shown in FIGS. 6A, 6B, 7A, 7B and 8A through 8C, the electromagnetic relay includes a hollow box-shaped case 4. An internal block 1 is formed by integrally combining the electromagnet block 2 and the contact point block 3. The internal block 1, the permanent magnets 46 and the first yokes 47 are stored within the case 4. In the following description, up-down and left-right directions will be defined on the basis of the directions shown in FIG. 6A. The direction orthogonal to the up-down and left-right directions will be referred to as front-rear direction.

The electromagnet block 2 includes: a hollow tubular coil bobbin 21 made of an insulating material and wound with an exciting coil 22; coil terminals 23 respectively connected to the opposite ends of the exciting coil 22; a fixed iron core 24 fixed inside the coil bobbin 21 and magnetized by the exciting coil 22 upon energizing the exciting coil 22; a movable iron core 25 moving in the axial direction within the coil bobbin 21, the movable iron core 25 arranged within the coil bobbin 21 in an axially-opposing relationship with the fixed iron core 24 and attracted toward the fixed iron core 24 in response to energization and de-energization of the exciting coil 22; a yoke 26 made of a magnetic material and arranged to surround the coil bobbin 21; and a return spring 27 arranged within the coil bobbin 21 and configured to bias the movable iron core 25 downward.

The contact point block 3 includes: a sealing container 31 made of an insulating material and formed into a hollow box shape so as to have an opening on the lower surface thereof; fixed terminals 33 formed into a substantially cylindrical columnar shape and inserted through the upper surface of the sealing container 31, the fixed terminals 33 including fixed contact points 32 formed on the lower surfaces thereof; a movable contactor 35 arranged within the sealing container 31 and provided with movable contact points 34 coming into contact and out of contact with the fixed contact points 32; and a compression spring 36 making contact with the lower surface of the movable contactor 35 and biasing the movable contactor 35 toward the fixed contact points 32.

The coil bobbin 21 is formed into a hollow cylindrical shape by a resin material. The coil bobbin 21 includes flanges 21*a* and 21*b* formed at the upper and lower ends thereof. The coil bobbin 21 further includes a cylinder portion 21*c* wound with the exciting coil 22. The inner diameter of the lower end extension of the cylinder portion 21*c* is larger than the inner diameter of the upper end extension thereof.

Figure 8A:
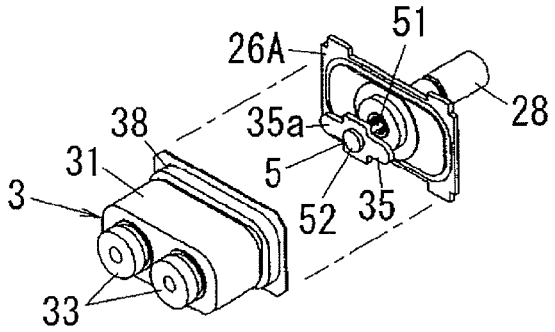
FIGS. 8A through 8C are exploded perspective views of the electromagnetic relay provided with the contact device of the first embodiment.
Figure 8B:
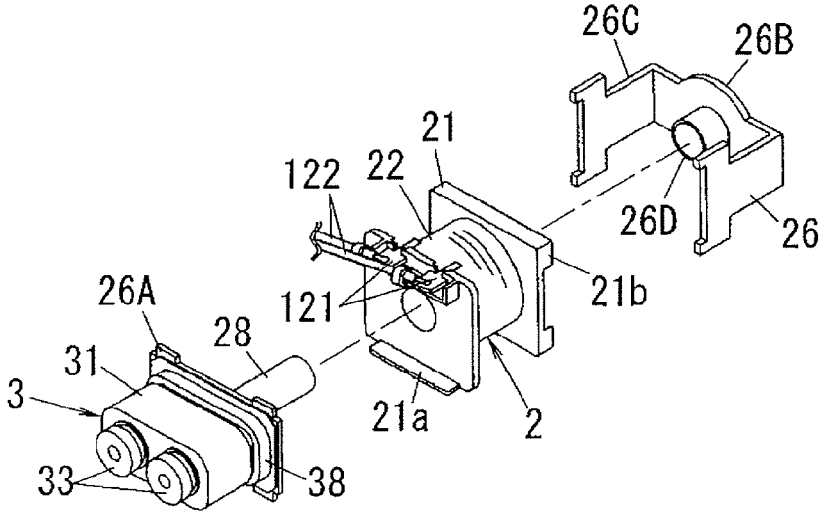
Figure 8C:
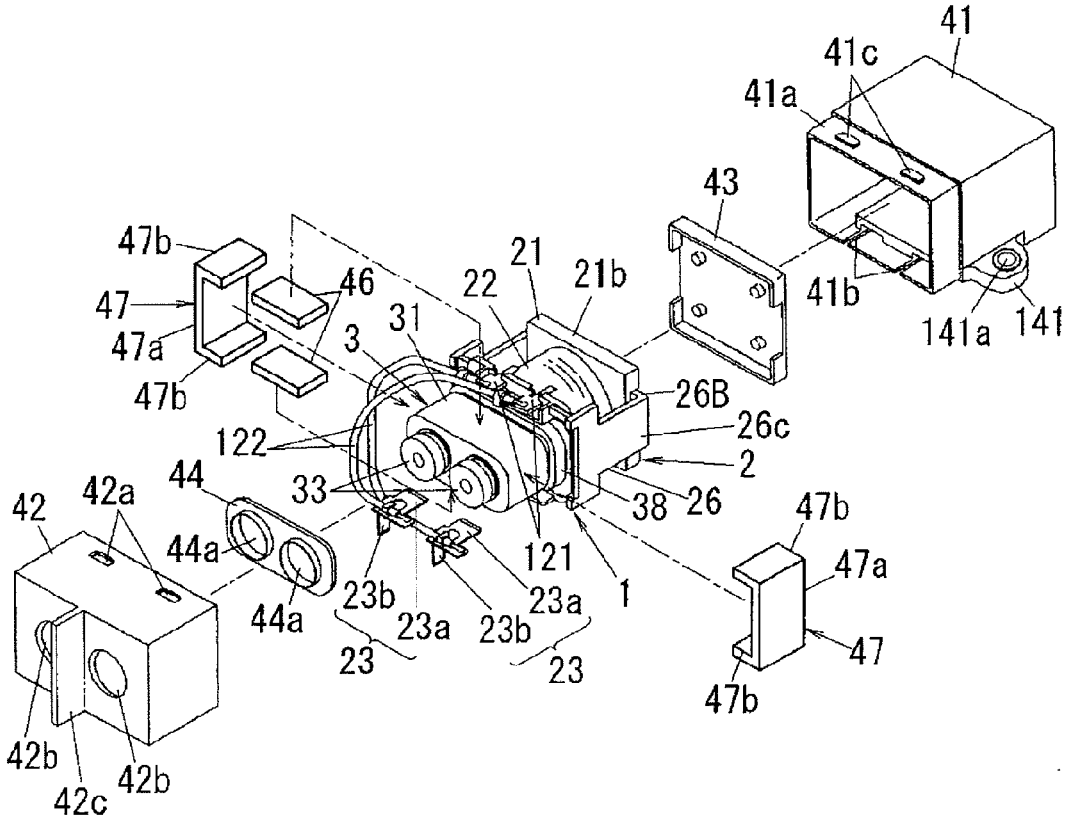

As shown in FIG. 8C, the end portions of the exciting coil 22 are respectively connected to a pair of terminal portions 121 arranged in the flange 21*a* of the coil bobbin 21 and are respectively connected to the coil terminals 23 through lead wires 122 connected to the terminal portions 121.

Each of the coil terminals 23 includes a base portion 23*a* made of an electrically conductive material such as copper or the like and connected to each of the lead wires 122 by a solder, and a terminal portion 23*b* extending substantially perpendicularly from the base portion 23*a*.

As shown in FIG. 8B, the yoke 26 includes a first yoke plate 26A formed into a substantially rectangular plate shape and arranged above the coil bobbin 21, a second yoke plate 26B formed into a substantially rectangular plate shape and arranged below the coil bobbin 21 and a third yoke plate 26C extending upward from the left and right ends of the second yoke plate 26B and connected to the first yoke plate 26A.

A recess portion 26*a* is formed in the substantially central region of the upper surface of the first yoke plate 26A. An insertion hole 26*c* is formed in the substantially central region of the recess portion 26*a*. A cylindrical member 28 having a closed bottom and a flange 28*a* formed at the upper end thereof is inserted into the insertion hole 26*c*. The flange 28*a* is bonded to the recess portion 26*a*. In this regard, the movable iron core 25 formed into a substantially cylindrical columnar shape by a magnetic material is arranged at the lower end side within the cylinder portion 28*b* of the cylinder member 28. Moreover, the fixed iron core 24 formed into a substantially cylindrical columnar shape by a magnetic material is inserted into the cylinder portion 28*b*. The fixed iron core 24 and the movable iron core 25 are arranged in an opposing relationship with each other.

On the upper surface of the first yoke plate 26A, there is provided a metal-made cap member 45 whose peripheral portion is fixed to the first yoke plate 26A. The cap member 45 includes a raised portion 45*a* formed in the substantially central region thereof. The raised portion 45*a* defines a space for receiving a flange 24*a* formed at the upper end of the fixed iron core 24. Removal of the fixed iron core 24 is prevented by the cap member 45.

A cylindrical bush 26D made of a magnetic material is fitted to the gap defined between the inner circumferential surface of the lower end extension of the coil bobbin 21 and the outer circumferential surface of the cylinder member 28. The yoke 26, the fixed iron core 24 and the movable iron core 25 make up a magnetic circuit.

The return spring 27 is inserted through the axially-extending insertion hole 24*b* of the fixed iron core 24. The lower end of the return spring 27 makes contact with the upper surface of the movable iron core 25. The upper end of the return spring 27 makes contact with the lower surface of the cap member 45. The return spring 27 is retained between the movable iron core 25 and the cap member 45 in a compressed state, thereby resiliently biasing the movable iron core 25 downward.

The movable shaft 5 includes a shaft portion 51 formed into a vertically-elongated round rod shape by a non-magnetic material and a flange-like yoke contact portion 52 made of a magnetic material. The yoke contact portion 52 is arranged at the upper end of the shaft portion 51 and is one-piece formed with the shaft portion 51.

The shaft portion 51 is inserted through the insertion hole 45*b* formed in the substantially central region of the raised portion 45*a* of the cap member 45 and then through the return spring 27. The shaft portion 51 includes a thread portion 51*a* formed in the lower end extension thereof. The movable iron core 25 includes a thread hole 25*a* extending in the axial direction. The thread portion 51*a* of the shaft portion 51 is threadedly coupled to the thread hole 25*a* of the movable iron core 25, whereby the shaft portion 51 is connected to the movable iron core 25.

The yoke contact portion 52 is formed into a substantially rectangular plate shape by a soft iron. The yoke contact portion 52 restrains the movable contactor 35 from moving toward the fixed contact points. That is to say, the yoke contact portion 52 serves as a contact portion for restraining movement of the movable contactor 35 and as a yoke. In the following description, the yoke contact portion 52 will be called a second yoke 52.

The movable contactor 35 includes a body portion 35*a* formed into a substantially rectangular shape and an insertion hole 35*b* formed in the substantially central region thereof. Movable contact points 34 are fixed to the left and right end regions of the body portion 35*a*. The movable shaft 5 is inserted through the insertion hole 35*b*.

The fixed terminals 33 are formed into a substantially cylindrical columnar shape by an electrically conductive material such as copper or the like. Each of the fixed terminals 33 includes a flange 33*a* formed at the upper end thereof. Fixed contact points 32 opposing to the movable contact points 34 are fixed to the lower surfaces of the fixed terminals 33. Each of the fixed terminals 33 further includes a thread hole 33*b* extending axially from the upper surface of each of the fixed terminals 33. A thread portion of an external load not shown in the drawings is threadedly coupled to the thread hole 33*b*, whereby the external load is connected to the fixed terminals 33.

The sealing container 31 is formed into a hollow box shape by a heat-resistant material such as ceramic or the like so as to have an opening on the lower surface thereof. Two through-holes 31*a*, through which the fixed terminals 33 are inserted, are formed side by side on the upper surface of the sealing container 31. The fixed terminals 33 are inserted through the through-holes 31*a* and soldered to the sealing container 31 in a state that the flanges 33*a* of the fixed terminals 33 protrude away from the upper surface of the sealing container 31. As shown in FIG. 8A, one end of a flange 38 is soldered to the peripheral edge of the opening of the sealing container 31. The other end of the flange 38 is soldered to the first yoke plate 26A, whereby the sealing container 31 is hermetically sealed.

In the opening of the sealing container 31, there is provided an insulating member 39 by which the arcs generated between the fixed contact points 32 and the movable contact points 34 are insulated from the joint portion of the sealing container 31 and the flange 38.

The insulating member 39 is formed into a substantially hollow rectangular parallelepiped shape by an insulating material such as ceramic or synthetic resin so as to have an opening on the upper surface thereof. The insulating member 39 includes a rectangular frame 39*a* formed in the substantially central region of the lower surface thereof. A recess portion is defined inside the rectangular frame 39*a*. The raised portion 45*a* of the cap member 45 is fitted to the recess portion defined inside the rectangular frame 39*a*. The upper end extension of the peripheral wall of the insulating member 39 makes contact with the inner surface of the peripheral wall of the sealing container 31, whereby the joint portion of the sealing container 31 and the flange 38 is insulated from the contact point unit including the fixed contact points 32 and the movable contact points 34.

A circular frame 39*c* having an inner diameter substantially equal to the inner diameter of the compression spring 36 is formed in the substantially central area of the inner bottom surface of the insulating member 39. An insertion hole 39*b*, through which the movable shaft 5 is inserted, is formed in the substantially central region of the circular frame 39*c*. The lower end portion of the compression spring 36 through which the movable shaft 5 is inserted is fitted into the recess portion defined inside the circular frame 39*c*, whereby the compression spring 36 is prevented from being out of alignment.

An upper end of the compression spring 36 makes contact with the lower surface of the movable contactor 35 and remains compressed between the insulating member 39 and the movable contactor 35. Thus the compression spring 36 resiliently biases the movable contactor 35 toward the fixed contact points 32.

The permanent magnets 46 are formed into a substantially rectangular parallelepiped shape and are arranged to make contact with the front and rear surfaces of the sealing container 31. The permanent magnets 46 are provided in a mutually-opposing relationship across the sealing container 31. The mutually-opposing surfaces of the permanent magnets 46 have the same polarity (the N-pole in the present embodiment). In this regard, the permanent magnets 46 are opposed to each other across the contact point gaps between the fixed contact points 32 and the movable contact points 34 arranged within the sealing container 31.

The first yokes 47 are formed into a substantially square bracket-like shape. Each of the first yokes 47 includes a base portion 47*a* having a substantially rectangular plate shape and a pair of extension portions 47*b* provided to extend from the opposite ends of the base portion 47*a* in a substantially perpendicular relationship with the base portion 47*a*. The first yokes 47 are arranged on the left and right side surfaces of the sealing container 31. The base portion 47*a* is arranged to make contact with the left or right surface of the sealing container 31. The permanent magnets 46 and the sealing container 31 are interposed between the extension portions 47*b* in the front-rear direction. In other words, one of the extension portions 47*b* makes contact with the front surface (the S-pole surface) of the front permanent magnet 46. The other extension portion 47*b* makes contact with the rear surface (the S-pole surface) of the rear permanent magnet 46.

The case 4 is formed into a substantially rectangular box shape by a resin material. The case 4 includes a hollow box-shaped case body 41 having an opening on the upper surface thereof and a hollow box-shaped cover 42 covering the opening of the case body 41.

Ear portions 141 having insertion holes 141*a* used in fixing the electromagnetic relay to an installation surface by screws are provided at the front ends of the left and right side walls of the case body 41. A shoulder portion 41*a* is formed in the peripheral edge of the upper end opening of the case body 41. Thus the outer circumference of the upper end portion of the case body 41 is smaller than the outer circumference of the lower end portion of the case body 41. A pair of slits 41*b*, into which the terminal portions 23*b* of the coil terminals 23 are fitted, are formed on the upper front surface of the case body 41 positioned higher than the shoulder portion 41*a*. On the upper rear surface of the case body 41 positioned higher than the shoulder portion 41*a*, a pair of depression portions 41*c* is arranged side by side along the left-right direction.

The cover 42 is formed into a hollow box shape so as to have an opening on the lower surface thereof. A pair of protrusion portions 42*a* fitted into the depression portions 41*c* of the case body 41 when the cover 42 is fixed to the case body 41 is formed on the rear surface of the cover 42. A partition portion 42*c* substantially bisecting the upper surface of the cover 42 into left and right regions is formed on the upper surface of the cover 42. A pair of insertion holes 42*b*, through which the fixed terminals 33 are inserted, is formed on the upper surface bisected by the partition portion 42*c*.

As shown in FIG. 8C, when the internal block 1 including the electromagnet block 2 and the contact point block 3 is stored into the case 4, a lower cushion rubber 43 having a substantially rectangular shape is interposed between the lower end flange 21*b* of the coil bobbin 21 and the bottom surface of the case body 41. Moreover, an upper cushion rubber 44 having insertion holes 44*a* through which the flanges 33*a* of the fixed terminals 33 are inserted is interposed between the sealing container 31 and the cover 42.

In the electromagnetic relay, the return spring 27 is larger in spring modulus than the compression spring 36. Therefore, the movable iron core 25 is slid downward by the pressing force of the return spring 27, in response to which the movable shaft 5 is also moved downward. As a result, the movable contactor 35 is moved downward in concert with the movement of the contact portion 52 of the movable shaft 5. In the initial state, therefore, the movable contact points 34 are kept spaced apart from the fixed contact points 32.

If the exciting coil 22 is energized, the movable iron core 25 is attracted by the fixed iron core 24 and is slid upward. In response, the movable shaft 5 connected to the movable iron core 25 is also moved upward. As a consequence, the contact portion 52 of the movable shaft 5 is moved toward the fixed contact points 32, whereby the movable contact points 34 fixed to the movable contactor 35 come into contact with the fixed contact points 32. Thus the movable contact points 34 and the fixed contact points 32 are electrically connected to each other.

Inasmuch as the electromagnetic relay configured as above is provided with the aforementioned contact device, it is possible to maintain stable contact-point switching performance and to reduce the size and cost of the electromagnetic relay.

In general, the front-rear dimension of the electromagnetic relay is decided by the size of the coil bobbin 21 of the electromagnet block 2. The left-right dimension of the electromagnetic relay is decided by the longitudinal (left-right) dimension of the movable contactor 35 on which the movable contact points 34 are arranged side by side along the longitudinal direction.

More specifically, the coil bobbin 21 has a cylindrical shape and includes the flanges 21*a* and 21*b* formed at the upper and lower ends thereof. The front-rear internal dimension of the case 4 is set depending on the external shape of the coil bobbin 21. In the movable contactor 35, the front-rear direction is the transverse direction. Therefore, when seen from above, the electromagnet block 2 protrudes outward from the front-rear opposite sides of the movable contactor 35. That is to say, a dead space exists between the movable contactor 35 and the inner wall of the case 4 in the front-rear direction.

In case where the permanent magnets 46 are arranged at the left-right opposite sides of the movable contactor 35, it is therefore necessary to increase the left-right dimension of the case 4. In the present embodiment, however, the permanent magnets 46 are arranged at the front-rear opposite sides of the movable contactor 35. This makes it possible to effectively utilize the dead space existing within the case 4 and to prevent the size of the case 4 from becoming larger.

In the electromagnetic relay, when the contact points are electrically connected to each other, the second yoke 52 of the movable shaft 5 comes close to the upper surface of the movable contactor 35. In that case, as described above in respect of FIG. 5B, the balance of the magnetic fields generated around the movable contactor 35 is collapsed. Thus a vertically upward attraction force acting substantially parallel to the displacement direction of the movable contactor 35 is applied to the movable contactor 35.

Accordingly, even if a contact-point repulsion force acts between the contact points, an attraction force 180 degrees opposite to the contact-point repulsion force is applied to the movable contactor 35. It is therefore possible to efficiently negate the contact-point repulsion force and to prevent trouble such as the decrease of a contact pressure or the contact point adhesion which may be caused by the arcs generated during the contact point switching operation.

Since the second yoke 52 is formed into a substantially flat shape, the distances from the respective points on the surface of the second yoke 52 opposing to the movable contactor 35 to the movable contactor 35 are substantially constant. It is therefore possible to keep substantially uniform the attraction forces acting on the movable contactor 35.

If the exciting coil 22 is de-energized, the movable iron core 25 is slid downward by the pressing force of the return spring 27, in response to which the movable shaft 5 is also moved downward. Therefore, the contact portion 52 and the movable contactor 35 are moved downward, whereby the fixed contact points 32 and the movable contact points 34 are spaced apart and disconnected from each other.

Figure 9:
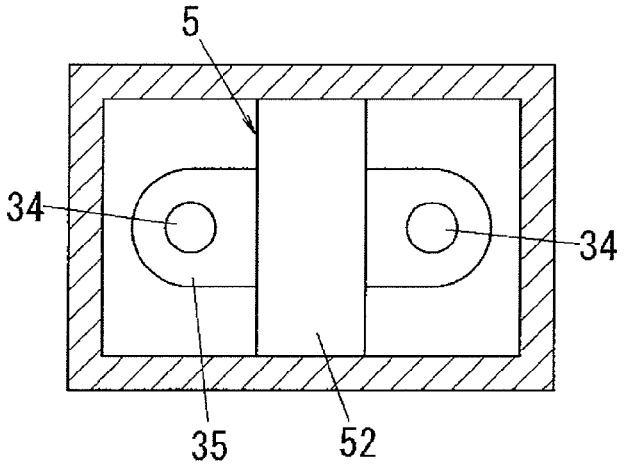
FIG. 9 is a partial section view of the electromagnetic relay provided with the contact device of the first embodiment.

As shown in FIG. 9, the front and rear ends of the contact portion 52 make contact with the inner wall of the case 4. Therefore, even if the rotational force acting in the winding direction of the compression spring 36 is applied to the contact portion 52, it is possible to prevent rotation of the contact portion 52 without having to provide any additional component. While the front and rear ends of the contact portion 52 make contact with the inner wall of the case 4 in the present embodiment, the rotation of the contact portion 52 may be prevented by bringing only a portion of the contact portion 52 into contact with the inner wall of the case 4.

In the present embodiment, the contact portion 52 is made of soft iron and is used as a yoke contact portion having the functions of a contact portion and a yoke. Alternatively, the contact portion 52 may be made of a non-magnetic material while providing an additional yoke. In that case, the yoke is provided in the substantially central region between the fixed terminals 33 and is arranged in a substantially opposing relationship with the axis of the movable shaft.

The contact device of the present embodiment may be a sealed contact device.

(Second Embodiment)

A contact device according to a second embodiment will be described with reference to FIG. 10. The contact device of the present embodiment differs from the contact device of the first embodiment in terms of the arrangement of the movable contactor 35 with respect to the permanent magnets 46 and in terms of the thickness of the permanent magnets 46. The same structures as those of the first embodiment will be designated by like reference symbols with no description made thereon. Up-down and left-right directions shown in FIG. 10 will be respectively referred to as front-rear and left-right directions. In the following description, it is assumed that an electric current flows from the left side toward the right side through the movable contactor 35.

As described in respect of the first embodiment, the arc generated in the left contact points is drawn out toward the left rear side. The arc generated in the right contact points is drawn out toward the right rear side (see arrows in FIG. 10). In the present embodiment, the movable contactor 35 is arranged between the permanent magnets 46 in a position nearer to the front permanent magnet 46 than the rear permanent magnet 46. That is to say, the space existing at the rear side of the movable contactor 35 is increased just as much as the offset of the movable contactor 35 from the center between the permanent magnets 46 toward the front permanent magnet 46.

Figure 10:
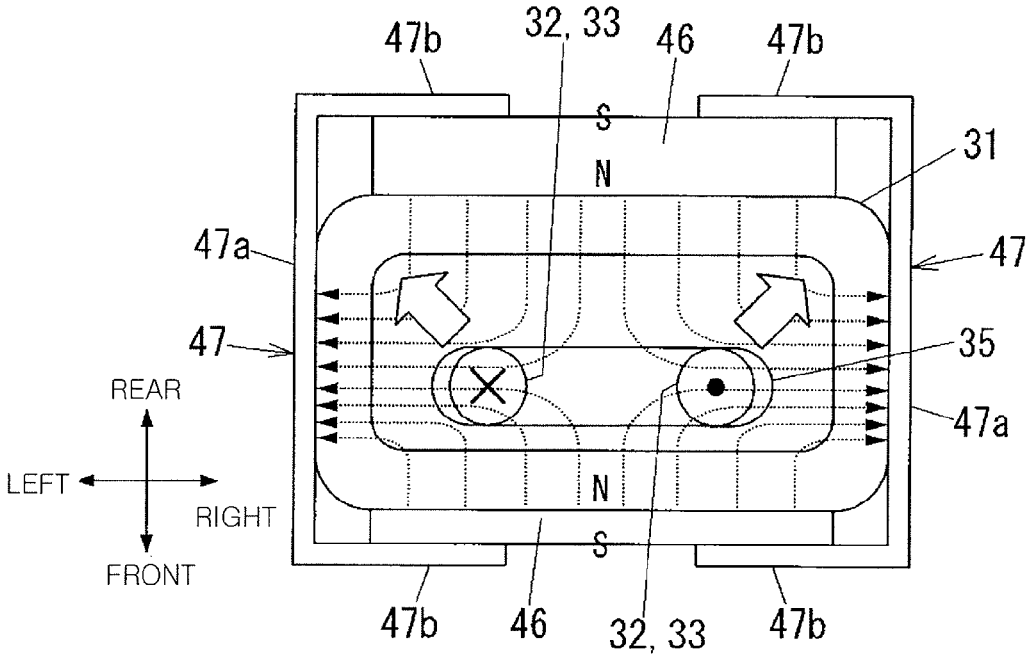
FIG. 10 is a partially enlarged view showing a contact device according to a second embodiment of the present invention.

In the contact device of the present embodiment, if the electric current flows toward the right side through the movable contactor 35 in FIG. 10, it is possible to make the arc drawing-out distance longer than that available in the first embodiment and to enhance the arc cutoff performance with respect to the forward electric current.

In the present embodiment, the thickness of the front permanent magnet 46 is smaller than the thickness of the rear permanent magnet 46. For that reason, the intensity of the magnetic fields generated at the rear side of the movable contactor 35 by the rear permanent magnet 46 is stronger than the intensity of the magnetic fields generated at the front side of the movable contactor 35 by the front permanent magnet 46. Accordingly, the force of drawing out the arc current toward the rear side becomes stronger, thereby making it possible to further enhance the arc cutoff performance.

While the present embodiment is directed to a case where the electric current flows toward the right side through the movable contactor 35, the present embodiment can be applied to a case where the electric current flows in the reverse direction (from the right side toward the left side). In that case, it is preferred that the movable contactor 35 is offset from the center between the permanent magnets 46 toward the rear permanent magnet 46 and that the thickness of the rear permanent magnet 46 is smaller than the thickness of the front permanent magnet 46.

The contact device of the present embodiment may be a sealed contact device.

(Third Embodiment)

A contact device according to a third embodiment will be described with reference to FIG. 11. The contact device of the present embodiment differs from the contact device of the first embodiment only in terms of the shape of the second yoke 53 of the movable shaft 5. The same structures as those of the first embodiment will be designated by like reference symbols with no description made thereon. Up-down and left-right directions will be defined on the basis of the directions shown in FIG. 11. The direction orthogonal to the up-down and left-right directions will be referred to as front-rear direction.

Figure 11:
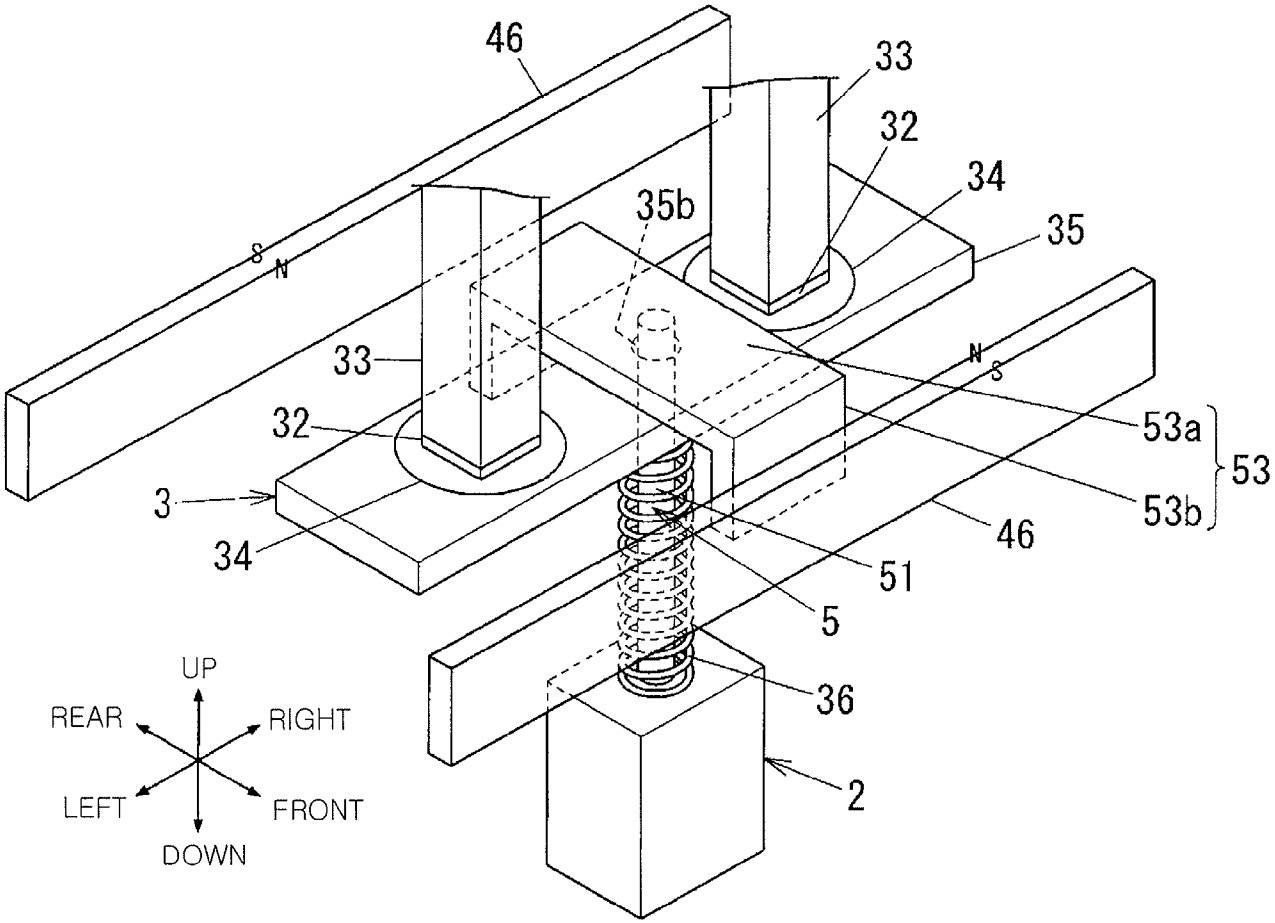
FIG. 11 is a schematic perspective view showing a contact device according to a third embodiment of the present invention.

As shown in FIG. 11, the second yoke 53 of the present embodiment is formed into a substantially square bracket-like cross-sectional shape. The second yoke 53 includes a base portion 53*a* having a substantially rectangular plate shape and a pair of extension portions 53*b* extending downward from the front and rear opposite ends of the base portion 53*a*.

When the contact points are electrically connected to each other, the lower surface of the base portion 53*a* of the second yoke 53 comes close to the upper surface of the movable contactor 35 while the extension portions 53*b* come close to the front and rear ends of the movable contactor 35.

Figure 12:
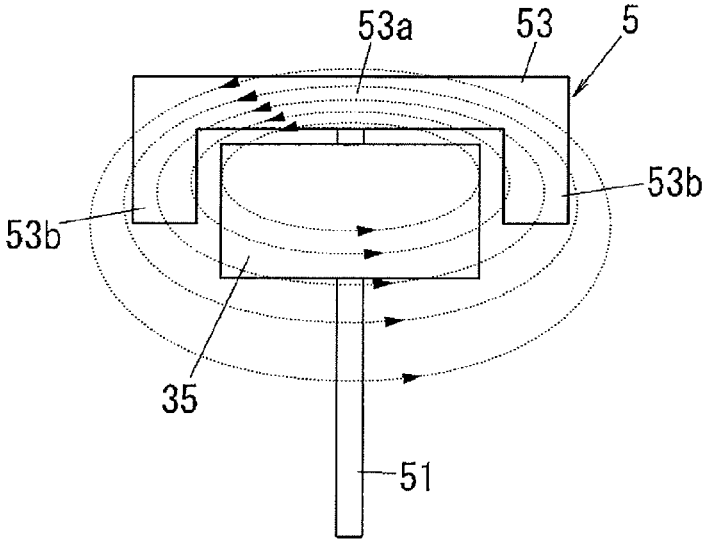
FIG. 12 is a schematic side view of the contact device of the third embodiment.

Then, as shown in FIG. 12, the balance of the magnetic fields generated around the movable contactor 35 is collapsed under the influence of the second yoke 53 coming close to the upper surface and the front and rear ends of the movable contactor 35. More specifically, most of the magnetic fluxes going from the right side toward the left side through the movable contactor 35 in FIG. 12 are attracted by the second yoke 53. Therefore, as compared with a case where the plate-shaped second yoke 52 is arranged near the movable contactor 35 as shown in FIG. 6B, the number of the magnetic fluxes going from the right side toward the left side through the movable contactor 35 is further reduced.

On the other hand, as shown in FIG. 12, all the magnetic fluxes going from the left side toward the right side through the movable contactor 35 are moved upward. Therefore, as compared with a case where the plate-shaped second yoke 52 is arranged near the movable contactor 35 as shown in FIG. 6B, the number of the magnetic fluxes going from the left side toward the right side through the movable contactor 35 is further increased.

Then, the upward electromagnetic force applied to the movable contactor 35 by the magnetic fluxes going from the left side toward the right side through the movable contactor 35 grows larger than the downward electromagnetic force applied to the movable contactor 35 by the magnetic fluxes going from the right side toward the left side through the movable contactor 35. For that reason, a large vertically-upward electromagnetic force (attraction force) acting substantially parallel to the displacement direction of the movable contactor 35 is applied to the movable contactor 35.

In this regard, the vertically upward attraction force applied to the movable contactor 35 is 180 degrees opposite to the contact point repulsion force (the downward force) generated in the movable contactor 35. Thus the vertically upward attraction force acts in the direction in which the contact point repulsion force is most efficiently negated. For that reason, as compared with the first embodiment, a large upward attraction force is generated in the movable contactor 35. This makes it possible to further suppress a decrease in the contact pressure acting between the contact points.

In the contact device of the present embodiment, therefore, a force (attraction force) negating the contact point repulsion force, which is larger than the force available in the first embodiment, is applied to the movable contactor 35 by the second yoke 53. Consequently, the contact device of the present embodiment is capable of increasing the endurance against the electromagnetic repulsion force generated during load short-circuit, providing stable arc cutoff performance and obtaining stable contact-point switching performance. In the present embodiment, the second yoke 53 serves as both a yoke and a contact portion. The second yoke 53 and the shaft portion are one-piece formed into the movable shaft 5. Accordingly, the functions of a yoke, a contact portion and a shaft portion are provided by a single component (the movable shaft 5). This makes it possible to reduce the number of components.

The extension portions 53*b* of the second yoke 53 are provided to make contact with the inner wall of the case 4. Therefore, even if the rotational force acting in the winding direction of the compression spring 36 is applied to the second yoke 53, it is possible to prevent rotation of the second yoke 53 without having to provide any additional component. While all the extension portions 53*b* make contact with the inner wall of the case 4 in the present embodiment, the rotation of the second yoke 53 may be prevented by bringing only one of the extension portions 53*b* into contact with the inner wall of the case 4.

While the second yoke 53 and the shaft portion 51 are one-piece formed in the present embodiment, it may be possible to independently form the second yoke 53 and the shaft portion 51, after which the shaft portion 51 may be fitted to the second yoke 53.

In the present embodiment, the second yoke 53 is made of soft iron and is used as a yoke contact portion having the functions of a contact portion and a yoke. Alternatively, the second yoke 53 may be made of a non-magnetic material while providing an additional yoke. In that case, the yoke is provided in the substantially central region between the fixed terminals 33 and is arranged in a substantially opposing relationship with the axis of the movable shaft.

The contact device of the present embodiment may be a sealed contact device.

(Fourth Embodiment)

Figure 13:
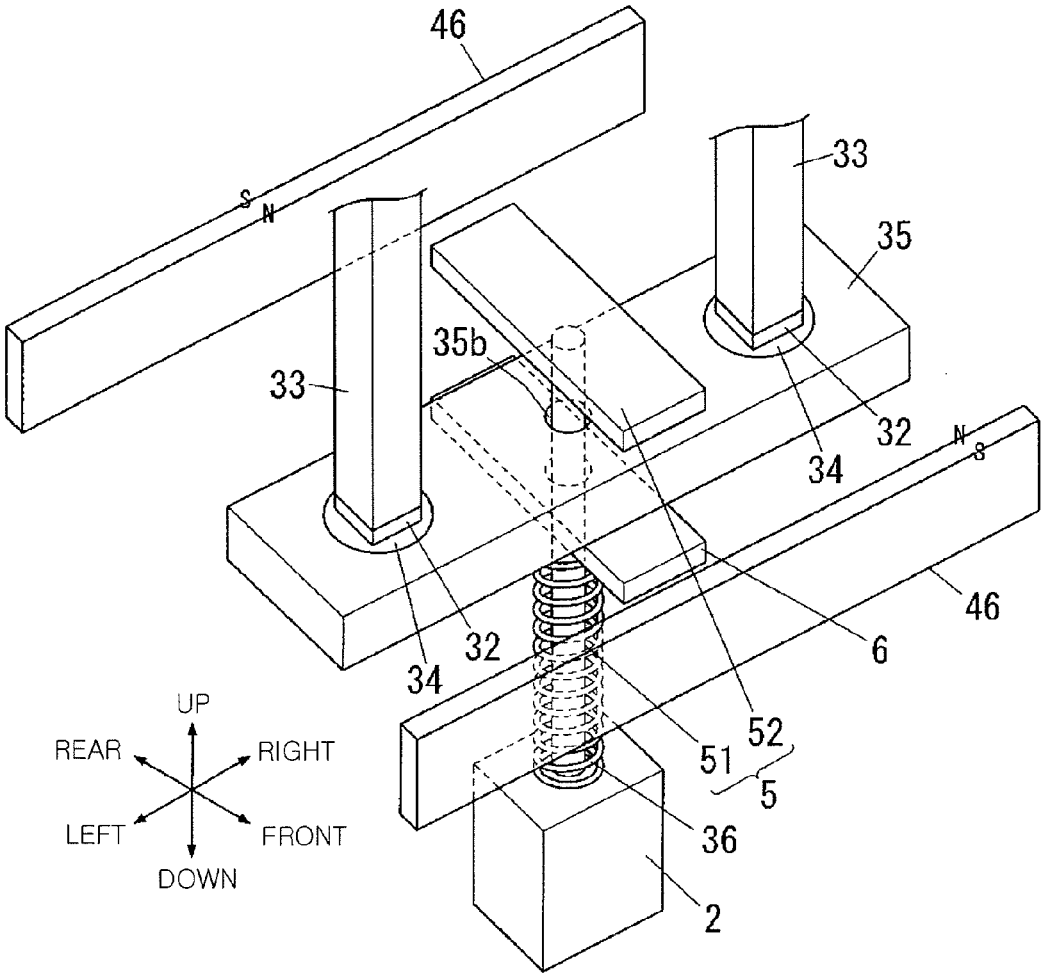
FIG. 13 is a schematic perspective view showing a contact device according to a fourth embodiment of the present invention.

A contact device according to a fourth embodiment will be described with reference to FIG. 13. The same structures as those of the first embodiment will be designated by like reference symbols with no description made thereon. Up-down and left-right directions will be defined on the basis of the directions shown in FIG. 13. The direction orthogonal to the up-down and left-right directions will be referred to as front-rear direction.

The contact device of the present embodiment differs from the contact device of the first embodiment shown in FIG. 1 in that a yoke plate 6 (hereinafter referred to as third yoke 6) made of a magnetic material, e.g., soft iron, and opposed to the second yoke 52 across the movable contactor 35 is fixed to the lower surface of the movable contactor 35.

In the contact device of the present embodiment, if the movable shaft 5 is displaced upward by the drive unit 2, the second yoke 52 of the movable shaft 5 is also moved upward. As the second yoke 52 is moved upward, the restraint on the upward movement of the movable contactor 35 (the movement of the movable contactor 35 toward the fixed contact points 32) is released, whereby the movable contactor 35 is displaced upward by the pressing force of the compression spring 36. Then, the movable contact points 34 provided in the movable contactor 35 comes into contact with the fixed contact points 32. The movable contact points 34 and the fixed contact points 32 are electrically connected to each other. At this time, the second yoke 52 is kept in the post-displacement position by the drive unit 2. Thus the second yoke 52 comes into contact with or comes close to the movable contactor 35 upwardly moved by the compression spring 36.

Figure 14:
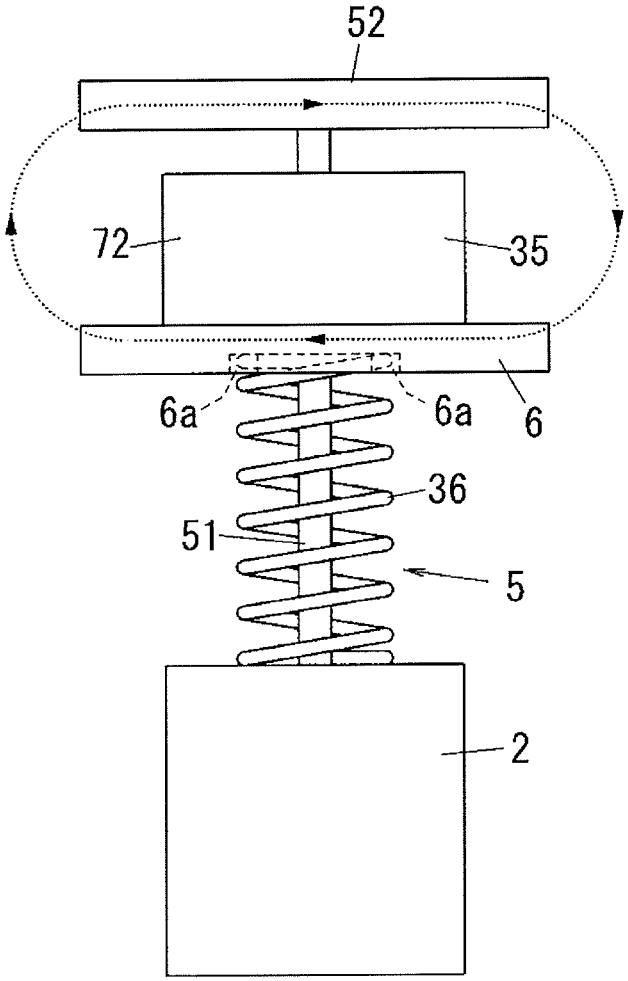
FIG. 14 is a schematic side view of the contact device of the fourth embodiment.

If the contact points are electrically connected to each other and if an electric current flows through the movable contactor 35, magnetic fields are generated around the movable contactor 35. As shown in FIG. 14, magnetic fluxes passing through the second yoke 52 and the third yoke 6 are formed and a first magnetic attraction force is generated between the second yoke 52 and the third yoke 6.

The third yoke 6 is attracted toward the second yoke 52 by the first magnetic attraction force acting between the second yoke 52 and the third yoke 6. That is to say, an upward force acting substantially parallel to the displacement direction of the movable contactor 35 (pressing the movable contactor 35 against the fixed contact points 32) is applied to the movable contactor 35 to which the third yoke 6 is fixed.

In this regard, the first magnetic attraction force acting between the second yoke 52 and the third yoke 6 to bias the movable contactor 35 upward is substantially 180 degrees opposite to the contact point repulsion force (the downward force) generated in the movable contactor 35. Thus the first magnetic attraction force acts in the direction in which the contact point repulsion force is most efficiently negated. In the contact device of the present embodiment, therefore, the contact point repulsion force can be efficiently negated by the first magnetic attraction force. This makes it possible to suppress a decrease in the contact pressure acting between the contact points.

Consequently, the contact device of the present embodiment is capable of increasing the endurance against the electromagnetic repulsion force generated during load short-circuit, providing stable arc cutoff performance and obtaining stable contact-point switching performance.

In the present embodiment, the second yoke 52 serves as both a yoke and a contact portion. The second yoke 52 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 52 and the shaft portion 51 are one-piece formed in the present embodiment, it may be possible to independently form the second yoke 52 and the shaft portion 51, after which the shaft portion 51 may be fitted to the second yoke 52.

As compared with the third yoke 6, the second yoke 52 arranged at the side of the fixed terminals 33 receives stronger magnetic fluxes from the fixed terminals 33. Thus the magnetic flux density is increased in the second yoke 52. For that reason, the first magnetic attraction force can be efficiently increased by increasing the up-down direction thickness of the second yoke 52 rather than increasing the up-down direction thickness of the third yoke 6. Accordingly, the decrease in the contact pressure between the contact points can be reliably prevented by increasing the thickness of the second yoke 52.

In the present embodiment, the contact portion 52 is made of a magnetic material and is used as the second yoke 52 having the functions of a contact portion and a yoke. Alternatively, the contact portion 52 may be made of a non-magnetic material while providing an additional yoke. In that case, the yoke is provided in the substantially central region between the fixed terminals 33 and is arranged in a substantially opposing relationship with the axis of the movable shaft 5.

Since the second yoke 52 and the third yoke 6 are formed into a substantially rectangular plate shape in the present embodiment, the distances from the respective points on the surface of the second yoke 52 opposing to the third yoke 6 to the third yoke 6 are substantially constant. It is therefore possible to keep substantially uniform the first magnetic attraction force acting on the third yoke 6.

The contact device of the present embodiment may be a sealed contact device.

(Fifth Embodiment)

A contact device according to a fifth embodiment will be described with reference to FIG. 15. The contact device of the present embodiment differs from the contact device of the fourth embodiment only in terms of the shape of a yoke plate 7 (a third yoke). The same structures as those of the fourth embodiment will be designated by like reference symbols with no description made thereon. Up-down and left-right directions will be defined on the basis of the directions shown in FIG. 15. The direction orthogonal to the up-down and left-right directions will be referred to as front-rear direction.

Figure 15:
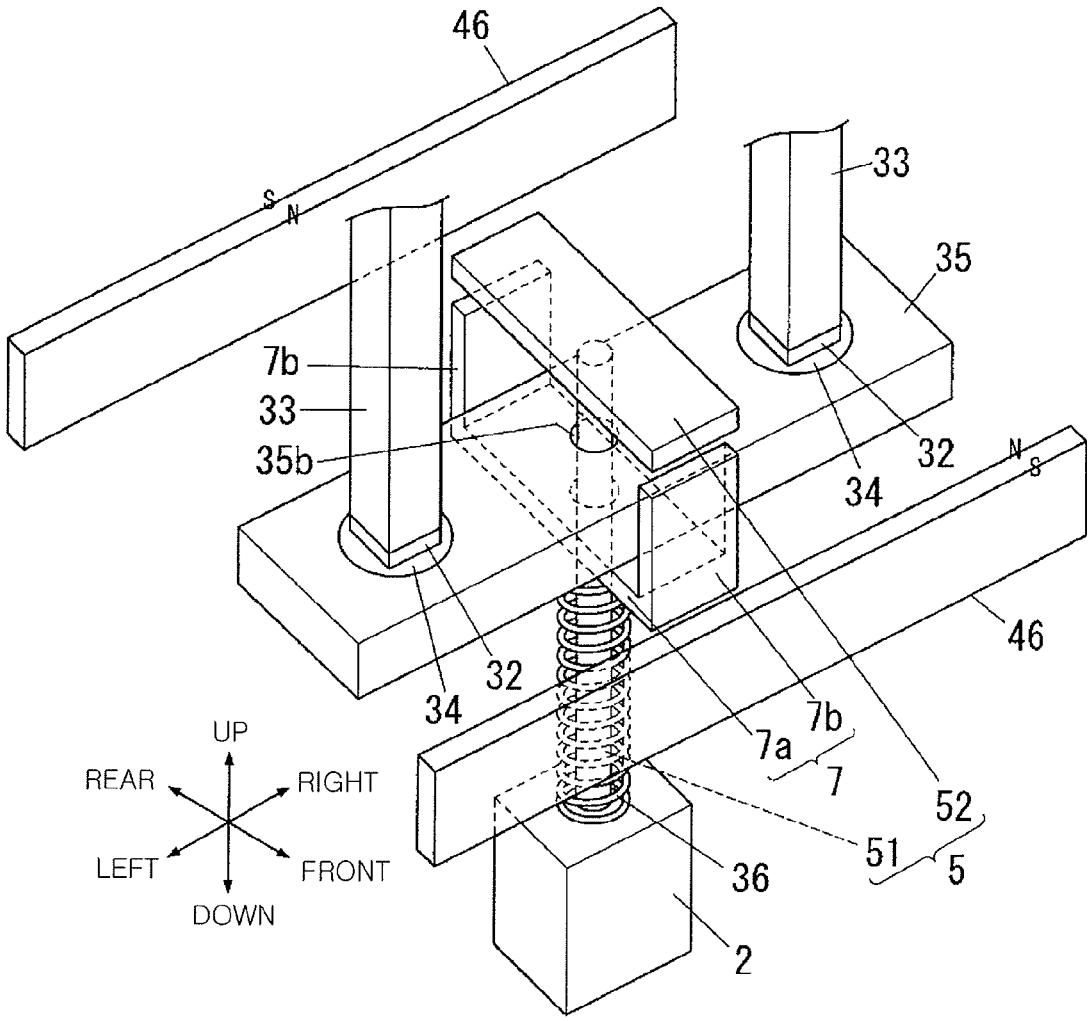
FIG. 15 is a schematic perspective view showing a contact device according to a fifth embodiment of the present invention.

As shown in FIG. 15, the third yoke 7 of the present embodiment is formed into a substantially square bracket-like cross-sectional shape. The third yoke 7 includes a base portion 7*a* having a substantially rectangular plate shape and a pair of extension portions 7*b* extending upward from the front and rear opposite ends of the base portion 7*a*.

Figure 16:
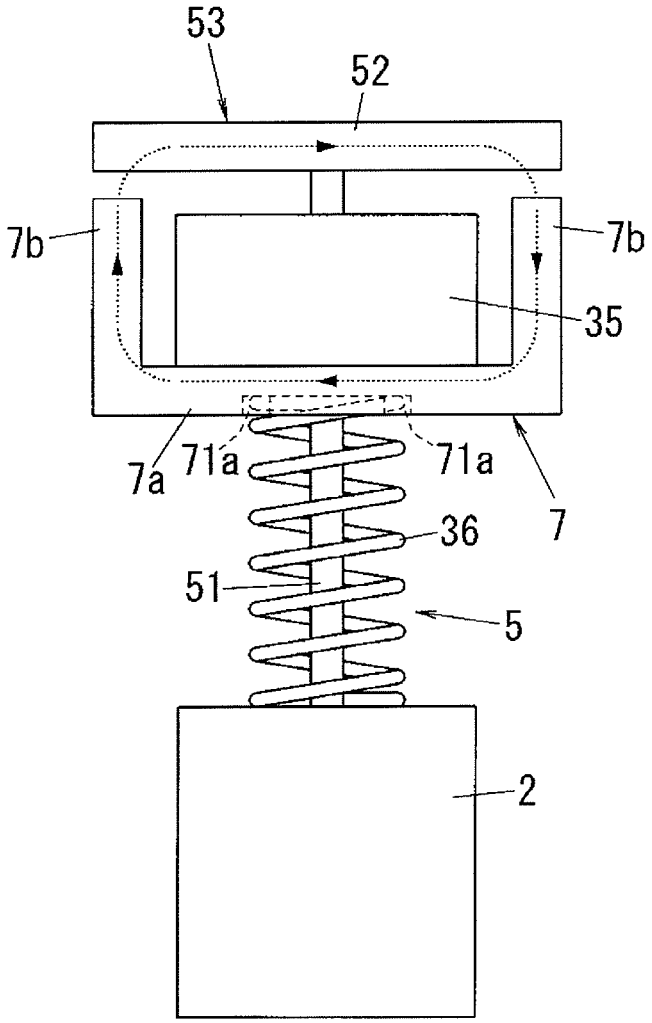
FIG. 16 is a schematic side view of the contact device of the fifth embodiment.

When the contact points are electrically connected to each other as shown in FIG. 16, the tip ends of the extension portions 7*b* of the third yoke 7 come close to the second yoke 52. Thus, the gap between the second yoke 52 and the third yoke 7 becomes smaller than that available in the third embodiment. The third yoke 7 receives a strong first magnetic attraction force from the second yoke 52. That is to say, a strong upward force is applied to the movable contactor 35.

In the contact device of the present embodiment, therefore, the first magnetic attraction force acting between the second yoke 52 and the third yoke 7 is larger than that available in the fourth embodiment. A larger upward force is applied to the movable contactor 35. This makes it possible to further suppress a decrease in the contact pressure between the contact points.

In this regard, the first magnetic attraction force is a force (an upward force) substantially 180 degrees opposite to the contact point repulsion force (the downward force) generated in the movable contactor 35. Thus the first magnetic attraction force acts in the direction in which the contact point repulsion force is most efficiently negated.

In the contact device of the present embodiment, therefore, the contact erosion of the left contact point becomes substantially equal to that of the right contact point due to the provision of the permanent magnets 46. The movable contactor 35 is attracted toward the fixed contact points 32 by the first magnetic attraction force stronger than that available in the fourth embodiment. That is to say, the contact device of the present embodiment has stable arc cutoff performance. Since the movable contactor 35 is pressed against the fixed contact points 32 by the third yoke 7, the contact device of the present embodiment has stable contact-point switching performance.

In the present embodiment, the second yoke 52 serves as both a yoke and a contact portion. The second yoke 52 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 52 and the shaft portion 51 are one-piece formed in the present embodiment, it may be possible to independently form the second yoke 52 and the shaft portion 51, after which the shaft portion 51 may be fitted to the second yoke 52.

In the present embodiment, the second yoke 52 is made of a magnetic material and is used as a yoke contact portion having the functions of a contact portion and a yoke. Alternatively, the second yoke 52 may be made of a non-magnetic material while providing an additional yoke. In that case, the second yoke 52 is provided in the substantially central region between the fixed terminals 33 and is arranged in a substantially opposing relationship with the axis of the movable shaft.

A substantially annular groove 71*a* is formed in the substantially central region of the lower surface of the base portion 7*a* of the third yoke 7. The upper end of the compression spring 36 is fitted to the groove 71*a*. This enhances the stability of the compression spring 36. When a contact point repulsion force is generated in the movable contactor 35, a uniform force is applied to the movable contactor 35. This makes it possible to stably obtain yield strength against the contact point repulsion force.

The contact device of the present embodiment may be a sealed contact device.

(Sixth Embodiment)

A contact device according to a sixth embodiment will be described with reference to FIG. 17. The contact device of the present embodiment differs from the contact device of the fifth embodiment only in terms of the shape of the yoke contact portion 53 (the second yoke 53). The same structures as those of the fifth embodiment will be designated by like reference symbols with no description made thereon. Up-down and left-right directions will be defined on the basis of the directions shown in FIG. 17. The direction orthogonal to the up-down and left-right directions will be referred to as front-rear direction.

Figure 17:
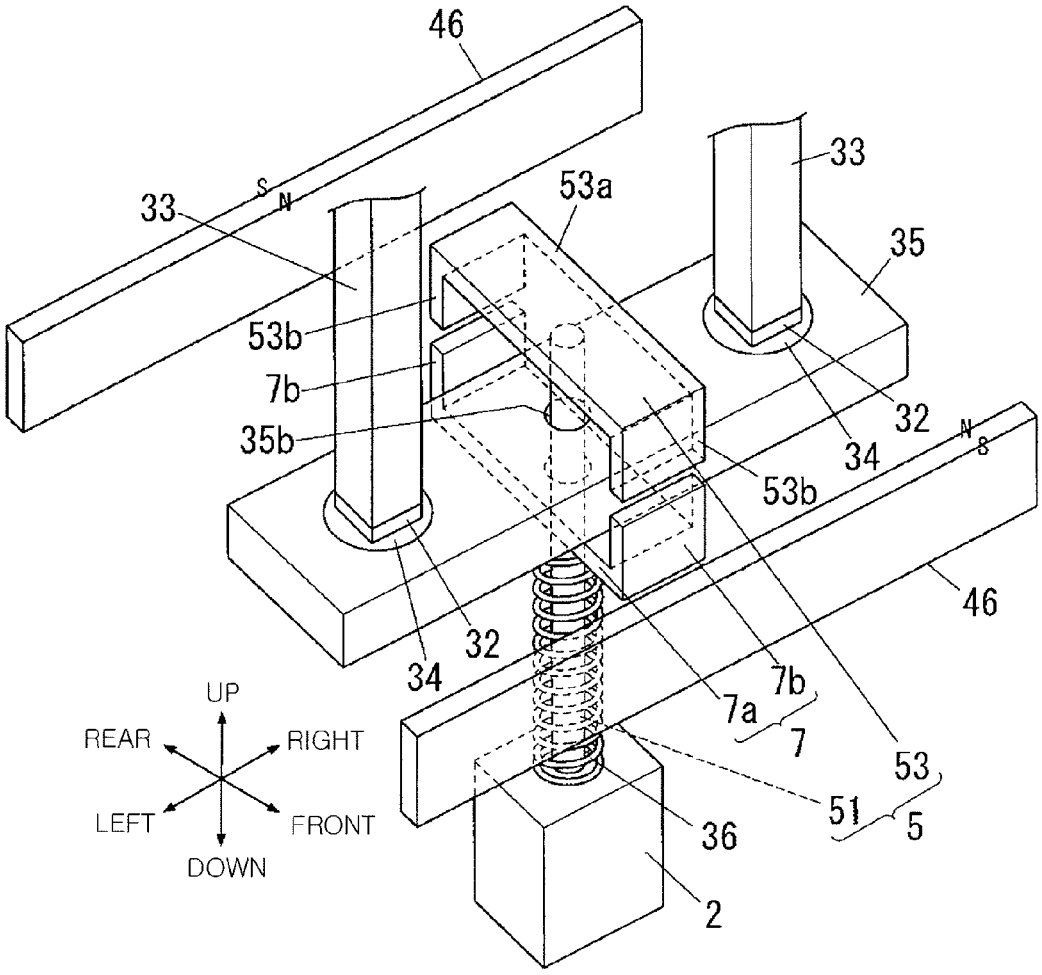
FIG. 17 is a schematic perspective view showing a contact device according to a sixth embodiment of the present invention.

As shown in FIG. 17, the second yoke 53 is formed into a substantially square bracket-like cross-sectional shape. The second yoke 53 includes a base portion 53*a* having a substantially rectangular plate shape and a pair of extension portions 53*b* extending downward from the front and rear opposite ends of the base portion 53*a*.

Figure 18:
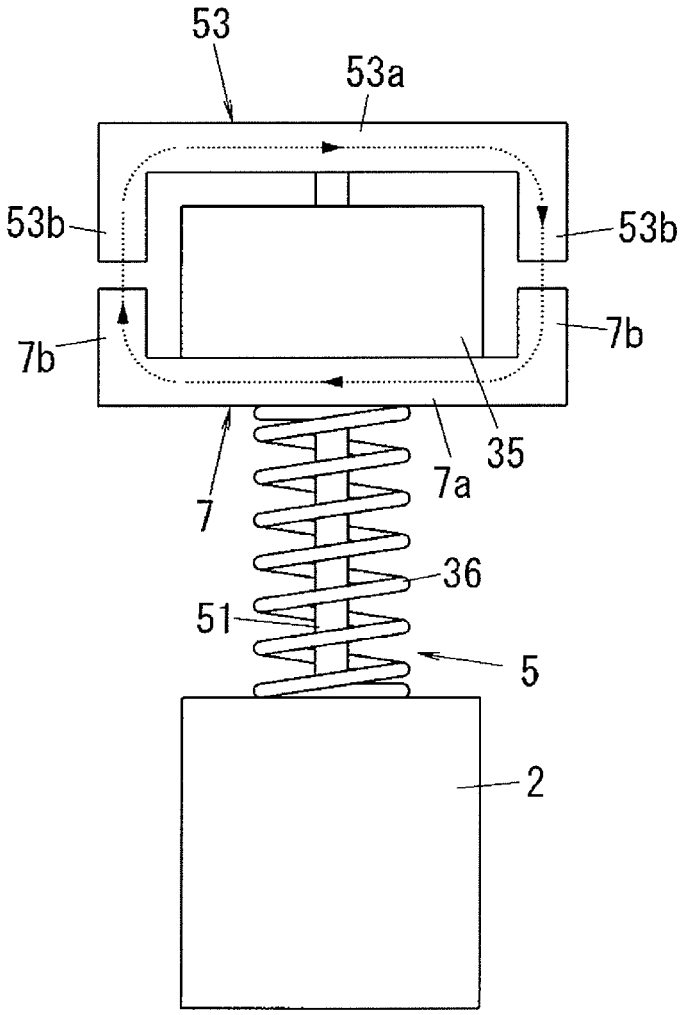
FIG. 18 is a schematic side view of the contact device of the sixth embodiment.

When the contact points are electrically connected to each other as shown in FIG. 18, the tip end surfaces of the extension portions 53*b* of the second yoke 53 comes close to the tip end surfaces of the extension portions 7*b* of the third yoke 7. Thus the first magnetic attraction force acting between the second yoke 53 and the third yoke 7 grows larger. The gaps between the tip end surfaces of the extension portions 53*b* and the tip end surfaces of the extension portions 7*b* are formed so as to oppose to the substantially central regions of the lateral end surfaces of the movable contactor 35. It is therefore possible to reduce leakage of the magnetic fluxes from the gaps between the second yoke 53 and the third yoke 7 and to further increase the first magnetic attraction force acting between the second yoke 53 and the third yoke 7 as compared with the fifth embodiment. That is to say, a large upward force acting substantially parallel to the displacement direction of the movable contactor 35 is applied to the movable contactor 35.

In the contact device of the present embodiment, therefore, the contact erosion of the left contact point becomes substantially equal to that of the right contact point due to the provision of the permanent magnets 46. The movable contactor 35 is pressed against the fixed contact points 32 by a force stronger than that available in the fourth embodiment. That is to say, the contact device of the present embodiment has stable arc cutoff performance and stable contact-point switching performance. In this regard, the first magnetic attraction force is a force (an upward force) substantially 180 degrees opposite to the contact point repulsion force (the downward force) generated in the movable contactor 35. Thus the first magnetic attraction force acts in the direction in which the contact point repulsion force is most efficiently negated.

In the present embodiment, the second yoke 53 serves as both a yoke and a contact portion. The second yoke 53 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 53 and the shaft portion 51 are one-piece formed in the present embodiment, it may be possible to independently form the second yoke 53 and the shaft portion 51, after which the shaft portion 51 may be fitted to the second yoke 53.

In the present embodiment, the second yoke 53 is made of a magnetic material and is used as a yoke contact portion having the functions of a contact portion and a yoke. Alternatively, the second yoke 53 may be made of a non-magnetic material while providing an additional yoke. In that case, the second yoke 53 is provided in the substantially central region between the fixed terminals 33 and is arranged in a substantially opposing relationship with the axis of the movable shaft.

The contact device of the present embodiment may be a sealed contact device.

(Seventh Embodiment)

Figure 19:
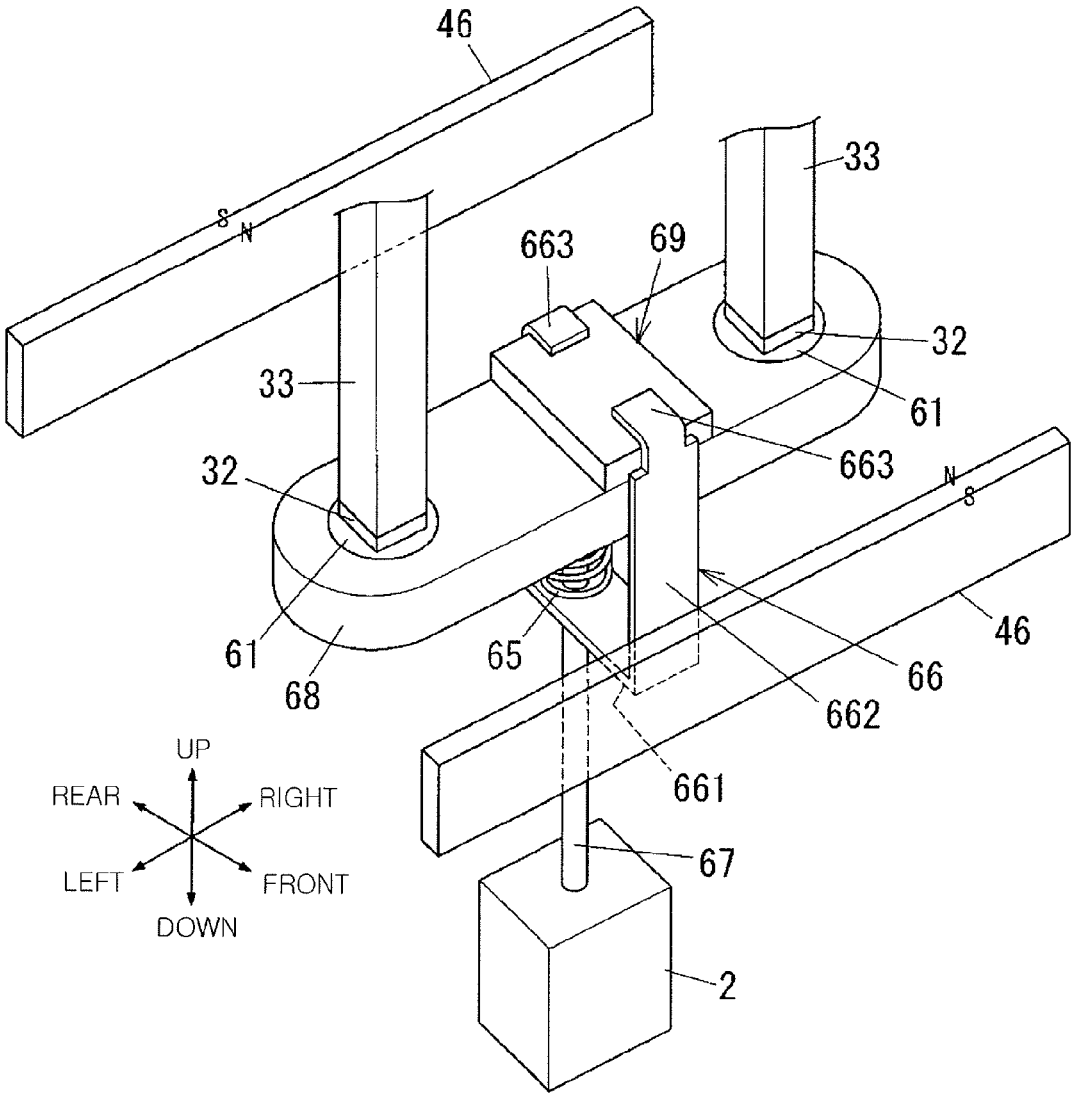
FIG. 19 is a schematic perspective view showing a contact device according to a seventh embodiment of the present invention.
Figure 20:
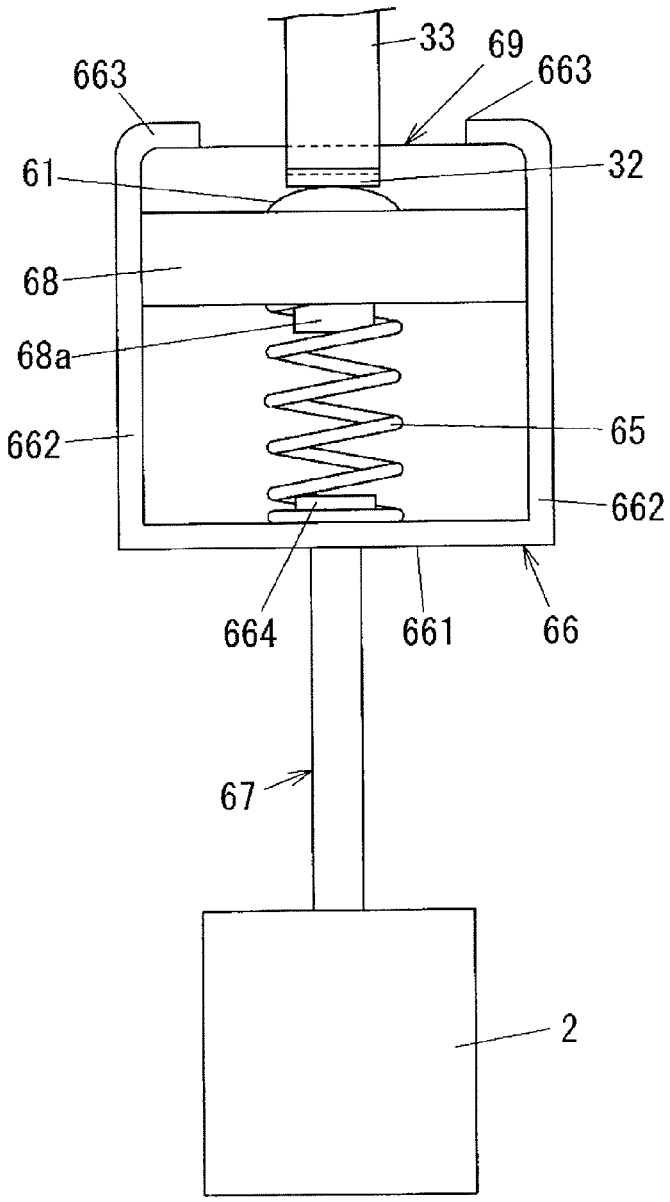
FIG. 20 is a schematic side view of the contact device of the seventh embodiment.
Figure 21:
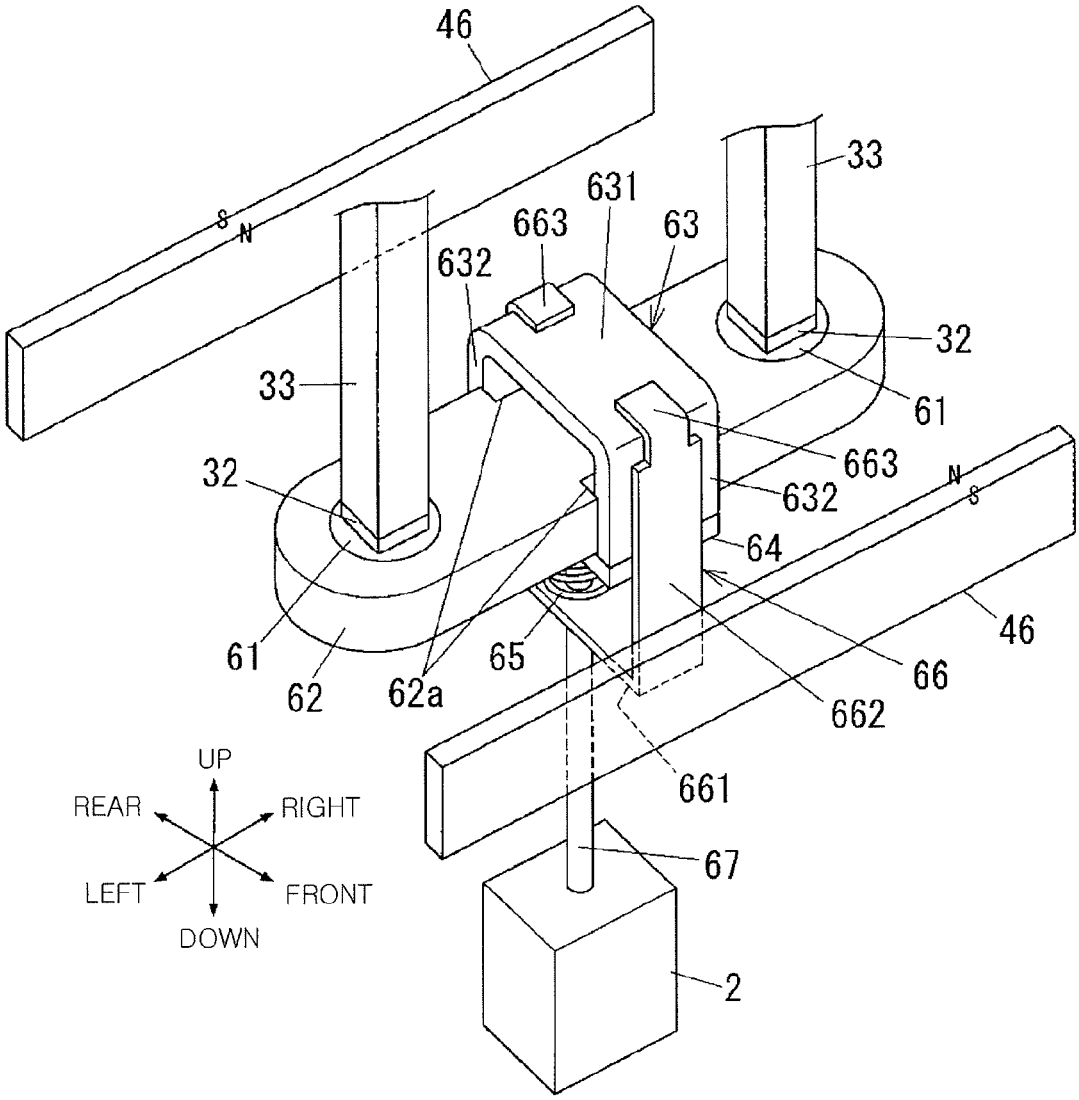
FIG. 21 is a schematic perspective view showing a contact device according to an eighth embodiment of the present invention.
Figure 22:
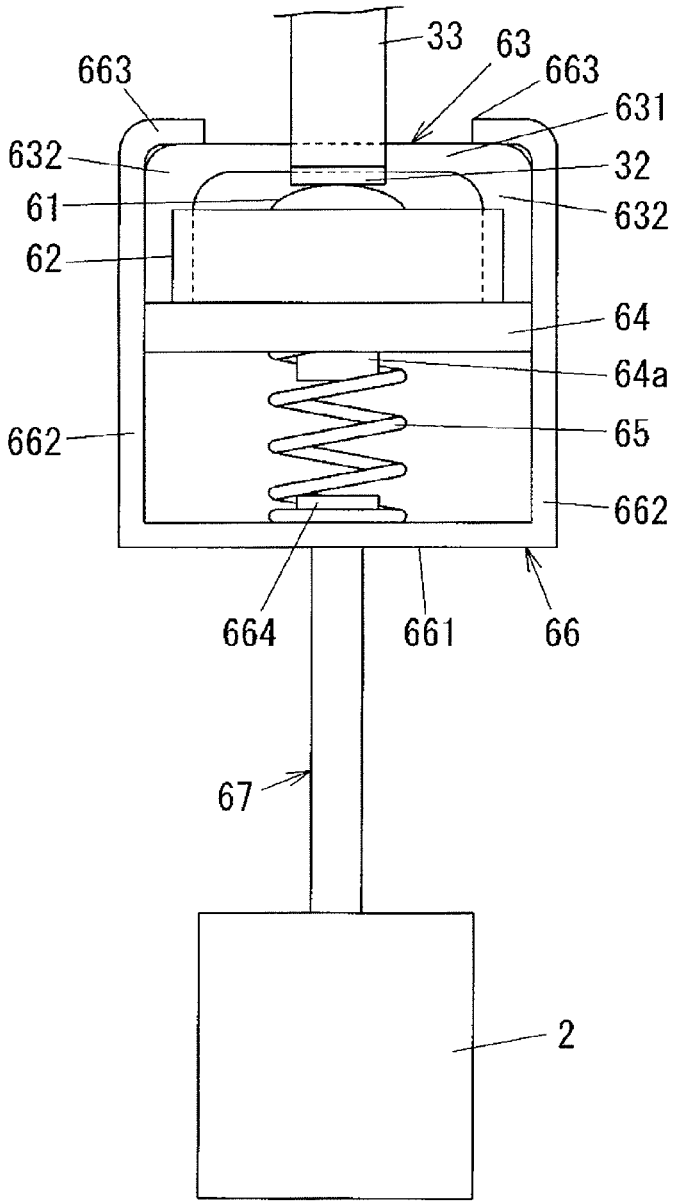
FIG. 22 is a schematic side view of the contact device of the eighth embodiment.

A contact device according to a seventh embodiment will be described with reference to FIGS. 19 and 20. Up-down and left-right directions will be defined on the basis of the directions shown in FIG. 19. The direction orthogonal to the up-down and left-right directions will be referred to as front-rear direction.

The contact device of the present embodiment includes fixed terminals 33 having fixed contact points 32 formed at the lower ends thereof, a movable contactor 68 having movable contact points 61 coming into contact and out of contact with the fixed contact points 32, a second yoke 69 arranged in an opposing relationship with the upper surface of the movable contactor 68, a compression spring 65 for biasing the movable contactor 68 toward the fixed contact points 32, a holder member 66 for holding the second yoke 69, a movable shaft 67 connected to the holder member 66 and an electromagnet block 2 for driving the movable shaft 67 so that the movable contact points 61 can come into contact and out of contact with the fixed contact points 32. The fixed contact points 32, the fixed terminals 33 and the electromagnet block 2 are the same as those of the first embodiment and, therefore, will be designated by like reference symbols with no description made thereon.

The movable contactor 68 is formed into a substantially rectangular plate shape. The movable contact points 61 are arranged in the longitudinal (left-right) opposite end regions of the upper surface of the movable contactor 68.

The second yoke 69 is formed into a flat plate shape by a magnetic material such as soft iron or the like and is arranged in an opposing relationship with the upper surface of the movable contactor 68.

The upper end of the compression spring 65 makes contact with the substantially central region of the lower surface of the movable contactor 68. A protrusion portion 68*a* protruding from the substantially central region of the lower surface of the movable contactor 68 is fitted to the upper end bore of the compression spring 65.

The holder member 66 includes a base portion 661 having a substantially rectangular plate shape, a pair of grip portions 662 extending upward from the front-rear opposite ends of the base portion 661 and a pair of contact portions 663 formed by bending the tip ends of the grip portions 662 inward in the front-rear direction.

The compression spring 65 having a lower end making contact with the upper surface of the base portion 661, the movable contactor 68 having a lower surface pressed against the compression spring 65, and the second yoke 69 held by the grip portions 662 in an opposing relationship with the upper surface of the movable contactor 68 are arranged between the grip portions 662.

In this regard, a substantially cylindrical columnar protrusion portion 664 protrudes from the substantially central region of the upper surface of the base portion 661 of the holder member 66. The protrusion portion 664 is fitted to the lower end bore of the compression spring 65. As a consequence, the compression spring 65 is fixed between the base portion 661 and the movable contactor 68 in a compressed state so as to bias the movable contactor 68 toward the fixed contact points 32 (upward). The movable contactor 68 is urged to move toward the fixed terminals 33 (upward) by the pressing force of the compression spring 65. However, the movement of the movable contactor 68 toward the fixed contact points 32 is restrained because the upper surface of the movable contactor 68 makes contact with the second yoke 69 whose upward movement is restrained by the contact portion 663.

The movable shaft 67 is formed into a vertically-extending substantially rod-like shape. The electromagnet block 2 is connected to the lower end of the movable shaft 67. The base portion 661 of the holder member 66 is fixed to the upper end of the movable shaft 67.

In the contact device of the present embodiment configured as above, if the movable shaft 67 is displaced upward by the drive unit 2, the holder member 66 connected to the movable shaft 67 is also displaced upward. Then, the second yoke 69 held by the holder member 66 is moved upward, thereby releasing the restraint on the upward movement of the movable contactor 68. The movable contactor 68 is moved upward by the pressing force of the compression spring 65. The movable contact points 61 formed in the movable contactor 68 comes into contact with the fixed contact points 32, whereby the movable contact points 61 and the fixed contact points 32 are electrically connected to each other.

If an electric current flows through the movable contactor 68 as a result of the electric connection of the contact points, an upward electromagnetic force (attraction force) is applied to the movable contactor 68 as described in the first embodiment with reference to FIG. 5B. That is to say, an attraction force acting substantially parallel to the displacement direction of the movable contactor 68 (vertically upward) to attract the movable contactor 68 toward the fixed contact points is applied to the movable contactor 68.

In this regard, the vertically upward attraction force applied to the movable contactor 68 is 180 degrees opposite to the contact point repulsion force (the downward force) generated in the movable contactor 68. Thus the vertically upward attraction force acts in the direction in which the contact point repulsion force is most efficiently negated. For that reason, the contact point repulsion force can be efficiently negated by the attraction force. This makes it possible to suppress a decrease in the contact pressure acting between the contact points.

In the contact device of the present embodiment, therefore, the contact erosion of the left contact point becomes substantially equal to that of the right contact point due to the provision of the permanent magnets 46. In addition, the second yoke 69 attracts the movable contactor 68 toward the fixed contact points. Consequently, the contact device of the present embodiment is capable of increasing the endurance against the electromagnetic repulsion force generated during load short-circuit, providing stable arc cutoff performance and obtaining stable contact-point switching performance.

The fixed contact points 32 may be one-piece formed with the fixed terminals 33 or may be formed independently of the fixed terminals 33. Similarly, the movable contact points 61 may be one-piece formed with the movable contactor 68 or may be formed independently of the movable contactor 68.

The contact device of the present embodiment may be a sealed contact device.

(Eighth Embodiment)

A contact device according to an eighth embodiment will be described with reference to FIGS. 21 through 25. Up-down and left-right directions will be defined on the basis of the directions shown in FIG. 21. The direction orthogonal to the up-down and left-right directions will be referred to as front-rear direction.

The contact device of the present embodiment includes fixed terminals 33 having fixed contact points 32 formed at the lower ends thereof, a movable contactor 62 having movable contact points 61 coming into contact and out of contact with the fixed contact points 32, a second yoke 63 arranged in an opposing relationship with the upper surface of the movable contactor 62, a third yoke 64 arranged in an opposing relationship with the lower surface of the movable contactor 62, a compression spring 65 for biasing the movable contactor 62 toward the fixed contact points 32, a holder member 66 for holding the second yoke 63, a movable shaft 67 connected to the holder member 66 and an electromagnet block 2 for driving the movable shaft 67 so that the movable contact points 61 can come into contact and out of contact with the fixed contact points 32. The fixed contact points 32, the fixed terminals 33 and the electromagnet block 2 are the same as those of the first embodiment and, therefore, will be designated by like reference symbols with no description made thereon.

The movable contactor 62 is formed into a substantially rectangular plate shape. The movable contact points 61 are arranged in the longitudinal (left-right) opposite end regions of the upper surface of the movable contactor 62. Substantially rectangular cutout portions 62*a* are formed in the substantially central regions of the respective longitudinal sides of the movable contactor 62.

The second yoke 63 is formed into a substantially square bracket-like cross-sectional shape by a magnetic material such as soft iron or the like. The second yoke 63 includes a base portion 631 having a substantially rectangular plate shape and opposing to the upper surface of the movable contactor 62 and a pair of extension portions 632 formed by bending the opposite ends of the base portion 631 downward. The extension portions 632 are inserted through the cutout portions 62*a* of the movable contactor 62, whereby the second yoke 63 restrains the left-right movement of the movable contactor 62.

The third yoke 64 is formed into a substantially rectangular plate shape by a magnetic material such as soft iron or the like. The third yoke 64 is fixed to the lower surface of the movable contactor 62 and is opposed to the second yoke 63 across the movable contactor 62. The tip ends of the extension portions 632 of the second yoke 63 are opposed to the upper surface of the third yoke 64. The movable contactor 62 is interposed between the second yoke 63 and the third yoke 64. While the third yoke 64 is fixed to and one-piece formed with the movable contactor 62 in the present embodiment, the third yoke 64 may be formed independently of the movable contactor 62 and may be arranged to make contact with the lower surface of the movable contactor 62.

The upper end of the compression spring 65 makes contact with the lower surface of the third yoke 64. A protrusion portion 64*a* protruding from the substantially central region of the lower surface of the third yoke 64 is fitted to the upper end bore of the compression spring 65.

The holder member 66 includes a base portion 661 having a substantially rectangular plate shape, a pair of grip portions 662 extending upward from the front-rear opposite ends of the base portion 661 and a pair of contact portions 663 formed by bending the tip ends of the grip portions 662 inward.

The movable contactor 62, which is interposed between the second yoke 63 and the third yoke 64, and the compression spring 65 are arranged between the grip portions 662. The second yoke 63 is held in place by the grip portions 662.

In this regard, a substantially cylindrical columnar protrusion portion 664 protrudes from the substantially central region of the upper surface of the base portion 661 of the holder member 66. The protrusion portion 664 is fitted to the lower end bore of the compression spring 65. As a consequence, the compression spring 65 is fixed between the base portion 661 and the third yoke 64 in a compressed state so as to bias the movable contactor 62 toward the fixed contact points 32 (upward) through the third yoke 64. The movable contactor 62 is urged to move toward the fixed terminals 33 (upward) by the pressing force of the compression spring 65. However, the movement of the movable contactor 62 toward the fixed contact points 32 is restrained because the upper surface of the movable contactor 62 makes contact with the second yoke 63 whose upward movement is restrained by the contact portion 663.

The movable shaft 67 is formed into a vertically-extending substantially rod-like shape. The electromagnet block 2 is connected to the lower end of the movable shaft 67. The base portion 661 of the holder member 66 is fixed to the upper end of the movable shaft 67.

In the contact device of the present embodiment configured as above, if the movable shaft 67 is displaced upward by the drive unit 2, the holder member 66 connected to the movable shaft 67 is also displaced upward. Then, the second yoke 63 held by the holder member 66 is moved upward, thereby releasing the restraint on the upward movement of the movable contactor 62. The movable contactor 62 is moved upward together with the third yoke 64 by the pressing force of the compression spring 65. The movable contact points 61 formed in the movable contactor 62 comes into contact with the fixed contact points 32, whereby the movable contact points 61 and the fixed contact points 32 are electrically connected to each other.

Figure 23:
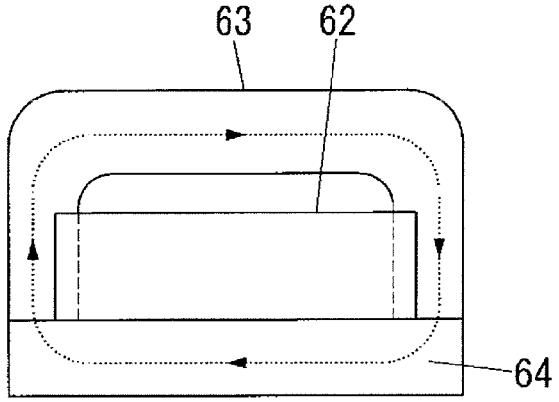
FIG. 23 is a partially enlarged view of the contact device of the eighth embodiment.

If an electric current flows through the movable contactor 62 as a result of the electric connection of the contact points, magnetic fields are generated around the movable contactor 62 and magnetic fluxes passing through the second yoke 63 and the third yoke 64 are formed as shown in FIG. 23. As a consequence, a magnetic attraction force is generated between the second yoke 63 and the third yoke 64. The third yoke 64 is attracted toward the second yoke 63. For that reason, the third yoke 64 presses the lower surface of the movable contactor 62, thereby generating an upward force by which the movable contactor 62 is pressed against the fixed contact points 32.

In this regard, the magnetic attraction force applied to the third yoke 64 is 180 degrees opposite to the contact point repulsion force (the downward force) generated in the movable contactor 62. Thus the magnetic attraction force acts in the direction in which the contact point repulsion force is most efficiently negated.

Therefore, the contact device of the present embodiment has stable arc cutoff performance. Since the movable contactor 62 is pressed against the fixed contact points 32 by the third yoke 64, the contact device of the present embodiment has stable contact-point switching performance.

Figure 24A:
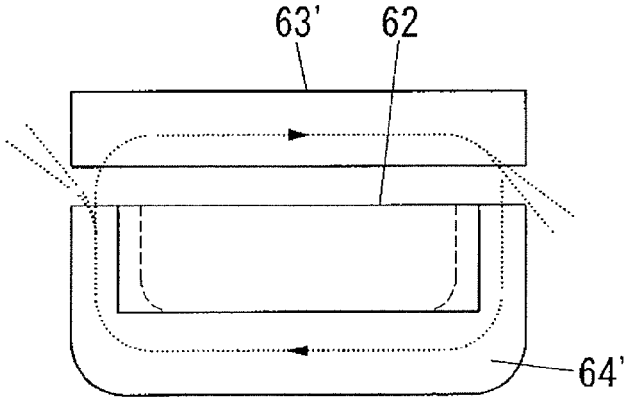
FIGS. 24A and 24B are schematic views showing magnetic paths formed in the contact device of the eighth embodiment.

When the movable shaft 67 is further driven toward the fixed contact points 32 after the contact points are electrically connected to each other (hereinafter referred to as over-travel time), the second yoke 63 held by the holder member 66 is spaced apart from the movable contactor 62 because the movable contactor 62 is kept in contact with the fixed terminals 33 and is restrained from moving upward. In a hypothetical case where a substantially flat yoke 63' is used as a second yoke and a substantially square bracket-like yoke 64' is used as a third yoke as shown in FIG. 24A, the magnetic path of the yoke 63' and the magnetic path of the yoke 64' are not continuous. For that reason, magnetic fluxes are leaked through between the yoke 63' and the yoke 64'.

Figure 24B:
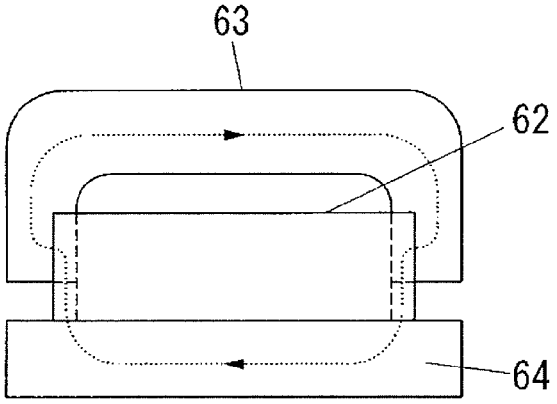

In the contact device of the present embodiment, however, the second yoke 63 is formed into a substantially square bracket-like shape. Even at the over-travel time, the extension portions 632 of the second yoke 63 make contact with the movable contactor 62 as shown in FIG. 24B. Therefore, the magnetic path of the second yoke 63 and the magnetic path of the third yoke 64 are connected through the movable contactor 62, eventually preventing leakage of the magnetic fluxes. Accordingly, it is possible to prevent the magnetic fluxes from being leaked through between the second yoke 63 and the third yoke 64 and to prevent reduction of the magnetic attraction force applied to the third yoke 64.

Figure 25:
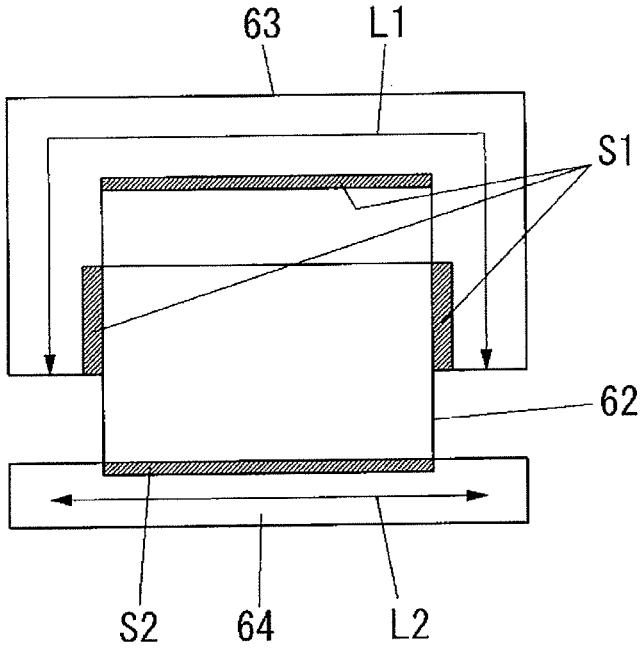
FIG. 25 is a partially enlarged view of the contact device of the eighth embodiment.

As shown in FIG. 25, the area S1 of the substantially square bracket-like second yoke 63 opposing to the movable contactor 62 is larger than the area S2 of the flat third yoke 64 opposing to the movable contactor 62. Thus the second yoke 63 can easily receive the magnetic fluxes from the movable contactor 62. The magnetic path length L1 of the second yoke 63 is longer than the magnetic path length L2 of the third yoke 64. For that reason, the magnetic attraction force applied to the third yoke 64 can be efficiently increased by increasing the up-down thickness of the second yoke 63 rather than increasing the up-down thickness of the third yoke 64.

As compared with the third yoke 64, the second yoke 63 is positioned nearer to the fixed terminals 33 and can easily receive the magnetic fluxes from the fixed terminals 33. Therefore, the magnetic flux density in the second yoke 63 is higher than the magnetic flux density in the third yoke 64.

As described above, the second yoke 63 existing near the fixed terminals 33 is formed into a substantially square bracket-like shape. This makes it possible to efficiently increase the magnetic attraction force with respect to the third yoke 64. The magnetic attraction force with respect to the third yoke 64 available when the second yoke 63 is formed into a flat plate shape can be obtained by a substantially square bracket-like yoke having a thickness smaller than the thickness of the flat plate yoke. By forming the second yoke 63 into a substantially square bracket-like shape, it is possible to reduce the thickness of the second yoke 63 and to reduce the size of the contact device while maintaining the magnetic attraction force with respect to the third yoke 64.

The fixed contact points 32 may be one-piece formed with the fixed terminals 33 or may be formed independently of the fixed terminals 33. Similarly, the movable contact points 61 may be one-piece formed with the movable contactor 62 or may be formed independently of the movable contactor 62.

The contact device of the present embodiment may be a sealed contact device.

(Ninth Embodiment)

Figure 26:
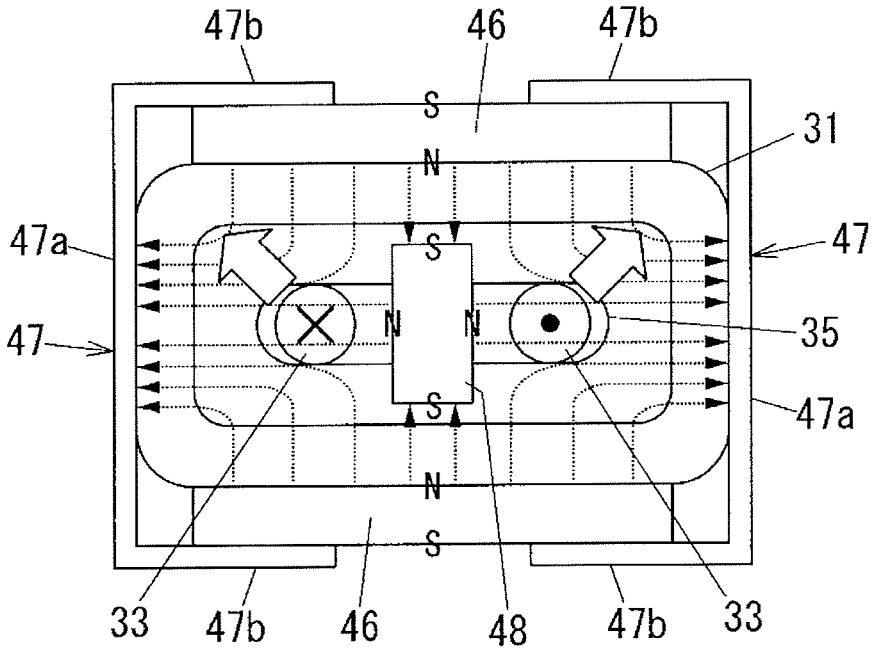
FIG. 26 is a partially enlarged view showing a contact device according to a ninth embodiment of the present invention.

A contact device according to a ninth embodiment will be described with reference to FIG. 26. The contact device of the present embodiment differs from the contact device of any one of the first through eighth embodiments in that a permanent magnet piece 48 is arranged between the permanent magnets 46. The same advantageous effects can be obtained regardless of which one of the contact devices of the first through eighth embodiments is provided with the permanent magnet piece 48. In the present embodiment, description will be made on a case where the permanent magnet piece 48 is provided in the contact device of the first embodiment. Up-down and left-right directions will be defined on the basis of the directions shown in FIG. 26. The direction orthogonal to the up-down and left-right directions will be referred to as front-rear direction.

The permanent magnet piece 48 is formed into a substantially rectangular parallelepiped shape and is arranged in the substantially middle region between the permanent magnets 46. The permanent magnet piece 48 is opposed to the upper surface of the movable contactor 35 and is positioned in the substantially middle region between a pair of first yokes 47. In this regard, the permanent magnet piece 48 is arranged in such a way that the facing surfaces of the permanent magnet piece 48 and the permanent magnets 46 are substantially parallel to each other and the surfaces of the permanent magnet piece 48 and the first yokes 47 are substantially parallel to each other.

The polarity of the surfaces (first surfaces) of the permanent magnet piece 48 opposing to the permanent magnets 46 is set as a pole (S-pole) different from the polarity of the surfaces of the permanent magnets 46 opposing to the first surfaces. The polarity of the surfaces (second surfaces) of the permanent magnet piece 48 opposing to the first yokes 47 is set as a pole (N-pole) different from the polarity of the first surfaces. That is to say, the polarity of the left and right side surfaces of the permanent magnet piece 48 is set as the N-pole. The polarity of the front and rear side surfaces of the permanent magnet piece 48 is set as the S-pole. For that reason, the magnetic fluxes generated between the permanent magnets 46 and between the first yokes 47 are attracted toward the permanent magnet piece 48 and are relayed by the permanent magnet piece 48.

In the contact device of the present embodiment, therefore, the leakage of the magnetic fluxes between the permanent magnets 46 and between the first yokes 47 is suppressed by the provision of the permanent magnet piece 48. This helps increase the magnetic flux density near the respective contact point units. Due to the provision of the permanent magnet piece 48, the magnetic flux density near the respective contact point units is increased and the arc drawing-out force generated in the contact point unit is increased. This makes it possible to further enhance the arc cutoff performance.

The contact device of the present embodiment may be a sealed contact device.

(First Modified Example)

A contact device according to a first modified example differs from the contact device of the first embodiment in terms of the arrangement of the permanent magnets 46. The same structures as those of the first embodiment will be designated by like reference symbols with no description made thereon. Up-down and left-right directions will be defined on the basis of the directions shown in FIG. 27. The direction orthogonal to the up-down and left-right directions will be referred to as front-rear direction.

The permanent magnets 46 of the present modified example are formed into a substantially rectangular parallelepiped shape and are arranged substantially parallel to the transverse direction of the movable contactor 35. In this regard, the permanent magnets 46 are arranged at the left and right sides of the movable contactor 35 in a mutually-opposing relationship across the gaps (contact point gaps) between the fixed contact points 32 and the movable contact points 34. The mutually-opposing surfaces of the permanent magnets 46 have the same polarity (the S-pole in the present modified example). That is to say, the left permanent magnet 46 is arranged such that the right surface thereof has the S-pole and the left surface thereof has the N-pole. The right permanent magnet 46 is arranged such that the left surface thereof has the S-pole and the right surface thereof has the N-pole.

Furthermore, the permanent magnets 46 are arranged such that the centers of the mutually-opposing surfaces thereof lie on the extension lines of a straight line interconnecting the fixed contact points 32. In addition, the permanent magnets 46 are arranged such that the distance between left permanent magnet 46 and the left contact point unit becomes substantially equal to the distance between the right permanent magnet 46 and the right contact point unit. Accordingly, the magnetic fields generated around the respective contact point units by the permanent magnets 46 are symmetrical with respect to a straight line X extending in the front-rear direction through the insertion hole 35*b* of the movable contactor 35.

Since the contact portion 52 (hereinafter referred to as second yoke 52) of the movable shaft 5 is positioned between the permanent magnets 46, the magnetic fluxes generated between the permanent magnets 46 are attracted toward the second yoke 52.

In the contact device of the present modified example, if the movable shaft 5 is moved upward by the electromagnet block 2, the restraint on the movement of the movable contactor 35 toward the fixed contact points 32 is released and the movable contactor 35 is moved toward the fixed contact points 32 by the biasing force of the compression spring 36. As a result, the movable contact points 34 come into contact with the fixed contact points 32, whereby electric connection is established between the contact points.

Figure 28:
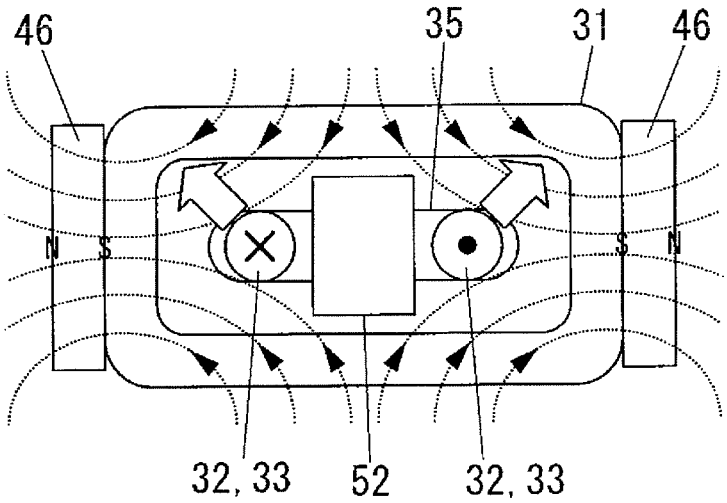
FIG. 28 is a partially enlarged view of the contact device of the first modified example.

Regardless of the flow direction of an electric current flowing through the movable contactor 35, the arcs generated between the fixed contact points 32 and the movable contact points 34 (between the contact points) are drawn out away from each other by the magnetic fields formed around the respective contact point units. More specifically, if the electric current flows through the movable contactor 35 from the left side toward the right side in FIG. 28, the arc generated between the left contact points is drawn out toward the left rear side and the arc generated between the right contact points is drawn out toward the right rear side. If the electric current flows through the movable contactor 35 from the right side toward the left side in FIG. 28, the arc generated between the left contact points is drawn out toward the left front side and the arc generated between the right contact points is drawn out toward the right front side.

In the present modified example, the magnetic fluxes generated between the permanent magnets 46 are attracted toward the second yoke 52. Thus the magnetic flux density grows higher around the respective contact point units and the arc drawing-out force gets increased. Accordingly, even if the size of the permanent magnets 46 made small, it is possible to maintain the force required in extinguishing the arcs. That is to say, the contact device of the present modified example can obtain stable arc cutoff performance while enjoying reduced size.

As stated above, the magnetic fields are symmetrically formed around the respective contact point units. The magnetic flux densities in the respective contact point units are substantially equal to each other and the arc drawing-out forces in the respective contact point units are substantially equal to each other. This makes it possible to obtain stable arc cutoff performance.

Figure 29:
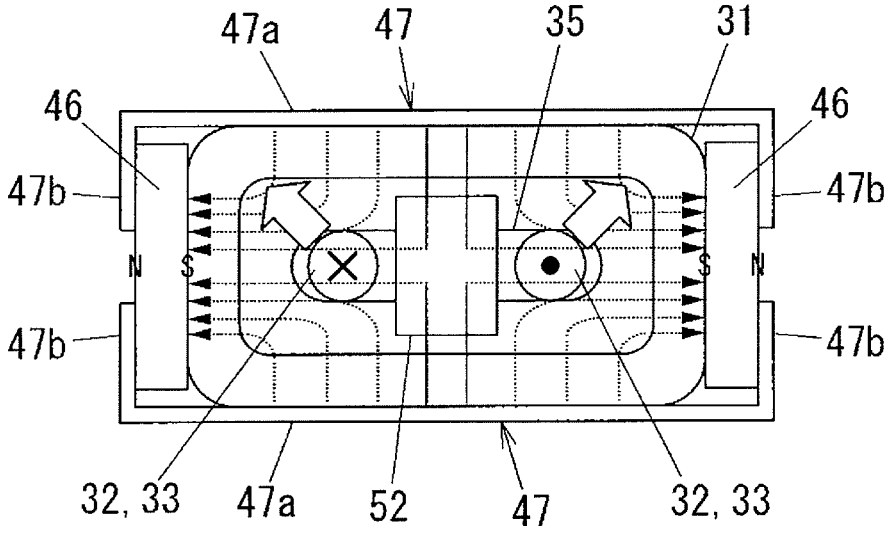
FIG. 29 is a partially enlarged view of the contact device of the first modified example provided with a first yoke.
Figure 30B:
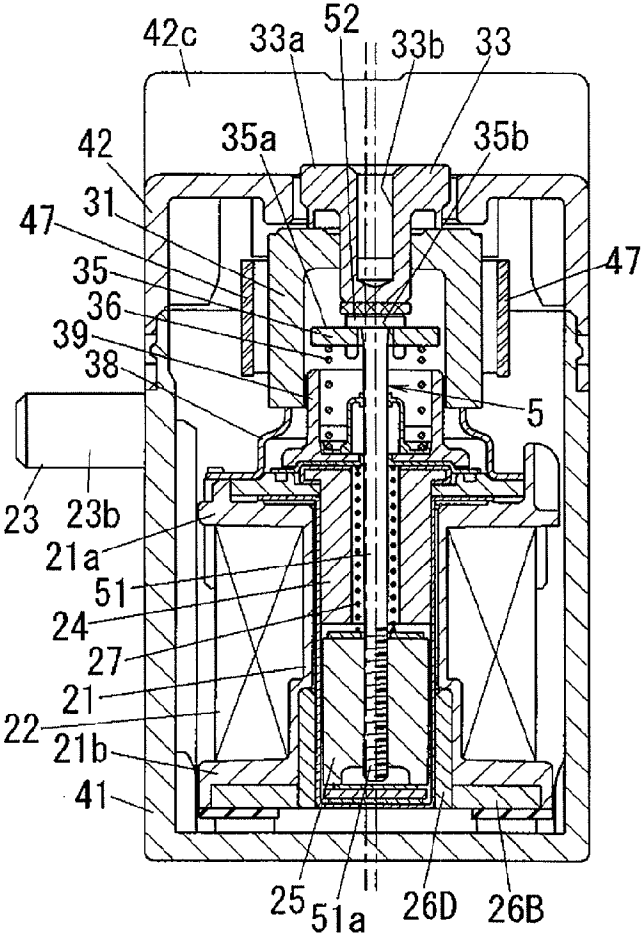
FIGS. 30A and 30B are section views showing an electromagnetic relay provided with the contact device of the first modified example.
Figure 30A:
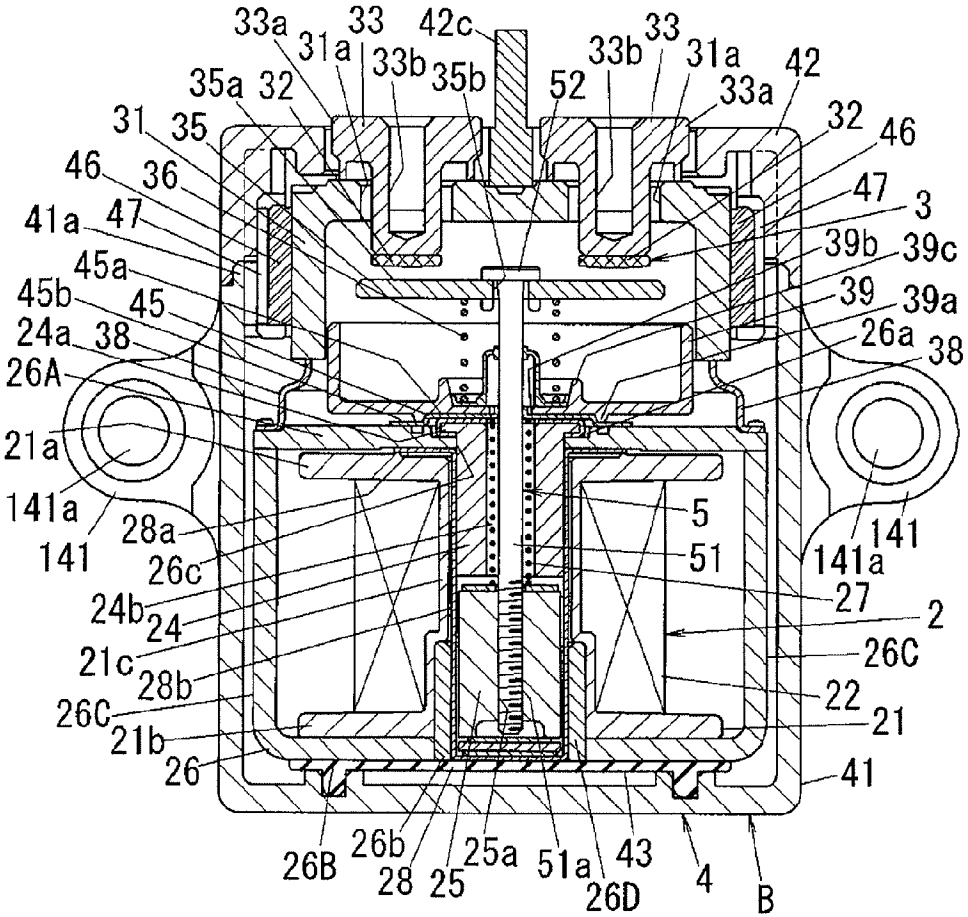
Figure 31A:
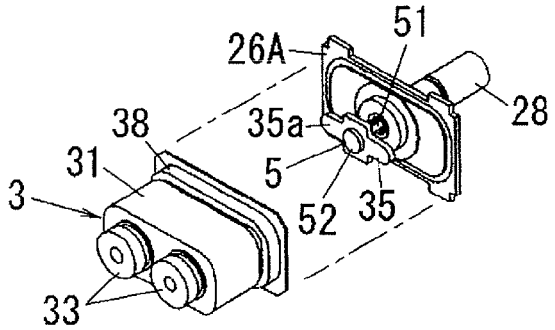
FIGS. 31A to 31C are exploded perspective views of the electromagnetic relay provided with the contact device of the first modified example.
Figure 31B:
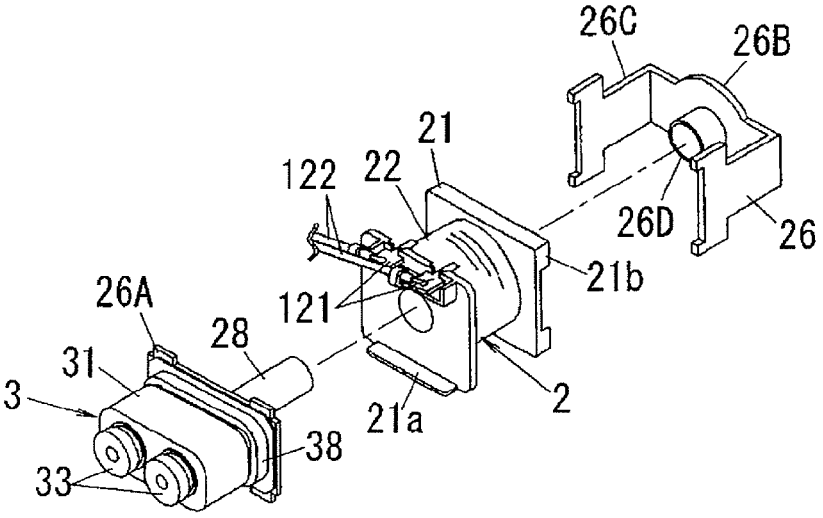
Figure 31C:
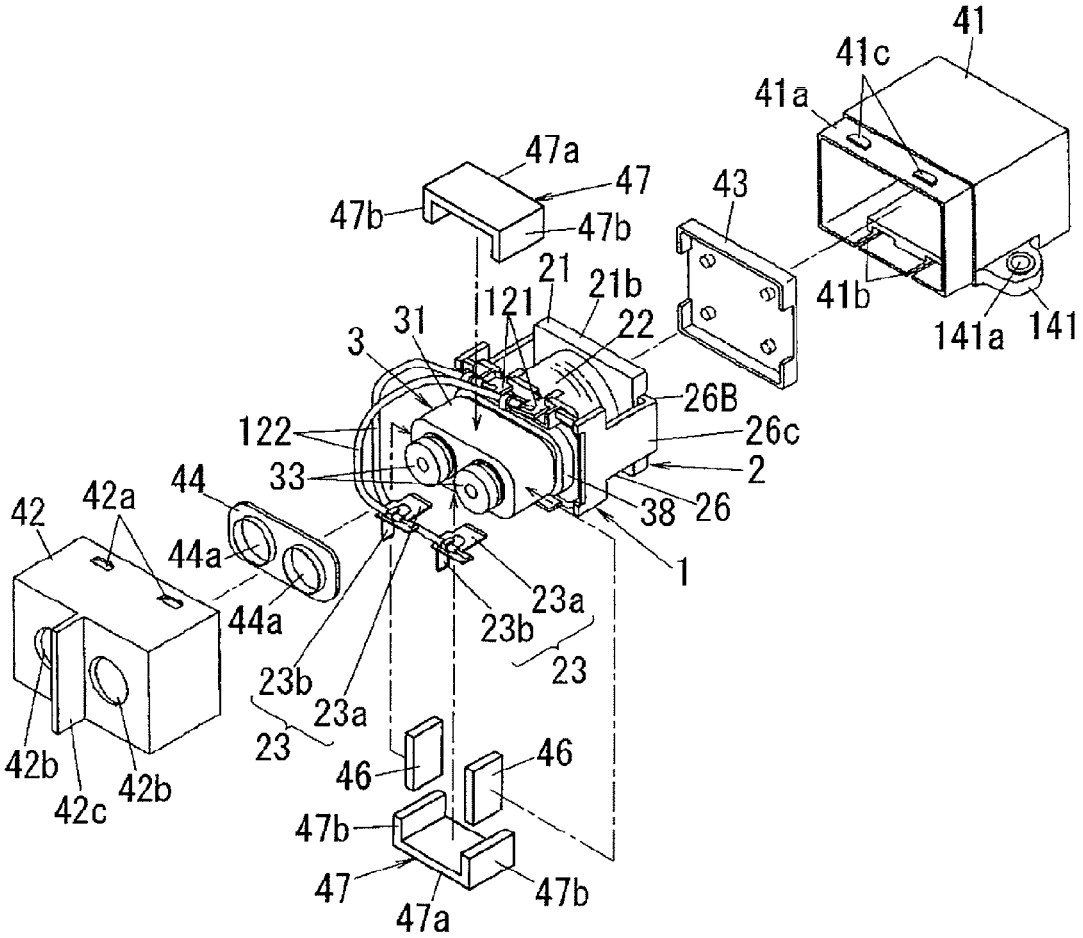

As shown in FIG. 29, a pair of first yokes 47 interconnecting the permanent magnets 46 may be provided in an opposing relationship with the transverse end surfaces of the movable contactor 35. The first yokes 47 are formed into a substantially square bracket-like shape. Each of the first yokes 47 includes a base portion 47*a* opposing to the transverse end surfaces of the movable contactor 35 and a pair of extension portions 47*b* extending from the opposite ends of the base portion 47*a* in a substantially perpendicular relationship with the base portion 47*a*. The extension portions 47*b* are connected to the respective permanent magnets 46. In this regard, the extension portions 47*b* are connected to the N-pole surfaces of the permanent magnets 46. That is to say, one of the extension portions 47*b* is connected to the right surface of the right permanent magnet 46. The other extension portion 47*b* is connected to the left surface of the left permanent magnet 46.

Thus the magnetic fluxes coming out from the permanent magnets 46 are attracted by the first yokes 47. This suppresses leakage of the magnetic fluxes, thereby making it possible to increase the magnetic flux density near the contact points. This increases the arc drawing-out forces generated between the contact points. Accordingly, even if the size of the permanent magnets 46 is made small, the arc drawing-out forces can be maintained by installing the first yokes 47. It is therefore possible to reduce the size of the contact device and to assure cost-effectiveness while maintaining the arc cutoff performance. In the contact device of the present modified example, if an electric current flows through the movable contactor 35, magnetic fields are formed as shown in FIGS. 5A and 5B. An upward electromagnetic force (attraction force) is applied to the movable contactor 35. That is to say, an attraction force acting substantially parallel to the displacement direction of the movable contactor 35 (vertically upward) to attract the movable contactor 35 toward the fixed contact points is applied to the movable contactor 35. For that reason, the contact point repulsion force can be efficiently negated by the attraction force. This makes it possible to suppress a decrease in the contact pressure acting between the contact points. In the contact device of the present modified example, it is therefore possible to obtain stable contact-point switching performance because the movable contactor 35 is attracted toward the fixed contact points by the second yoke 52.

In the present modified example, the second yoke 52 serves as both a yoke and a contact portion. The second yoke 52 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 52 and the shaft portion 51 are one-piece formed in the present modified example, it may be possible to independently form the second yoke 52 and the shaft portion 51, after which the shaft portion 51 may be fitted to the second yoke 52.

The contact device of the present modified example can be used in, e.g., an electromagnetic relay shown in FIGS. 30A, 30B and 31A through 31C.

The electromagnetic relay using the contact device of the present modified example has the same configuration as that of the electromagnetic relay of the first embodiment except that the permanent magnets are arranged along the arranging direction of the movable contact points in a mutually-opposing relationship across the contact point block. Just like the electromagnetic relay employing the contact device of the first embodiment, the electromagnetic relay using the contact device of the present modified example is capable of providing stable contact-point switching performance while assuring size reduction and cost-effectiveness.

The contact device of the present modified example may be a sealed contact device.

(Second Modified Example)

A contact device according to a second modified example will be described with reference to FIG. 32. The contact device of the present modified example differs from the contact device of the first modified example only in terms of the arrangement of the movable contactor 35 with respect to the permanent magnets 46. The same structures as those of the first modified example will be designated by like reference symbols with no description made thereon. Up-down and left-right directions in FIG. 32 will be referred to as front-rear and left-right directions. In the following description, it is assumed that an electric current flows from the left side toward the right side through the movable contactor 35.

Figure 32:
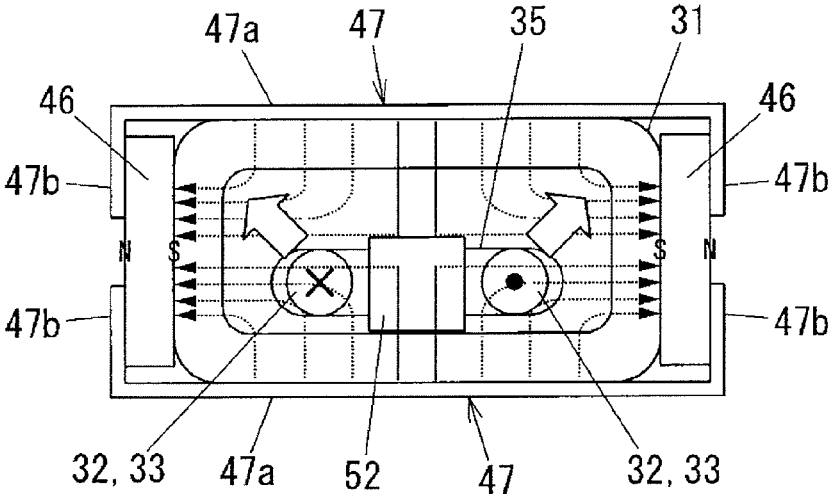
FIG. 32 is a partially enlarged view showing a contact device according to a second modified example of the present invention.

As described above in respect of the first modified example, the arc generated in the left contact point unit is drawn out toward the left rear side and the arc generated in the right contact point unit is drawn out toward the right rear side (see arrows in FIG. 32). In the present modified example, the movable contactor 35 is arranged between the first yokes 47 in a position nearer to the front first yoke 47 than the rear first yoke 47. That is to say, the space existing at the rear side of the movable contactor 35 is increased just as much as the offset of the movable contactor 35 from the center between the first yokes 47 toward the front first yoke 47.

In the contact device of the present modified example, if the electric current flows toward the right side through the movable contactor 35 in FIG. 32, it is possible to make the arc drawing-out distance longer than that available in the first modified example and to enhance the arc cutoff performance with respect to the forward electric current.

Figure 33:
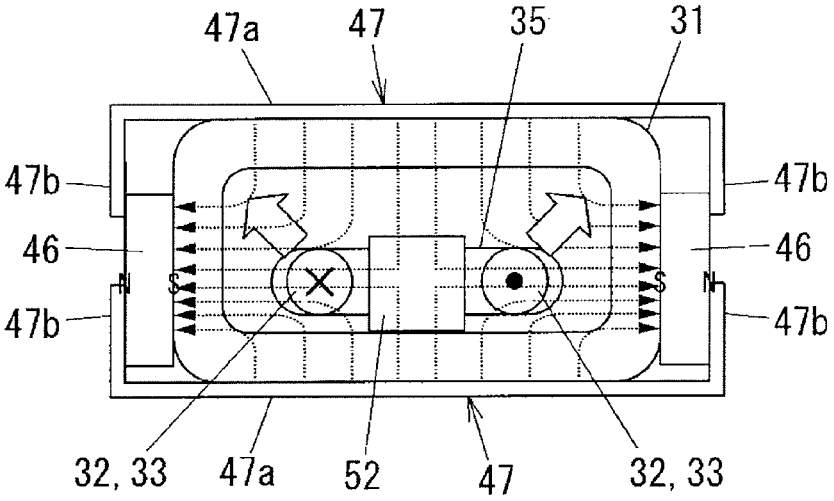
FIG. 33 is a partially enlarged view showing a modification of the contact device of the second modified example.

As shown in FIG. 33, the permanent magnets 46 are arranged such that the centers of the mutually-opposing surfaces of the permanent magnets 46 lie on a straight line interconnecting the fixed contact points. This makes it possible to increase the magnetic flux densities around the respective contact point units. That is to say, the force of drawing out the arc current toward the rear side grows larger, which makes it possible to further enhance the arc cutoff performance.

While the present modified example is directed to a case where the electric current flows toward the right side through the movable contactor 35, it is equally possible to apply the present modified example to a case where the electric current flows in the reverse direction (from the right side toward the left side). In that case, the movable contactor 35 is arranged in a position offset to the rear first yoke 47 from the center between the first yokes 47.

The contact device of the present modified example may be a sealed contact device.

(Third Modified Example)

A contact device according to a third modified example will be described with reference to FIGS. 34 and 12. The contact device of the present modified example differs from the contact device of the first modified example only in terms of the shape of the second yoke 53 of the movable shaft 5. The same structures as those of the first modified example will be designated by like reference symbols with no description made thereon. Up-down and left-right directions will be defined on the basis of the directions shown in FIG. 34. The direction orthogonal to the up-down and left-right directions will be referred to as front-rear direction.

Figure 34:
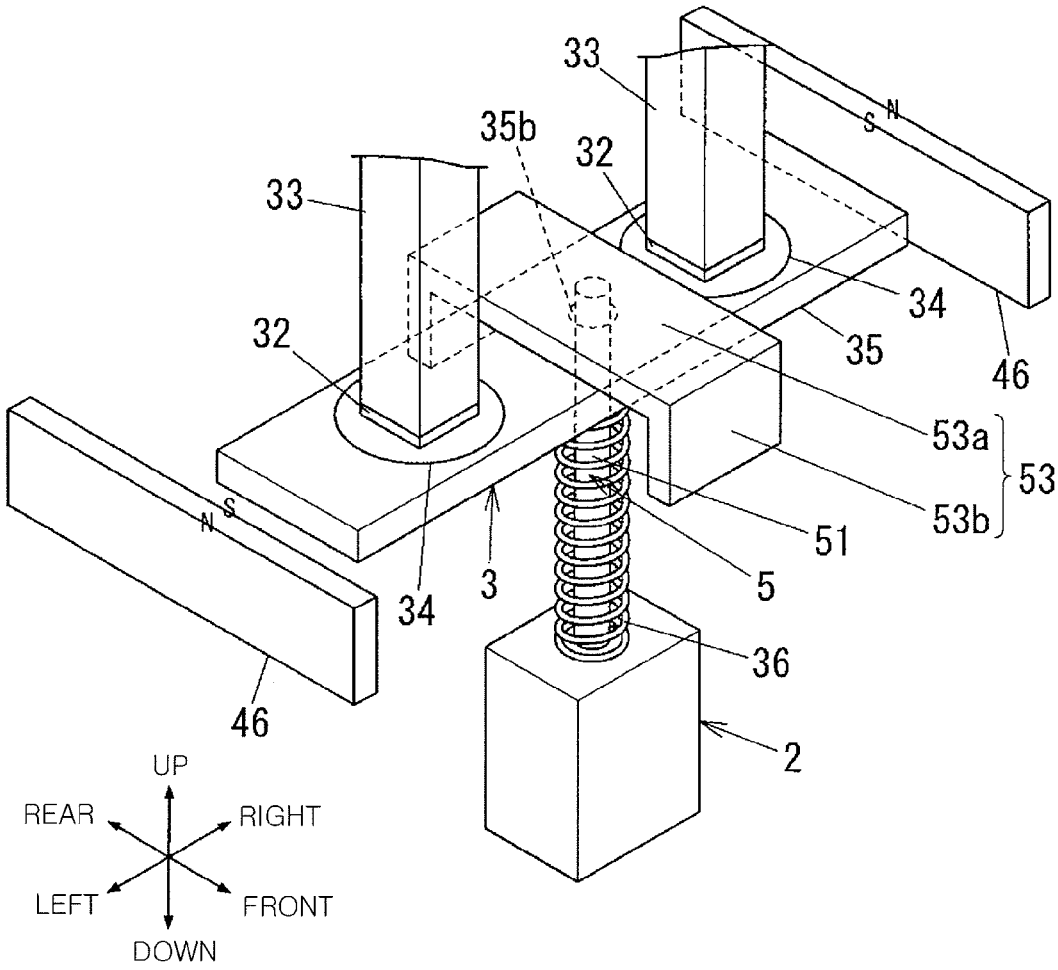
FIG. 34 is a schematic perspective view showing a contact device according to a third modified example of the present invention.

As shown in FIG. 34, the second yoke 53 of the present modified example is formed into a substantially square bracket-like cross-sectional shape. The second yoke 53 includes a base portion 53*a* having a substantially rectangular plate shape and a pair of extension portions 53*b* extending downward from the front and rear opposite ends of the base portion 53*a*.

When the contact points are electrically connected to each other, the lower surface of the base portion 53*a* of the second yoke 53 comes close to the upper surface of the movable contactor 35 while the extension portions 53*b* come close to the front and rear ends of the movable contactor 35.

Then, as shown in FIG. 12, the balance of the magnetic fields generated around the movable contactor 35 is collapsed under the influence of the second yoke 53 coming close to the upper surface and the front and rear ends of the movable contactor 35. More specifically, most of the magnetic fluxes going from the right side toward the left side through the movable contactor 35 in FIG. 12 are attracted by the second yoke 53. Therefore, as compared with a case where the flat second yoke 52 is arranged near the movable contactor 35 as shown in FIG. 6B, the number of the magnetic fluxes going from the right side toward the left side through the movable contactor 35 is further reduced.

On the other hand, as shown in FIG. 12, all the magnetic fluxes going from the left side toward the right side through the movable contactor 35 are moved upward. Therefore, as compared with a case where the flat second yoke 52 is arranged near the movable contactor 35 as shown in FIG. 6B, the number of the magnetic fluxes going from the left side toward the right side through the movable contactor 35 is further increased.

Then, the upward electromagnetic force applied to the movable contactor 35 by the magnetic fluxes going from the left side toward the right side through the movable contactor 35 grows larger than the downward electromagnetic force applied to the movable contactor 35 by the magnetic fluxes going from the right side toward the left side through the movable contactor 35. For that reason, a large vertically-upward electromagnetic force (attraction force) acting substantially parallel to the displacement direction of the movable contactor 35 is applied to the movable contactor 35.

In this regard, the vertically upward attraction force applied to the movable contactor 35 is 180 degrees opposite to the contact point repulsion force (the downward force) generated in the movable contactor 35. Thus the vertically upward attraction force acts in the direction in which the contact point repulsion force is most efficiently negated. For that reason, as compared with the first modified example, a large upward attraction force is generated in the movable contactor 35. This makes it possible to further suppress a decrease in the contact pressure acting between the contact points.

In the contact device of the present modified example, therefore, a force (attraction force) negating the contact point repulsion force, which is larger than the force available in the first modified example, is applied to the movable contactor 35 by the second yoke 53. Consequently, the contact device of the present modified example is capable of increasing the endurance against the electromagnetic repulsion force generated during load short-circuit, providing stable arc cutoff performance and obtaining stable contact-point switching performance. In the present modified example, the second yoke 53 serves as both a yoke and a contact portion. The second yoke 53 and the shaft portion 51 are one-piece formed into the movable shaft 5. Accordingly, the functions of a yoke, a contact portion and a shaft portion are provided by a single component (the movable shaft 5). This makes it possible to reduce the number of components.

The extension portions 53*b* of the second yoke 53 are provided to make contact with the inner wall of the case 4. Therefore, even if the rotational force acting in the winding direction of the compression spring 36 is applied to the second yoke 53, it is possible to prevent rotation of the second yoke 53 without having to provide any additional component. While all the extension portions 53*b* make contact with the inner wall of the case 4 in the present modified example, the rotation of the second yoke 53 may be prevented by bringing only one of the extension portions 53*b* into contact with the inner wall of the case 4.

While the second yoke 53 and the shaft portion 51 are one-piece formed in the present modified example, it may be possible to independently form the second yoke 53 and the shaft portion 51, after which the shaft portion 51 may be fitted to the second yoke 53.

In the present modified example, the second yoke 53 is made of soft iron and is used as a yoke contact portion having the functions of a contact portion and a yoke. Alternatively, the second yoke 53 may be made of a non-magnetic material while providing an additional yoke. In that case, the additional yoke is provided in the substantially central region between the fixed terminals 33 and is arranged in a substantially opposing relationship with the axis of the movable shaft.

The contact device of the present modified example may be a sealed contact device.

(Fourth Modified Example)

Figure 35:
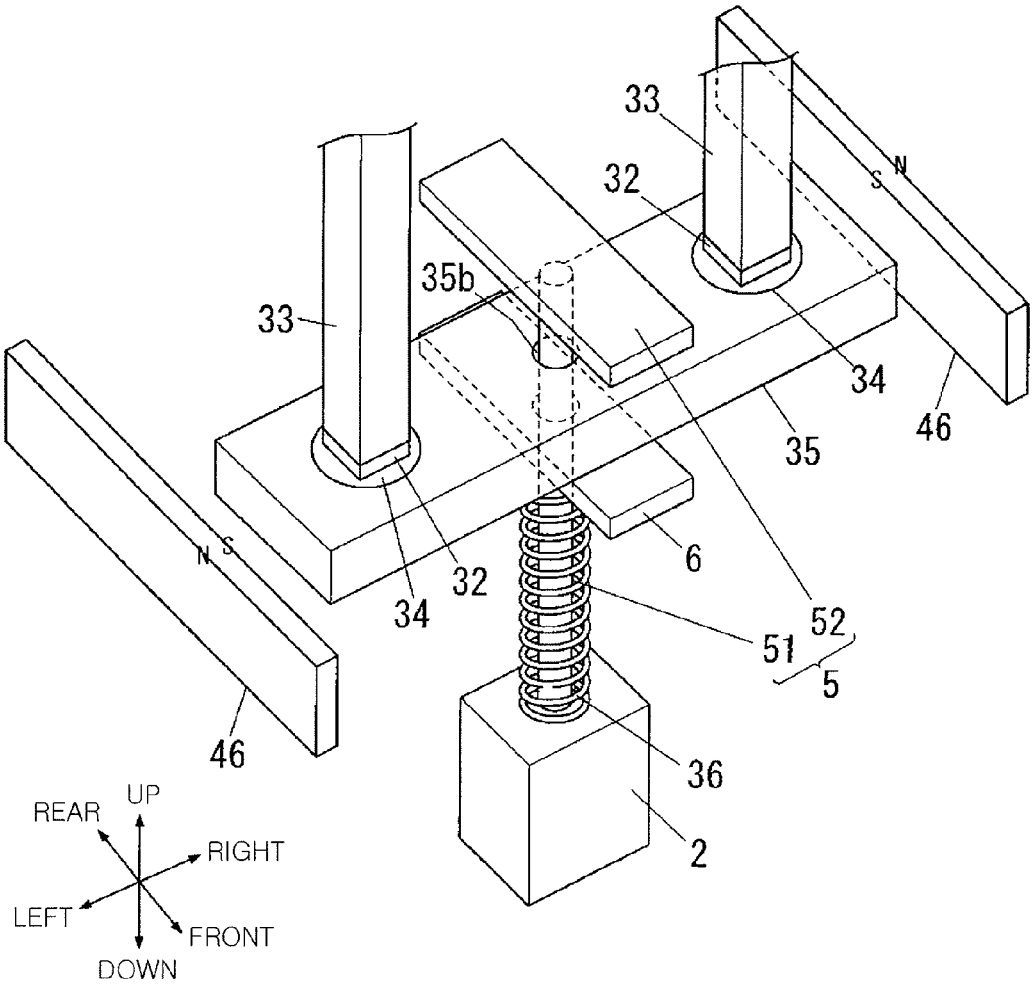
FIG. 35 is a schematic perspective view showing a contact device according to a fourth modified example of the present invention.

A contact device according to a fourth modified example will be described with reference to FIGS. 35 and 14. The same structures as those of the first modified example will be designated by like reference symbols with no description made thereon. Up-down and left-right directions will be defined on the basis of the directions shown in FIG. 35. The direction orthogonal to the up-down and left-right directions will be referred to as front-rear direction.

Figure 27:
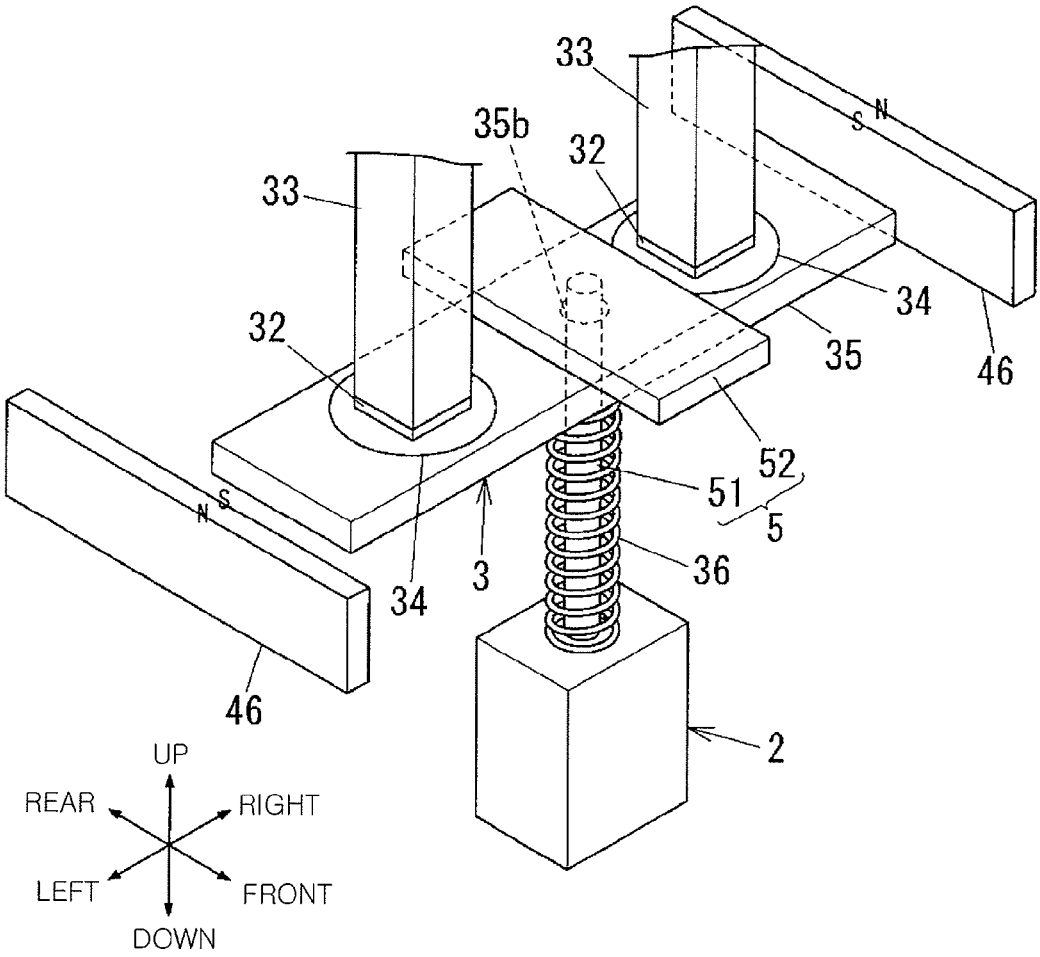
FIG. 27 is a schematic perspective view showing a contact device according to a first modified example of the present invention.

The contact device of the present modified example differs from the contact device of the first modified example shown in FIG. 27 in that a yoke plate 6 (hereinafter referred to as third yoke 6) made of a magnetic material, e.g., soft iron, and opposed to the contact portion 52 across the movable contactor 35 is fixed to the lower surface of the movable contactor 35.

In the contact device of the present modified example, if the movable shaft 5 is displaced upward by the drive unit 2, the second yoke 52 of the movable shaft 5 is also moved upward. As the second yoke 52 is moved upward, the restraint on the upward movement of the movable contactor 35 (the movement of the movable contactor 35 toward the fixed contact points 32) is released, whereby the movable contactor 35 is displaced upward by the pressing force of the compression spring 36. Then, the movable contact points 34 provided in the movable contactor 35 comes into contact with the fixed contact points 32, whereby the movable contact points 34 and the fixed contact points 32 are electrically connected to each other. At this time, the second yoke 52 is kept in the post-displacement position by the drive unit 2. Thus the second yoke 52 comes into contact with or comes close to the movable contactor 35 upwardly moved by the compression spring 36.

If the contact points are electrically connected to each other and if an electric current flows through the movable contactor 35, magnetic fields are generated around the movable contactor 35. As shown in FIG. 14, magnetic fluxes passing through the second yoke 52 and the third yoke 6 are formed and a first magnetic attraction force is generated between the second yoke 52 and the third yoke 6.

The third yoke 6 is attracted toward the second yoke 52 by the first magnetic attraction force acting between the second yoke 52 and the third yoke 6. That is to say, an upward force acting substantially parallel to the displacement direction of the movable contactor 35 (pressing the movable contactor 35 against the fixed contact points 32) is applied to the movable contactor 35 to which the third yoke 6 is fixed.

In this regard, the first magnetic attraction force acting between the second yoke 52 and the third yoke 6 to bias the movable contactor 35 upward is substantially 180 degrees opposite to the contact point repulsion force (the downward force) generated in the movable contactor 35. Thus the first magnetic attraction force acts in the direction in which the contact point repulsion force is most efficiently negated. In the contact device of the present modified example, therefore, the contact point repulsion force can be efficiently negated by the first magnetic attraction force. This makes it possible to suppress a decrease in the contact pressure acting between the contact points.

Consequently, the contact device of the present modified example is capable of increasing the endurance against the electromagnetic repulsion force generated during load short-circuit, providing stable arc cutoff performance and obtaining stable contact-point switching performance.

In the present modified example, the second yoke 52 serves as both a yoke and a contact portion. The second yoke 52 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 52 and the shaft portion 51 are one-piece formed in the present modified example, it may be possible to independently form the second yoke 52 and the shaft portion 51, after which the shaft portion 51 may be fitted to the second yoke 52.

As compared with the third yoke 6, the second yoke 52 arranged at the side of the fixed terminals 33 receives stronger magnetic fluxes from the fixed terminals 33. Thus the magnetic flux density is increased in the second yoke 52. For that reason, the first magnetic attraction force can be efficiently increased by increasing the up-down direction thickness of the second yoke 52 rather than increasing the up-down direction thickness of the third yoke 6. Accordingly, the decrease in the contact pressure between the contact points can be reliably prevented by increasing the thickness of the second yoke 52.

In the present modified example, the contact portion 52 is made of a magnetic material and is used as the second yoke 52 having the functions of a contact portion and a yoke. Alternatively, the contact portion 52 may be made of a non-magnetic material while providing an additional yoke. In that case, the additional yoke is provided in the substantially central region between the fixed terminals 33 and is arranged in a substantially opposing relationship with the axis of the movable shaft 5.

Since the second yoke 52 and the third yoke 6 are formed into a substantially rectangular plate shape in the present modified example, the distances from the respective points on the surface of the second yoke 52 opposing to the third yoke 6 to the third yoke 6 are substantially constant. It is therefore possible to keep substantially uniform the first magnetic attraction force acting on the third yoke 6.

The contact device of the present modified example may be a sealed contact device.

(Fifth Modified Example)

A contact device according to a fifth modified example will be described with reference to FIGS. 36 and 16. The contact device of the present modified example differs from the contact device of the fourth modified example only in terms of the shape of a yoke plate 7 (a third yoke). The same structures as those of the fourth modified example will be designated by like reference symbols with no description made thereon. Up-down and left-right directions will be defined on the basis of the directions shown in FIG. 36. The direction orthogonal to the up-down and left-right directions will be referred to as front-rear direction.

Figure 36:
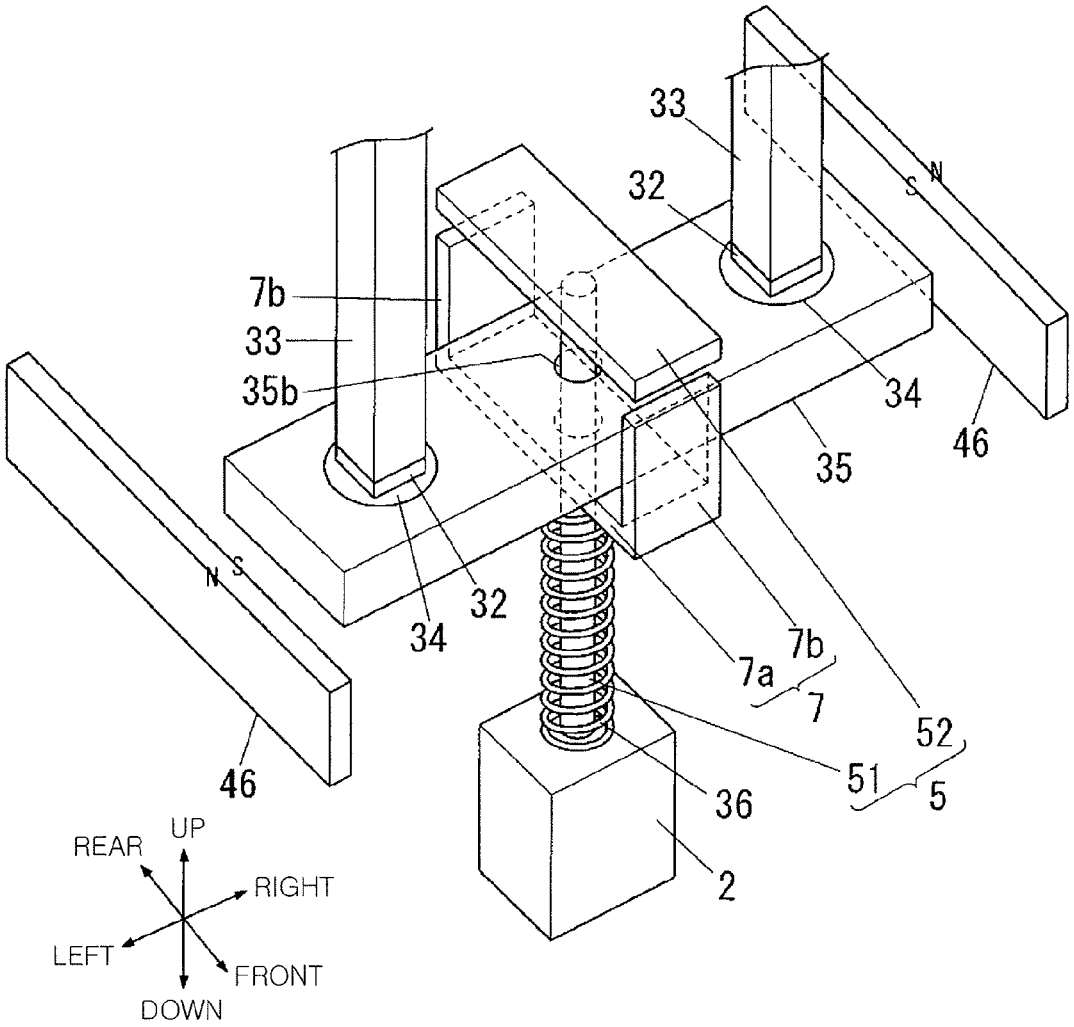
FIG. 36 is a schematic perspective view showing a contact device according to a fifth modified example of the present invention.

As shown in FIG. 36, the third yoke 7 of the present modified example is formed into a substantially square bracket-like cross-sectional shape. The third yoke 7 includes a base portion 7*a* having a substantially rectangular plate shape and a pair of extension portions 7*b* extending upward from the front and rear opposite ends of the base portion 7*a*.

When the contact points are electrically connected to each other as shown in FIG. 16, the tip ends of the extension portions 7*b* of the third yoke 7 come close to the second yoke 52. Thus, the gap between the second yoke 52 and the third yoke 7 becomes smaller than that available in the third modified example. The third yoke 7 receives a strong first magnetic attraction force from the second yoke 52. That is to say, a strong upward force is applied to the movable contactor 35.

In the contact device of the present modified example, therefore, the first magnetic attraction force acting between the second yoke 52 and the third yoke 7 is larger than that available in the third modified example. A larger upward force is applied to the movable contactor 35. This makes it possible to further suppress a decrease in the contact pressure between the contact points.

In this regard, the first magnetic attraction force is substantially 180 degrees opposite to the contact point repulsion force (the upward force) generated in the movable contactor 35. Thus the first magnetic attraction force acts in the direction in which the contact point repulsion force is most efficiently negated.

In the contact device of the present modified example, therefore, the movable contactor 35 is attracted toward the fixed contact points 32 by the first magnetic attraction force stronger than that available in the third modified example. That is to say, the contact device of the present modified example is capable of increasing the endurance against the electromagnetic repulsion force generated during load short-circuit and providing stable arc cutoff performance. Since the movable contactor 35 is pressed against the fixed contact points 32 by the third yoke 7, the contact device of the present modified example has stable contact-point switching performance.

In the present modified example, the second yoke 52 serves as both a yoke and a contact portion. The second yoke 52 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 52 and the shaft portion 51 are one-piece formed in the present modified example, it may be possible to independently form the second yoke 52 and the shaft portion 51, after which the shaft portion 51 may be fitted to the second yoke 52.

In the present modified example, the second yoke 52 is made of a magnetic material and is used as a yoke contact portion having the functions of a contact portion and a yoke. Alternatively, the second yoke 52 may be made of a non-magnetic material while providing an additional yoke. In that case, the additional yoke is provided in the substantially central region between the fixed terminals 33 and is arranged in a substantially opposing relationship with the axis of the movable shaft.

A substantially annular groove 71*a* is formed in the substantially central region of the lower surface of the base portion 7*a* of the third yoke 7. The upper end of the compression spring 36 is fitted to the groove 71*a*. This enhances the fixing stability of the compression spring 36. When a contact point repulsion force is generated in the movable contactor 35, a uniform force is applied to the movable contactor 35. This makes it possible to stably obtain yield strength against the contact point repulsion force.

The contact device of the present modified example may be a sealed contact device.

(Sixth Modified Example)

A contact device according to a sixth modified example will be described with reference to FIGS. 37 and 18. The contact device of the present modified example differs from the contact device of the fifth modified example only in terms of the shape of the yoke contact portion 53 (the second yoke 53). The same structures as those of the fourth modified example will be designated by like reference symbols with no description made thereon. Up-down and left-right directions will be defined on the basis of the directions shown in FIG. 37. The direction orthogonal to the up-down and left-right directions will be referred to as front-rear direction.

Figure 37:
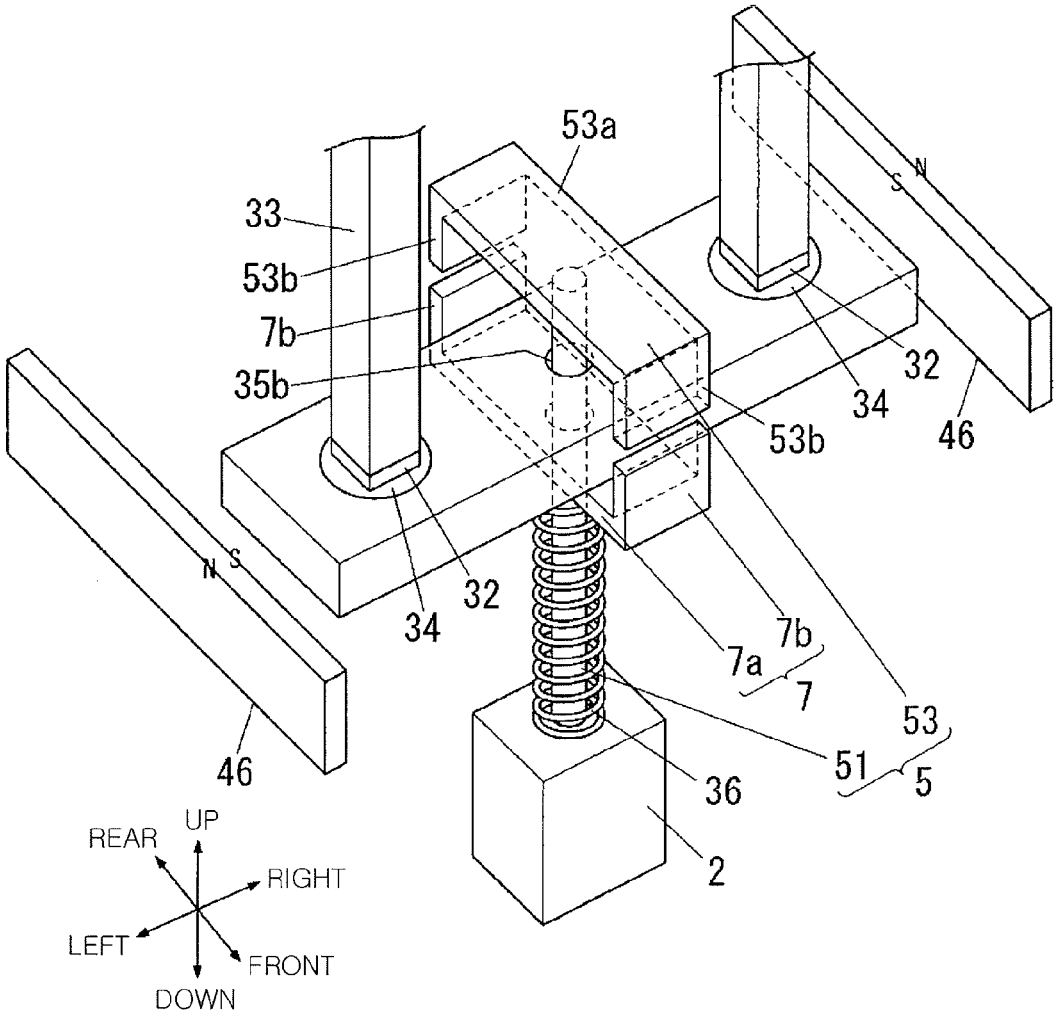
FIG. 37 is a schematic perspective view showing a contact device according to a sixth modified example of the present invention.

As shown in FIG. 37, the second yoke 53 is formed into a substantially square bracket-like cross-sectional shape. The second yoke 53 includes a base portion 53*a* having a substantially rectangular plate shape and a pair of extension portions 53*b* extending downward from the front and rear opposite ends of the base portion 53*a*.

When the contact points are electrically connected to each other as shown in FIG. 18, the tip end surfaces of the extension portions 53*b* of the second yoke 53 comes close to the tip end surfaces of the extension portions 7*b* of the third yoke 7. Thus the first magnetic attraction force acting between the second yoke 53 and the third yoke 7 grows larger. The gaps between the tip end surfaces of the extension portions 53*b* and the tip end surfaces of the extension portions 7*b* are formed so as to oppose to the substantially central regions of the lateral end surfaces of the movable contactor 35. It is therefore possible to reduce leakage of the magnetic fluxes from the gaps between the second yoke 53 and the third yoke 7 and to further increase the first magnetic attraction force acting between the second yoke 53 and the third yoke 7 as compared with the fourth modified example. That is to say, a large upward force acting substantially parallel to the displacement direction of the movable contactor 35 is applied to the movable contactor 35.

The contact device of the present modified example is capable of increasing the endurance against the electromagnetic repulsion force generated during load short-circuit and providing stable arc cutoff performance. Since the movable contactor 35 is pressed against the fixed contact points 32 by a force larger than the force available in the fourth modified example, the contact device of the present modified example has stable contact-point switching performance. In this regard, the first magnetic attraction force is a force (an upward force) substantially 180 degrees opposite to the contact point repulsion force (the down force) generated in the movable contactor 35. Thus the first magnetic attraction force acts in the direction in which the contact point repulsion force is most efficiently negated.

In the present modified example, the second yoke 53 serves as both a yoke and a contact portion. The second yoke 53 and the shaft portion 51 are one-piece formed into the movable shaft 5. Accordingly, the functions of a yoke, a contact portion and a shaft portion are provided by a single component (the movable shaft 5). This makes it possible to reduce the number of components.

While the second yoke 53 and the shaft portion 51 are one-piece formed in the present modified example, it may be possible to independently form the second yoke 53 and the shaft portion 51, after which the shaft portion 51 may be fitted to the second yoke 53.

In the present modified example, the second yoke 53 is made of a magnetic material and is used as a yoke contact portion having the functions of a contact portion and a yoke. Alternatively, the second yoke 53 may be made of a non-magnetic material while providing an additional yoke. In that case, the additional yoke is provided in the substantially central region between the fixed terminals 33 and is arranged in a substantially opposing relationship with the axis of the movable shaft.

The contact device of the present modified example may be a sealed contact device.

(Seventh Modified Example)

Figure 38:
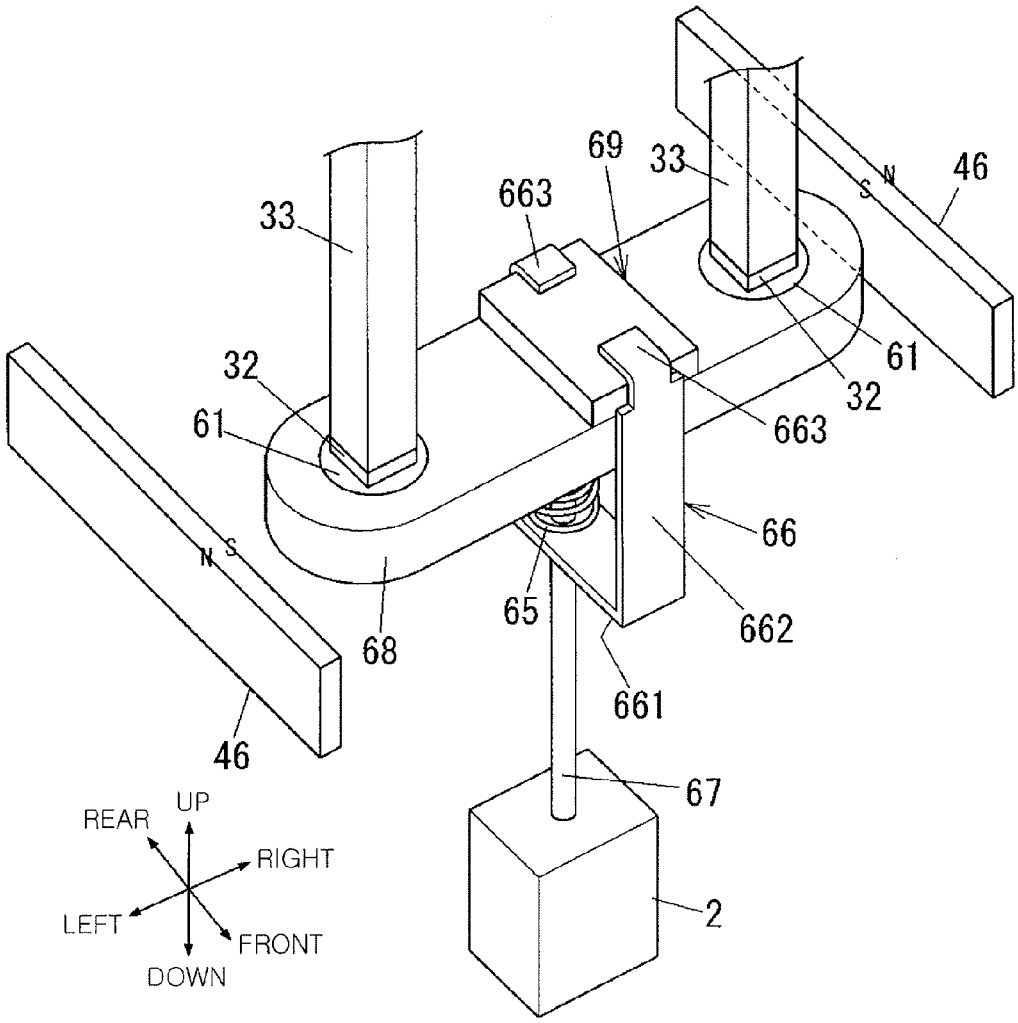
FIG. 38 is a schematic perspective view showing a contact device according to a seventh modified example of the present invention.
Figure 39:
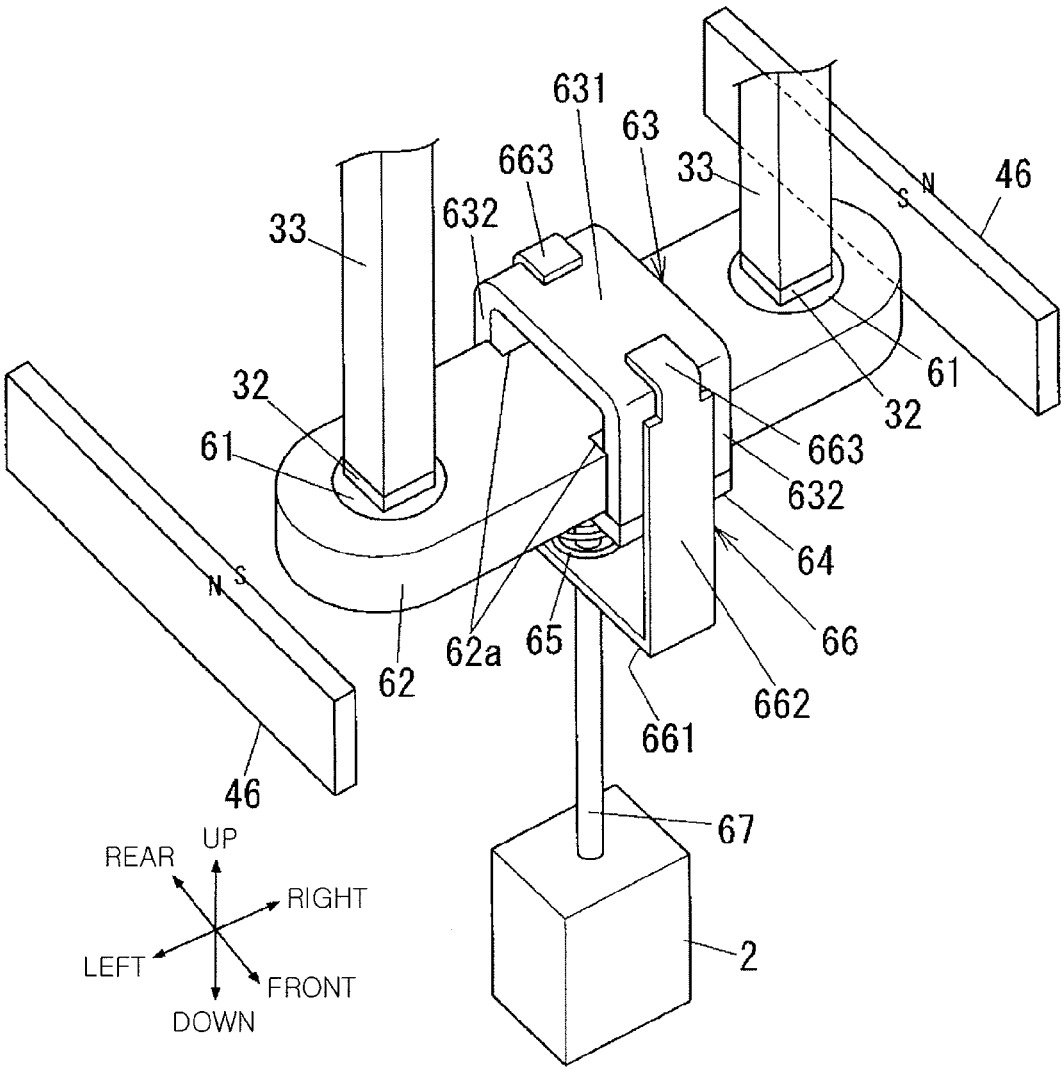
FIG. 39 is a schematic perspective view showing a contact device according to an eighth modified example of the present invention.

A contact device according to a seventh modified example will be described with reference to FIGS. 38 and 20. Up-down and left-right directions will be defined on the basis of the directions shown in FIG. 38. The direction orthogonal to the up-down and left-right directions will be referred to as front-rear direction.

The contact device of the present modified example includes fixed terminals 33 having fixed contact points 32 formed at the lower ends thereof, a movable contactor 68 having movable contact points 61 coming into contact and out of contact with the fixed contact points 32, a second yoke 69 arranged in an opposing relationship with the upper surface of the movable contactor 68, a compression spring 65 for biasing the movable contactor 68 toward the fixed contact points 32, a holder member 66 for holding the second yoke 69, a movable shaft 67 connected to the holder member 66, an electromagnet block 2 for driving the movable shaft 67 so that the movable contact points 61 can come into contact and out of contact with the fixed contact points 32, and a pair of permanent magnets 46 opposing to the left and right ends of the movable contactor 68. The fixed contact points 32, the fixed terminals 33, the electromagnet block 2 and the permanent magnets 46 are the same as those of the first embodiment and, therefore, will be designated by like reference symbols with no description made thereon.

The movable contactor 68 is formed into a substantially rectangular plate shape. The movable contact points 61 are arranged in the longitudinal (left-right) opposite end regions of the upper surface of the movable contactor 68.

The second yoke 69 is formed into a flat plate shape by a magnetic material such as soft iron or the like and is arranged in an opposing relationship with the upper surface of the movable contactor 68.

The upper end of the compression spring 65 makes contact with the substantially central region of the lower surface of the movable contactor 68. A protrusion portion 68*a* protruding from the substantially central region of the lower surface of the movable contactor 68 is fitted to the upper end bore of the compression spring 65.

The holder member 66 includes a base portion 661 having a substantially rectangular plate shape, a pair of grip portions 662 extending upward from the front-rear opposite ends of the base portion 661 and a pair of contact portions 663 formed by bending the tip ends of the grip portions 662 inward in the front-rear direction.

The compression spring 65 having a lower end making contact with the upper surface of the base portion 661, the movable contactor 68 having a lower surface pressed against the compression spring 65, and the second yoke 69 held by the grip portions 662 in an opposing relationship with the upper surface of the movable contactor 68 are arranged between the grip portions 662.

In this regard, a substantially cylindrical columnar protrusion portion 664 protrudes from the substantially central region of the upper surface of the base portion 661 of the holder member 66. The protrusion portion 664 is fitted to the lower end bore of the compression spring 65. As a consequence, the compression spring 65 is fixed between the base portion 661 and the movable contactor 68 in a compressed state so as to bias the movable contactor 68 toward the fixed contact points 32 (upward). The movable contactor 68 is urged to move toward the fixed terminals 33 (upward) by the pressing force of the compression spring 65. However, the movement of the movable contactor 68 toward the fixed contact points 32 is restrained because the upper surface of the movable contactor 68 makes contact with the second yoke 69 whose upward movement is restrained by the contact portion 663.

The movable shaft 67 is formed into a vertically-extending substantially rod-like shape. The electromagnet block 2 is connected to the lower end of the movable shaft 67. The base portion 661 of the holder member 66 is fixed to the upper end of the movable shaft 67.

In the contact device of the present modified example configured as above, if the movable shaft 67 is displaced upward by the drive unit 2, the holder member 66 connected to the movable shaft 67 is also displaced upward. Then, the second yoke 69 held by the holder member 66 is moved upward, thereby releasing the restraint on the upward movement of the movable contactor 68. The movable contactor 68 is moved upward by the pressing force of the compression spring 65. The movable contact points 61 formed in the movable contactor 68 comes into contact with the fixed contact points 32, whereby the movable contact points 61 and the fixed contact points 32 are electrically connected to each other.

If an electric current flows through the movable contactor 68 as a result of the electric connection of the contact points, an upward electromagnetic force (attraction force) is applied to the movable contactor 68. That is to say, an attraction force acting substantially parallel to the displacement direction of the movable contactor 68 (vertically upward) to attract the movable contactor 68 toward the fixed contact points is applied to the movable contactor 68.

In this regard, the vertically upward attraction force applied to the movable contactor 68 is 180 degrees opposite to the contact point repulsion force (the downward force) generated in the movable contactor 68. Thus the vertically upward attraction force acts in the direction in which the contact point repulsion force is most efficiently negated. For that reason, the contact point repulsion force can be efficiently negated by the attraction force. This makes it possible to suppress a decrease in the contact pressure acting between the contact points.

Due to the provision of the permanent magnets 46, the contact device of the present modified example draws out the arcs generated in the left and right contact points with no short-circuit and regardless of the flow direction of the electric current. The second yoke 69 attracts the movable contactor 68 toward the fixed contact points. Consequently, the contact device of the present modified example is capable of increasing the endurance against the electromagnetic repulsion force generated during load short-circuit, providing stable arc cutoff performance and obtaining stable contact-point switching performance.

The fixed contact points 32 may be one-piece formed with the fixed terminals 33 or may be formed independently of the fixed terminals 33. Similarly, the movable contact points 61 may be one-piece formed with the movable contactor 68 or may be formed independently of the movable contactor 68.

The contact device of the present modified example may be a sealed contact device.

(Eighth Modified Example)

A contact device according to an eighth modified example will be described with reference to FIGS. 39 and 22 through 25. Up-down and left-right directions will be defined on the basis of the directions shown in FIG. 39. The direction orthogonal to the up-down and left-right directions will be referred to as front-rear direction.

The contact device of the present modified example includes fixed terminals 33 having fixed contact points 32 formed at the lower ends thereof, a movable contactor 62 having movable contact points 61 coming into contact and out of contact with the fixed contact points 32, a second yoke 63 arranged in an opposing relationship with the upper surface of the movable contactor 62, a third yoke 64 arranged in an opposing relationship with the lower surface of the movable contactor 62, a compression spring 65 for biasing the movable contactor 62 toward the fixed contact points 32, a holder member 66 for holding the second yoke 63, a movable shaft 67 connected to the holder member 66, an electromagnet block 2 for driving the movable shaft 67 so that the movable contact points 61 can come into contact and out of contact with the fixed contact points 32, and a pair of permanent magnets 46 opposing to the left and right ends of the movable contactor 62. The fixed contact points 32, the fixed terminals 33, the electromagnet block 2 and the permanent magnets 46 are the same as those of the first modified example and, therefore, will be designated by like reference symbols with no description made thereon.

The movable contactor 62 is formed into a substantially rectangular plate shape. The movable contact points 61 are arranged in the longitudinal (left-right) opposite end regions of the upper surface of the movable contactor 62. Substantially rectangular cutout portions 62*a* are formed in the substantially central regions of the respective longitudinal sides of the movable contactor 62.

The second yoke 63 is formed into a substantially square bracket-like cross-sectional shape by a magnetic material such as soft iron or the like. The second yoke 63 includes a base portion 631 having a substantially rectangular plate shape and opposing to the upper surface of the movable contactor 62 and a pair of extension portions 632 formed by bending the opposite ends of the base portion 631 downward. The extension portions 632 are inserted through the cutout portions 62*a* of the movable contactor 62, whereby the second yoke 63 restrains the left-right movement of the movable contactor 62.

The third yoke 64 is formed into a substantially rectangular plate shape by a magnetic material such as soft iron or the like. The third yoke 64 is fixed to the lower surface of the movable contactor 62 and is opposed to the second yoke 63 across the movable contactor 62. The tip ends of the extension portions 632 of the second yoke 63 are opposed to the upper surface of the third yoke 64. The movable contactor 62 is interposed between the second yoke 63 and the third yoke 64. While the third yoke 64 is fixed to and one-piece formed with the movable contactor 62 in the present modified example, the third yoke 64 may be formed independently of the movable contactor 62 and may be arranged to make contact with the lower surface of the movable contactor 62.

The upper end of the compression spring 65 makes contact with the lower surface of the third yoke 64. A protrusion portion 64*a* protruding from the substantially central region of the lower surface of the third yoke 64 is fitted to the upper end bore of the compression spring 65.

The holder member 66 includes a base portion 661 having a substantially rectangular plate shape, a pair of grip portions 662 extending upward from the front-rear opposite ends of the base portion 661 and a pair of contact portions 663 formed by bending the tip ends of the grip portions 662 inward.

The movable contactor 62, which is interposed between the second yoke 63 and the third yoke 64, and the compression spring 65 are arranged between the grip portions 662. The second yoke 63 is held in place by the grip portions 662.

In this regard, a substantially cylindrical columnar protrusion portion 664 protrudes from the substantially central region of the upper surface of the base portion 661 of the holder member 66. The protrusion portion 664 is fitted to the lower end bore of the compression spring 65. As a consequence, the compression spring 65 is fixed between the base portion 661 and the third yoke 64 in a compressed state so as to bias the movable contactor 62 toward the fixed contact points 32 (upward) through the third yoke 64. The movable contactor 62 is urged to move toward the fixed terminals 33 (upward) by the pressing force of the compression spring 65. However, the movement of the movable contactor 62 toward the fixed contact points 32 is restrained because the upper surface of the movable contactor 62 makes contact with the second yoke 63 whose upward movement is restrained by the contact portion 663.

The movable shaft 67 is formed into a vertically-extending substantially rod-like shape. The electromagnet block 2 is connected to the lower end of the movable shaft 67. The base portion 661 of the holder member 66 is fixed to the upper end of the movable shaft 67.

In the contact device of the present embodiment configured as above, if the movable shaft 67 is displaced upward by the drive unit 2, the holder member 66 connected to the movable shaft 67 is also displaced upward. Then, the second yoke 63 held by the holder member 66 is moved upward, thereby releasing the restraint on the upward movement of the movable contactor 62. The movable contactor 62 is moved upward together with the third yoke 64 by the pressing force of the compression spring 65. The movable contact points 61 formed in the movable contactor 62 comes into contact with the fixed contact points 32, whereby the movable contact points 61 and the fixed contact points 32 are electrically connected to each other.

If an electric current flows through the movable contactor 62 as a result of the electric connection of the contact points, magnetic fields are generated around the movable contactor 62 and magnetic fluxes passing through the second yoke 63 and the third yoke 64 are formed as shown in FIG. 23. As a consequence, a magnetic attraction force is generated between the second yoke 63 and the third yoke 64. The third yoke 64 is attracted toward the second yoke 63. For that reason, the third yoke 64 presses the lower surface of the movable contactor 62, thereby generating an upward force by which the movable contactor 62 is pressed against the fixed contact points 32.

In this regard, the magnetic attraction force applied to the third yoke 64 is 180 degrees opposite to the contact point repulsion force (the downward force) generated in the movable contactor 62. Thus the magnetic attraction force acts in the direction in which the contact point repulsion force is most efficiently negated.

Therefore, the contact device of the present modified example is capable of increasing the endurance against the electromagnetic repulsion force generated during load short-circuit and providing stable arc cutoff performance. Since the movable contactor 62 is pressed against the fixed contact points 32 by the third yoke 64, the contact device of the present modified example has stable contact-point switching performance.

When the movable shaft 67 is further driven toward the fixed contact points 32 after the contact points are electrically connected to each other (hereinafter referred to as over-travel time), the second yoke 63 held by the holder member 66 is spaced apart from the movable contactor 62 because the movable contactor 62 is kept in contact with the fixed terminals 33 and is restrained from moving upward. In a hypothetical case where a substantially flat yoke 63' is used as a second yoke and a substantially square bracket-like yoke 64' is used as a third yoke as shown in FIG. 24A, the magnetic path of the yoke 63' and the magnetic force of the yoke 64' are not continuous. For that reason, magnetic fluxes are leaked through between the yoke 63' and the yoke 64'.

In the contact device of the present modified example, however, the second yoke 63 is formed into a substantially square bracket-like shape. Even at the over-travel time, the extension portions 632 of the second yoke 63 make contact with the movable contactor 62 as shown in FIG. 24B. Therefore, the magnetic path of the second yoke 63 and the magnetic path of the third yoke 64 are connected through the movable contactor 62, eventually preventing leakage of the magnetic fluxes. Accordingly, it is possible to prevent the magnetic fluxes from being leaked through between the second yoke 63 and the third yoke 64 and to prevent reduction of the magnetic attraction force applied to the third yoke 64.

As shown in FIG. 25, the area S1 of the substantially square bracket-like second yoke 63 opposing to the movable contactor 62 is larger than the area S2 of the plate-shaped third yoke 64 opposing to the movable contactor 62. Thus the second yoke 63 can easily receive the magnetic fluxes from the movable contactor 62. The magnetic path length L1 of the second yoke 63 is longer than the magnetic path length L2 of the third yoke 64. For that reason, the magnetic attraction force applied to the third yoke 64 can be efficiently increased by increasing the up-down thickness of the second yoke 63 rather than increasing the up-down thickness of the third yoke 64.

As compared with the third yoke 64, the second yoke 63 is positioned nearer to the fixed terminals 33 and can easily receive the magnetic fluxes from the fixed terminals 33. Therefore, the magnetic flux density in the second yoke 63 is higher than the magnetic flux density in the third yoke 64.

As described above, the second yoke 63 existing near the fixed terminals 33 is formed into a substantially square bracket-like shape. This makes it possible to efficiently increase the magnetic attraction force with respect to the third yoke 64. The magnetic attraction force with respect to the third yoke 64 available when the second yoke 63 is formed into a plate shape can be obtained by a substantially square bracket-like yoke having a thickness smaller than the thickness of the plate-shape yoke. By forming the second yoke 63 into a substantially square bracket-like shape, it is possible to reduce the thickness of the second yoke 63 and to reduce the size of the contact device while maintaining the magnetic attraction force with respect to the third yoke 64.

The fixed contact points 32 may be one-piece formed with the fixed terminals 33 or may be formed independently of the fixed terminals 33. Similarly, the movable contact points 61 may be one-piece formed with the movable contactor 62 or may be formed independently of the movable contactor 62.

The contact device of the present modified example may be a sealed contact device.

(Ninth Modified Example)

Figure 40:
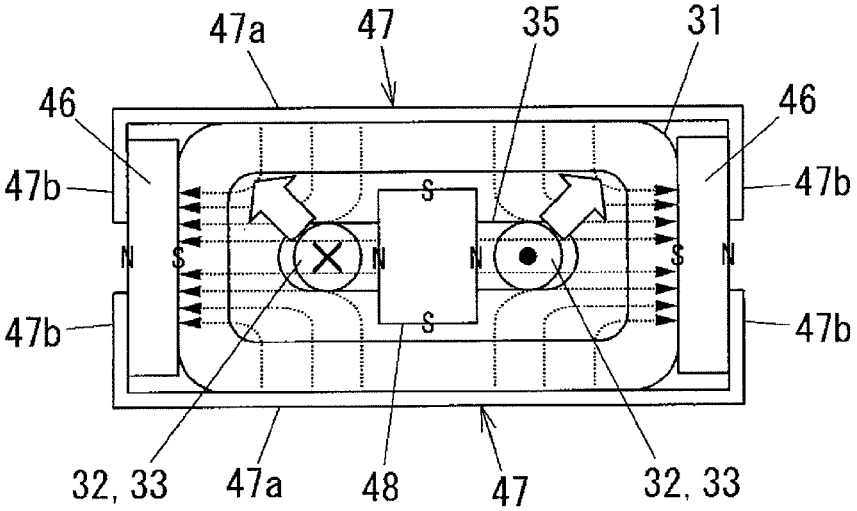
FIG. 40 is a partially enlarged view showing a contact device according to a ninth modified example of the present invention.
Figure 41:
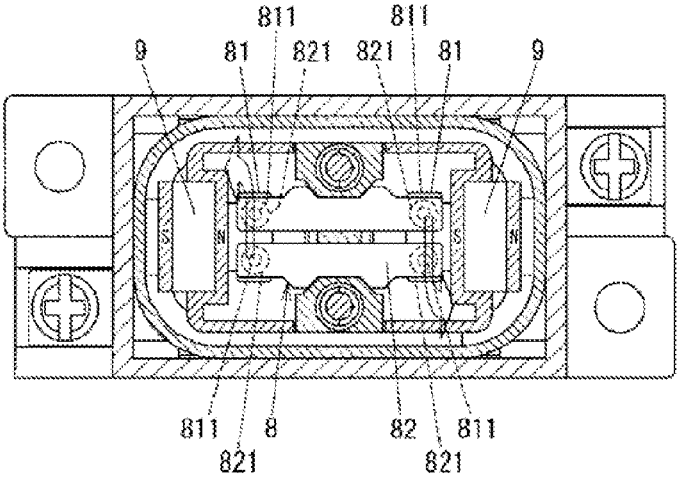
FIG. 41 (PRIOR ART)
FIG. 41 is a section view showing a first conventional contact device.
Figure 42:
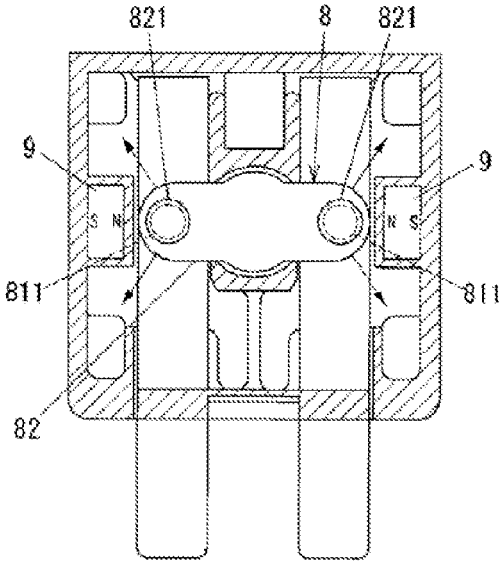
FIG. 42 (PRIOR ART)
FIG. 42 is a section view showing a second conventional contact device.
Figure 43:
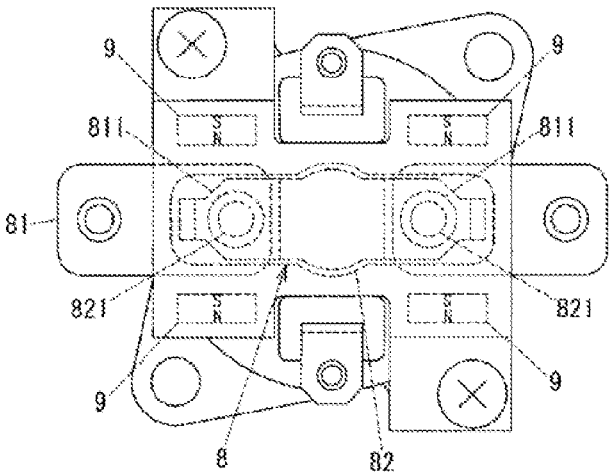
FIG. 43 (PRIOR ART)
FIG. 43 is a plan view showing a third conventional contact device.

A contact device according to a ninth modified example will be described with reference to FIG. 40. The contact device of the present modified example differs from the contact device of any one of the first through eighth modified examples in that a permanent magnet piece 48 is arranged between the permanent magnets 46. The same advantageous effects can be obtained regardless of which one of the contact devices of the first through eighth modified examples is provided with the permanent magnet piece 48. In the present modified example, description will be made on a case where the permanent magnet piece 48 is provided in the contact device of the first modified example. Up-down and left-right directions will be defined on the basis of the directions shown in FIG. 40. The direction orthogonal to the up-down and left-right directions will be referred to as front-rear direction.

The permanent magnet piece 48 is formed into a substantially rectangular parallelepiped shape and is arranged in the substantially middle region between the permanent magnets 46. The permanent magnet piece 48 is opposed to the upper surface of the movable contactor 35 and is positioned in the substantially middle region between a pair of first yokes 47. In this regard, the permanent magnet piece 48 is arranged in such a way that the facing surfaces of the permanent magnet piece 48 and the permanent magnets 46 are substantially parallel to each other and the surfaces of the permanent magnet piece 48 and the first yokes 47 are substantially parallel to each other.

The polarity of the surfaces (first surfaces) of the permanent magnet piece 48 opposing to the permanent magnets 46 is set as a pole (N-pole) different from the polarity of the surfaces of the permanent magnets 46 opposing to the first surfaces (set as the N-pole). The polarity of the surfaces (second surfaces) of the permanent magnet piece 48 opposing to the first yokes 47 is set as a pole (N-pole) different from the polarity of the first surfaces. That is to say, the polarity of the left and right side surfaces of the permanent magnet piece 48 is set as the N-pole. The polarity of the front and rear side surfaces of the permanent magnet piece 48 is set as the S-pole. For that reason, the magnetic fluxes generated between the permanent magnets 46 are attracted toward the permanent magnet piece 48 and are relayed by the permanent magnet piece 48.

In the contact device of the present modified example, therefore, the leakage of the magnetic fluxes between the permanent magnets 46 is suppressed by the provision of the permanent magnet piece 48. This helps increase the magnetic flux density near the respective contact point units. Due to the provision of the permanent magnet piece 48, the magnetic flux density near the respective contact point units is increased and the arc drawing-out force generated in the contact point unit is increased. This makes it possible to further enhance the arc cutoff performance.

The contact device of the present modified example may be a sealed contact device.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A contact device, comprising:

a contact point block including a pair of fixed terminals having fixed contact points and a movable contactor having a pair of movable contact points arranged side by side on one surface of the movable contactor, the movable contact points configured to come into contact and out of contact with the fixed contact points;

a driver that drives the movable contactor such that the movable contact points come into contact and out of contact with the fixed contact points;

a pair of permanent magnets arranged in a mutually opposing relationship across the contact point block along a direction orthogonal to an arrangement direction of the movable contact points and to a direction in which the movable contact points come into contact and out of contact with the fixed contact points, the permanent magnets provided with mutually-opposing surfaces having the same polarity;

a second yoke arranged between the permanent magnets in a mutually opposing relationship to each of the permanent magnets, the second yoke being positioned in an opposing relationship with said one surface of the movable contactor; and a third yoke that makes contact with the other surface of the movable contactor and opposes the second yoke across the movable contactor.

2. The device of claim 1, further comprising:

a pair of first yokes provided in an opposing relationship with end surfaces of the movable contactor in the arrangement direction of the movable contact points and arranged to interconnect the permanent magnets.

3. The device of claim 2, further comprising:

a permanent magnet piece arranged between the permanent magnets, the permanent magnet piece including first surfaces opposing to the permanent magnets and second surfaces opposing to the first yokes, the polarity of the first surfaces of the permanent magnet piece is different from the polarity of the surfaces of the permanent magnets opposing to the first surfaces, and the polarity of the second surfaces of the permanent magnet piece is different from the polarity of the first surfaces.

4. The device of claim 1, wherein the driver includes a compression spring biasing the movable contactor toward the fixed contact points, a restrainer to restrain the movable contactor from moving toward the fixed contact points, a movable shaft to which the restrainer is connected, and an electromagnet block to drive the movable shaft such that the movable contact points come into contact and out of contact with the fixed contact points.

5. The device of claim 4, wherein the movable shaft includes a shaft portion movably inserted through an insertion hole provided in the movable contactor and a contact portion arranged at one end of the shaft portion to contact said one surface of the movable contactor.

6. The device of claim 5, wherein the second yoke serves as the contact portion of the movable shaft.

7. The device of claim 5, wherein the second yoke serves as the contact portion of the movable shaft and is provided as one-piece with the movable shaft.

8. The device of claim 4, wherein the restrainer is arranged to hold the second yoke, the movable contactor and the compression spring and is configured to restrain movement of the movable contactor toward the fixed contact points through the second yoke.

9. The device of claim 1, wherein the contact point block is stored within a container, at least a portion of an outer periphery of the second yoke making contact with an inner wall of the container.

10. The device of claim 1, wherein the contact point block is stored within a container, at least a portion of the outer periphery of each of the second yoke and the third yoke making contact with an inner wall of the container.

11. The device of claim 1, wherein the second yoke comprises a flat plate shape.

12. The device of claim 1, wherein at least one of the second yoke and the third yoke comprises a flat plate shape.

13. The device of claim 1, wherein the second yoke comprises a substantially square bracket-like cross-sectional shape and includes a plate-shaped base portion opposed to the movable contactor and a pair of extension portions extending from tip ends of the base portion toward the movable contactor.

14. The device of claim 13, wherein a gap between the second yoke and a third yoke is opposed to side surfaces of the movable contactor at least when the movable contact points come into contact with the fixed contact points.

15. The device of claim 1, wherein at least one of the second yoke and the third yoke comprises a substantially square bracket-like cross-sectional shape and includes a plate-shaped base portion opposed to the movable contactor and a pair of extension portions extending from tip ends of the base portion toward the movable contactor.

16. The device of claim 1, wherein a groove is provided on the opposite surface of the third yoke from the surface thereof making contact with the movable contactor, and one end of a compression spring is fitted to the groove.

17. The device of claim 1, wherein a protrusion is provided on the opposite surface of the third yoke from the surface thereof making contact with the movable contactor, and the protrusion is fitted to one end of a compression spring.

18. The device of claim 1, wherein the fixed contact points are provided as one-piece or independently provided with the fixed terminals.

19. The device of claim 1, wherein the movable contact points are provided as one-piece or independently provided with the movable contactor.

20. A contact device, comprising:

a contact point block including a pair of fixed terminals having fixed contact points and a movable contactor having a pair of movable contact points arranged side by side on one surface of the movable contactor, the movable contact points configured to come into contact and out of contact with the fixed contact points;

a driver that drives the movable contactor such that the movable contact points come into contact and out of contact with the fixed contact points;

a pair of permanent magnets arranged in a mutually opposing relationship across the contact point block along an arrangement direction of the movable contact points, the permanent magnets are provided with mutually-opposing surfaces having the same polarity;

a second yoke arranged between the permanent magnets in a mutually opposing relationship to each of the permanent magnets; and a third yoke that makes contact with the other surface of the movable contactor and opposes the second yoke across the movable contactor.

21. The device of claim 20, further comprising:

a pair of first yokes provided in an opposing relationship with end surfaces of the movable contactor in a direction orthogonal to the arrangement direction of the movable contact points and to the direction in which the movable contact points come into contact and out of contact with the fixed contact points, the first yokes being arranged to interconnect the permanent magnets.

22. The device of claim 20, wherein the permanent magnets are arranged such that centers of mutually-opposing surfaces of the permanent magnets lie on extension lines of a straight line interconnecting the fixed contact points.

23. The device of claim 20, wherein the driver includes a compression spring biasing the movable contactor toward the fixed contact points, a restrainer to restrain the movable contactor from moving toward the fixed contact points, a movable shaft to which the restrainer is connected, and an electromagnet block to drive the movable shaft such that the movable contact points come into contact and out of contact with the fixed contact points.

24. The device of claim 23, wherein the movable shaft includes a shaft portion movably inserted through an insertion hole provided in the movable contactor and a contact portion arranged at one end of the shaft portion to contact said one surface of the movable contactor.

25. The device of claim 24, wherein the first yoke serves as the contact portion of the movable shaft.

26. The device of claim 24, wherein the second yoke serves as the contact portion of the movable shaft and is provided as one-piece with the movable shaft.

27. The device of claim 26, wherein the contact point block is stored within a container, at least a portion of the outer periphery of each of the second yoke and the third yoke making contact with an inner wall of the container.

28. The device of claim 26, wherein at least one of the second yoke and a third yoke comprises a flat plate shape.

29. The device of claim 26, wherein at least one of the second yoke and a third yoke comprises a substantially square bracket-like cross-sectional shape and includes a plate-shaped base portion opposed to the movable contactor and a pair of extension portions extending from tip ends of the base portion toward the movable contactor.

30. The device of claim 26, wherein a groove is provided on the opposite surface of a third yoke from the surface thereof making contact with the movable contactor, and one end of the compression spring is fitted to the groove.

31. The device of claim 26, wherein a protrusion is provided on the opposite surface of a third yoke from the surface thereof making contact with the movable contactor, and the protrusion is fitted to one end of the compression spring.

32. The device of claim 23, wherein the restrainer is arranged to hold the second yoke, the movable contactor and the compression spring and is configured to restrain movement of the movable contactor toward the fixed contact points through the second yoke.

33. The device of claim 20, wherein the contact point block is stored within a container, at least a portion of an outer periphery of the second yoke making contact with an inner wall of the container.

34. The device of claim 20, wherein the second yoke comprises a flat plate shape.

35. The device of claim 20, wherein the second yoke comprises a substantially square bracket-like cross-sectional shape and includes a plate-shaped base portion opposed to the movable contactor and a pair of extension portions extending from tip ends of the base portion toward the movable contactor.

36. The device of claim 35, wherein a gap between the second yoke and the third yoke is opposed to side surfaces of the movable contactor at least when the movable contact points come into contact with the fixed contact points.

37. The device of claim 20, further comprising:

a permanent magnet piece arranged between the permanent magnets, the permanent magnet piece including first surfaces opposing to the permanent magnets and second surfaces opposing to the first yokes, the polarity of the first surfaces of the permanent magnet piece is different from the polarity of the surfaces of the permanent magnets opposing to the first surfaces, and the polarity of the second surfaces of the permanent magnet piece is different from the polarity of the first surfaces.

38. The device of claim 20, wherein the fixed contact points are provided as one-piece or independently provided with the fixed terminals.

39. The device of claim 20, wherein the movable contact points are provided as one-piece or independently provided with the movable contactor.

* * * * *